US006505923B1

(12) United States Patent
Yamamoto et al.

(10) Patent No.: US 6,505,923 B1
(45) Date of Patent: Jan. 14, 2003

(54) LIQUID SUPPLY SYSTEM, LIQUID SUPPLY CONTAINER AND NEGATIVE PRESSURE GENERATING MEMBER CONTAINER USED FOR THE SAME SYSTEM, AND INK JET RECORDING APPARATUS USING THE SAME SYSTEM

(75) Inventors: Hajime Yamamoto, Yokohama (JP); Sadayuki Sugama, Tsukuba (JP); Shozo Hattori, Tokyo (JP); Eiichiro Shimizu, Yokohama (JP); Hirofumi Okuhara, Tokyo (JP); Hiroshi Koshikawa, Kawasaki (JP); Tomoyuki Kaneda, Yokohama (JP); Hiroki Hayashi, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,959

(22) Filed: Jun. 22, 2000

(30) Foreign Application Priority Data

Jun. 24, 1999 (JP) ..... 11-178574
Jun. 24, 1999 (JP) ..... 11-179053

(51) Int. Cl.[7] ..... B41J 2/175
(52) U.S. Cl. ..... 347/85
(58) Field of Search ..... 347/85, 86, 87, 347/92

(56) References Cited

U.S. PATENT DOCUMENTS

| | | | | |
|---|---|---|---|---|
| 5,453,771 A | * | 9/1995 | Waseda et al. | 347/86 |
| 5,509,140 A | | 4/1996 | Koitabashi et al. | 347/86 |
| 5,619,238 A | | 4/1997 | Higuma et al. | 347/86 |
| 5,975,330 A | * | 11/1999 | Sasaki et al. | 220/495.01 |
| 6,022,102 A | * | 2/2000 | Ikkatai et al. | 347/85 |
| 6,174,053 B1 | * | 1/2001 | Higuma et al. | 347/86 |
| 6,345,888 B1 | * | 2/2002 | Matsumoto et al. | 347/86 |
| 6,402,308 B1 | * | 6/2002 | Hattori et al. | 347/86 |

FOREIGN PATENT DOCUMENTS

| | | | |
|---|---|---|---|
| EP | 624 475 | * | 11/1994 |
| EP | 691207 | | 1/1996 |
| EP | 803 364 | * | 10/1997 |
| JP | 7-125232 | | 5/1995 |
| JP | 8-20115 | | 1/1996 |
| JP | 8-034122 | * | 2/1996 |

* cited by examiner

*Primary Examiner*—Michael Nghiem
(74) *Attorney, Agent, or Firm*—Fitzpatrick, Cella, Harper & Scinto

(57) ABSTRACT

By solving the problem of unstable ink supply which occurs due to bubble stagnation in a communication portion at a high ink supply rate per unit time when a fiber absorbent is used as a negative pressure generating member in the ink tank or ink supply system in which a negative pressure generating member container is adjacent to a liquid container, the present invention provides an ink tank and a liquid supply system which supply ink stably.

7 Claims, 29 Drawing Sheets

260b
261
230
266
265
262
263
260a
264

76
77
75a
75b
75c
77a
77b
77c
73a
73b
73c
74a
74b
74c
70
71
72

LIQUID SUPPLY SYSTEM, LIQUID SUPPLY CONTAINER AND NEGATIVE PRESSURE GENERATING MEMBER CONTAINER USED FOR THE SAME SYSTEM, AND INK JET RECORDING APPARATUS USING THE SAME SYSTEM

BACKGROUND OF THE INVENTION

1. Field of the Invention

The present invention relates to a liquid container preferably used in the field of ink jet recording or the like, and more particularly to a liquid supply system whose liquid container can be partially replaceable.

2. Related Background Art

Ink tanks have been proposed which apply negative pressure to an ink discharge head. These tanks are most generally designed so that they use capillary force of porous matter. The ink tanks include porous matter, such as sponge, packed, preferably being compressed, in the entire tanks and an air communication port through which air can be taken in the ink container to supply ink smoothly during printing.

A problem with porous matter used as an ink retaining member is low ink containing capacity per unit volume of the porous matter. To solve this problem, the applicant proposed in Japanese Patent Application Laid-Open No. 7-125232 an ink tank with an ink container which is substantially sealed in whole excluding the communication portion against a capillary force generating member container, which tank is used, with the capillary force generating member container open to the air. The applicant also proposed in Japanese Patent Application Laid-Open No. 6-226990 an ink tank configured as described above whose ink container is replaceable.

In the above-described ink tank, ink is supplied from the ink container to the capillary force generating member container by gas/liquid exchange during which gas is introduced into the ink container as ink leaves the container. Thus the ink tank advantageously allows ink to be supplied under almost constant pressure during gas/liquid exchange. Considering its ease of replacement, the ink tank, disclosed in Japanese Patent Application Laid-Open No. 6-226990, is also technically good.

In Japanese Patent Application Laid-Open No. 8-20115, on the other hand, the applicant proposed an ink tank which uses fibers made of a thermoplastic olefin resin (for example, polypropylene and polyethylene) as a capillary force generating member. The ink tank is good at ink storage stability. It is also easy to recycle because the ink tank enclosure and fibers are made of the same material.

An ink tank in which the above-described capillary force generating member container is adjacent to its corresponding ink container performs gas/liquid exchange, that is; introduces gas into the ink container when supplying ink from the ink container, which has a predetermined capacity, to the capillary force generating member container.

Using fibers made of the above-described olefin resin as an ink absorbent, or the capillary force generating member in the capillary force generating member container, has been found to cause bubbles to stagnate in a communication portion when much ink is supplied in a short time.

Analysis of the phenomenon unique to the fiber absorbent by the inventors has shown that the problem is caused by absorbent characteristics described below.

In contrast to conventional porous material, such as urethane foam, ink absorbents using fibers have the following characteristics:

(1) Because these absorbents have a high porosity, pressure loss due to ink movement is small.

(2) The difference between the leading and trailing angles of contact of ink with fibers is small.

(3) Because gaps between fibers produce capillary force, the difference in local capillary force between urethane sponge cells (about 80 to about 120 $\mu$m in size) is small, compared with ink absorbents formed by foaming urethane and then removing cell membranes.

Thus a plurality of passages from the air communication port to the communication portion are formed during gas/liquid exchange especially when much ink is supplied in a short time. Because of this, much gas floods into the communication portion, thus causing bubbles to stagnate in the communication portion.

On the other hand, the inventors found another technical problem with an ink tank in which the capillary force generating member container is adjacent to its corresponding ink container, which can be replaced by removing it from the capillary force generating member container.

The problem is that enlarging the cross-portional area of the communication portion between the ink container and the capillary force generating member container to cover a high flow rate of about 10 to about 15 g/min, which rate has not been assumed, may cause air to be taken in the ink container, thus disturbing pressure balance between the ink container and the capillary force generating member container when the ink container is attached to the capillary force generating member housing.

SUMMARY OF THE INVENTION

The present invention has been made based on the above-described novel findings. It is a first object of the present invention to provide an ink tank and a liquid supply system which supply ink stably by solving, from a viewpoint different from conventional techniques, the problem of unstable ink supply which occurs due to bubble stagnation in a communication portion at a high ink supply rate per unit time when a fiber absorbent is used as a negative pressure generating member in the ink tank or ink supply system in which a negative pressure generating member container is adjacent to a liquid container.

It is a second object of the present invention, in addition to or independently of the above first object, to provide a liquid supply system which has a simple structure not to make its installation or removal difficult and prevents air to enter an ink supply container when the container is attached to a capillary force generating member container.

It is a third object of the present invention to provide an ink jet recording apparatus using a liquid supply system of the present invention.

To attain the first object, a liquid supply system of the present invention has on the one hand a liquid supply container including a liquid container for storing liquid in a hermetically sealed space and on the other hand a negative pressure generating member container communicating with the above-described liquid container through portions of communication with the liquid supply container and containing a negative pressure generating member and supplies liquid by gas/liquid exchange, that is; by introducing gas through the above-described communication portions into the above-described liquid container and carrying liquid out of the above-described liquid container into the above-described negative pressure generating member container, wherein the above-described communication portions, which number 2, are provided one above the other in the direction of gravitational force.

In the present invention, arranged as described above, the two communication portions provided in the direction of gravitational force allow the liquid supply container including a liquid container for storing liquid in a hermetically sealed space and the negative pressure generating member container containing a negative pressure generating member to communicate with each other. Gas is exchanged with liquid by introducing gas into the liquid container and carrying liquid out of the liquid container into the negative pressure generating member container through these two communication portions. During ordinary liquid supply, gas is exchanged with liquid mainly through the communication portion provided above in the direction of gravitational force if a small amount of liquid is supplied, and only liquid is mainly carried out of the liquid supply container into the negative pressure generating member container mainly through the communication portion provided below in the direction of gravitational force. On the other hand, if a large amount of liquid is supplied, gas moves mainly through the communication portion provided above in the direction of gravitational force while liquid moves mainly through the communication portion provided below in the direction of gravitational force. If one of the communication portions is blocked by stagnant bubbles, gas is exchanged with liquid through the other communication portion. Because gas and liquid are exchanged between the liquid supply container and the negative pressure generating member container using both or either of the two communication portions according to the amount of liquid to be supplied and rate of liquid supply, liquid is stably supplied.

To attain the second object, a liquid supply system of the present invention has on the one hand a liquid supply container for holding liquid in a hermetically sealed space and on the other hand a capillary force generating member container containing a capillary force generating member which can be installed to, or removed from, the liquid supply container and hold liquid, wherein the liquid supply system has a plurality of connection tubes which connect the liquid supply container and capillary force generating member container together, wherein the plurality of connection tubes include gas/liquid exchange connection tubes positioned above vertically and liquid supply connection tubes positioned below vertically, and wherein earlier than the gas/liquid exchange connection tubes, the liquid supply connection tubes allow the liquid supply container to communicate with the capillary force generating member container when the liquid supply container is installed to the capillary force generating member container.

In addition, the present invention provides an ink jet recording apparatus to which the above-described liquid supply systems apply. An ink jet recording apparatus of the present invention has on the one hand a liquid supply system which has one of the above-described structures and on the other hand a liquid discharge head which sprays liquid supplied from the negative pressure generating member container on a recording medium.

BRIEF DESCRIPTION OF THE DRAWINGS

FIG. 35A being a schematic perspective view showing the structure of an ink-jet cartridge which uses a separated liquid supply container, and FIG. 35B being a schematic perspective view showing the structure of an ink-jet cartridge which uses an integrated liquid supply container.

DETAILED DESCRIPTION OF THE PREFERRED EMBODIMENTS

With reference now to the attached drawings, embodiments of the present invention will be explained in detail below.

The following embodiments describe a liquid supply method and liquid supply system using ink as an example of the liquid used, but the applicable liquid is not limited to ink and it goes without saying that in the ink jet recording field, for example, the liquid also includes a processing liquid for a recording medium.

Moreover, the "hardness" of a capillary force generation material in the present invention refers to the "hardness" when the capillary force generation material is placed in a liquid container and is specified by the gradient of repulsion against the amount of deformation of the capillary force generation material (unit: kgf/mm). When comparing the "hardness" of two capillary force generation materials, the one with a greater gradient of repulsion against the amount of deformation is assumed to be a "harder capillary force generation material".

(Embodiment 1)

Figure 1A:
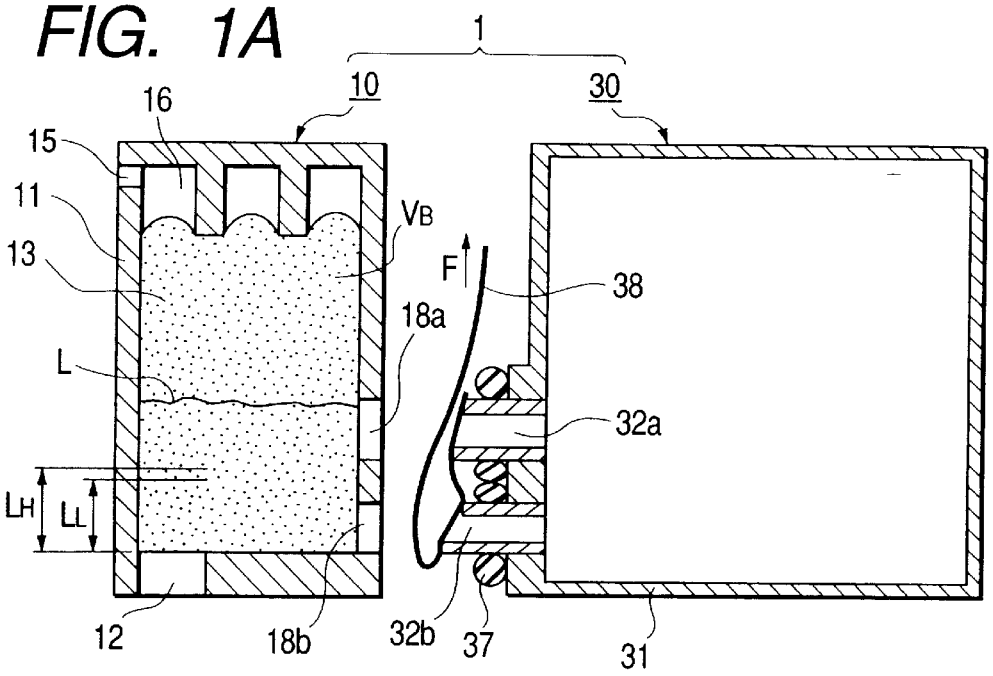
FIGS. 1A, 1B, 1C and 1D illustrate first embodiments of a replaceable liquid supply system of the present invention, FIG. 1A being a cross-portional view of the embodiment with the capillary force generating member container and liquid supply container removed, FIG. 1B being a cross-portional view of the embodiment with the capillary force generating member container and liquid supply container combined together, FIG. 1C showing fibers in the capillary force generating member container, and FIG. 1D being a cross-portional view of one of the fibers.
Figure 1B:
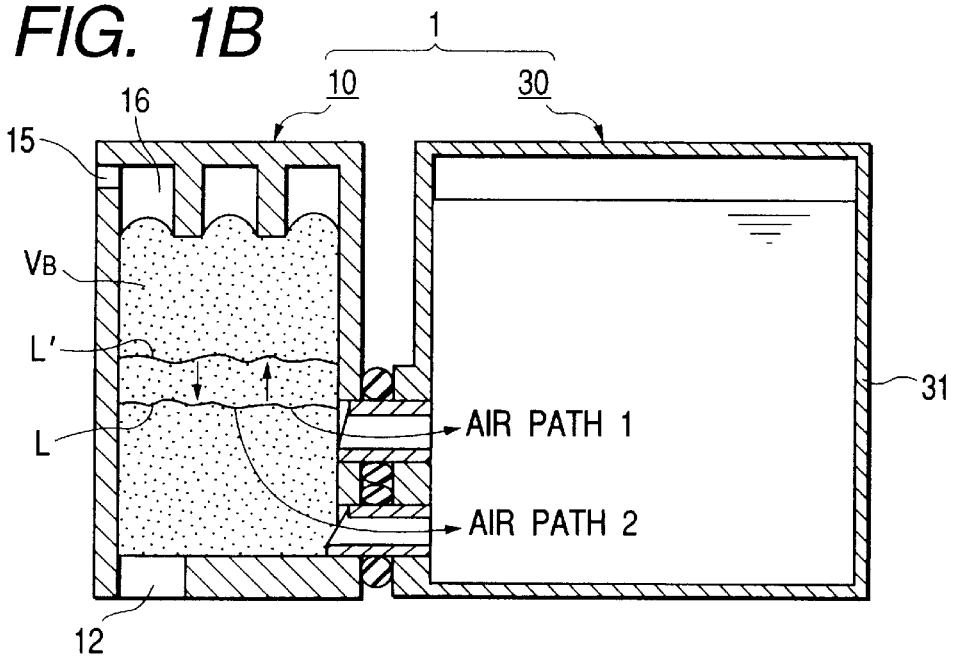
Figure 1C:
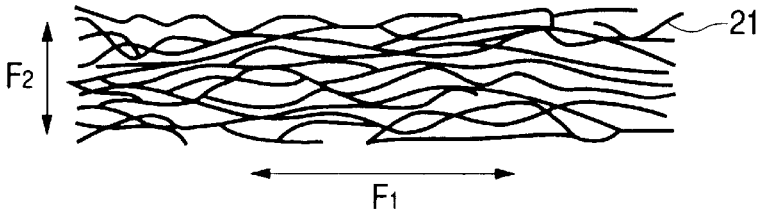
Figure 1D:
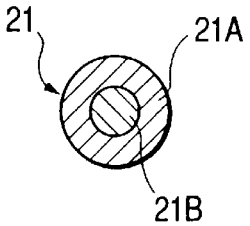

FIGS. 1A to 1D are drawings to explain a first embodiment of a replaceable liquid supply system of the present invention and FIG. 1A is a cross-portional view of a capillary force generation material container and a liquid supply container when these two containers are disconnected, FIG. 1B is a cross-portional view of the capillary force generation material container and the liquid supply container when these two containers are connected, FIG. 1C illustrates fiber inside the capillary force generation material container 10 and FIG. 1D is a cross-portional view of one piece of the fiber.

The ink tank 1 is configured by a capillary force generation material container 10 serving as a container for the capillary force generation material and a liquid supply container 30 serving as a container for ink and the liquid supply container 30 is detachable from the capillary force generation material container 10 by the medium of gas-liquid exchange paths 14*a* and 14*b*.

The capillary force generation material container 10 is equipped with a container 11 having an ink supply port 12 that supplies ink (including a processing liquid) to the outside such as a recording head portion that performs recording by discharging a liquid through a discharge port, a capillary force generation material 13 configured by blended fiber of polypropylene and polyethylene, etc. (can also be 2-axis fiber using resin having relatively a low melting point as a sheath material and resin having a relatively high melting point as a core material) placed inside the container 11 and communication openings 18*a* and 18*b* having contact with the capillary force generation material 13 to introduce a liquid from the liquid supply container 30. The container 11 is also provided with an air vent 15 so that the capillary force generation material 13 inside has contact with external air. Near this air vent 15 is a buffer space 16 formed by ribs protruding from the inner surface of the container 11.

On the other hand, the liquid supply container 30 directly contains ink in the container 31 and is provided with ink paths 32*a* and 32*b*, which are connected to the communication openings 18*a* and 18*b* of the capillary force generation material container 10 to introduce the liquid contained in the container 31 (liquid containing portion) into the capillary force generation material container 10. In this embodiment, the ink paths 32*a* and 32*b* are protruding from the container 31 and by connecting the ink paths 32*a* and 32*b* to the communication openings 18*a* and 18*b* provided for the capillary force generation material container 10, communication portions 14*a* and 14*b* are formed to communicate the liquid supply container 30 with the capillary force generation material container 10 and the liquid containing portion of the liquid supply container 30 forms a substantially airtight space against the external air except this communication portion. Here, the joint between the ink paths 32*a* and 32*b* and the communication portion opening 18 is provided with a sealing material 37, for example, an O ring to prevent ink from leaking from the joint or prevent air from entering. Furthermore, the ink paths 32*a* and 32*b* are provided with a film 38 as a sealing means to prevent ink from leaking through ink paths 32*a* and 32*b* before connecting the liquid supply container 30 to the capillary force generation material container 10 and this film can be peeled away from the ink paths 32*a* and 32*b* by pulling it toward F in the figure.

Here, the capillary force generation material 13 of this embodiment will be explained in further details below.

The capillary force generation material 13 of this embodiment is configured by blended fiber of polypropylene and polyethylene and each piece of fiber composing the capillary force generation material 13 of this embodiment has a length of approximately 60 mm. As shown in FIG. 1D, this fiber 21 has a cross-portion of a quasi-concentric shape and is made up of a sheath material 21A in which polyethylene with a relatively low melting point is disposed and core material 21B in which polypropylene with a relatively high melting point is disposed. The capillary force generation material 13 of this embodiment is manufactured by arranging the fiber direction of a fiber lump made up of short fiber using a carding machine, then heating it (it is desirable to set a heating temperature higher than the melting point of polyethylene with a relatively low melting point and lower than the melting point of polypropylene with a relatively high melting point) and cutting it to desired lengths.

Thus, as shown in FIG. 1C, each piece of fiber is mainly arrayed consecutively in the longitudinal direction (F1) in which it is arranged by the carding machine and at the same time it is structured to have connections in the direction perpendicular to this direction (F2), by means of fusion of some points of interportion between fiber pieces due to thermoforming. Thus, the capillary force generation material 13 is strong against a tensile force in the F1 direction in the figure but is easily separated if a tensile force is applied in the direction F2 in the figure because the link between fiber pieces is destroyed.

The capillary force generation material 13 made of fiber produces capillary force from gaps between fiber pieces. The capillary force generation material of this embodiment has the main fiber direction (F1) and the fluidity of ink and how to retain ink in a static condition differ between the main fiber direction (F1) and the fiber direction perpendicular to the main fiber direction (F2).

This embodiment arranges this capillary force generation material 13 so that the main fiber direction (F1) is oriented in the quasi-horizontal direction and almost parallel to the direction from the communication portion to the ink supply port 12. Thus, as shown in FIG. 1B, a gas-liquid interface L inside the capillary force generation material 13 with a liquid supply container 30 connected is quasi-horizontal, that is, parallel to the main fiber direction F1 and even if an environmental variation occurs, the gas-liquid interface L' maintains its quasi-horizontal direction and the gas-liquid interface returns to its original position L once the environmental variation is settled, preventing the variation of the gas-liquid interface L from increasing in the direction of gravity according to the number of cycles of the environment variation. As a result, when the liquid in the liquid supply container 30 is used up and the liquid supply container 30 is replaced with a new one, as shown in FIG. 1A, its gas-liquid interface L is maintained in a quasi-horizontal state, preventing the buffer space VB from reducing even if the number of times the liquid supply container 30 is replaced is increased.

In this way, in order to stabilize the position of the gas-liquid interface L in a gas-liquid exchange operation irrespective of environmental variations, it is desirable to provide a layer having the main fiber array component in the top end area of the communication portion as the joint (communication opening 18 in the case of this embodiment), or more preferably the area including the area superior to the top end. From a different point of view, this layer can be located in an area connecting the ink supply port 12 and the top end of the communication opening 18, and from a further different point of view, this area can be located on the gas-liquid interface L during a gas-liquid exchange operation. If the latter is viewed from an operational standpoint, the fiber layer having this array directionality acts to make the gas-liquid interface 1 in the capillary force generation material 13 horizontal and has a function of regulating variations in the vertical direction of the gas-liquid interface 1 in the capillary force generation material 13 accompanying the movement of the liquid from the liquid supply container 30.

Having such a layer in the capillary force generation material 13, the gas-liquid interface L in this area can suppress variations in the direction of gravity. In this case, it is more desirable that the main fiber array component be almost parallel to the longitudinal direction in the cross portion of the capillary force generation material 13 in the horizontal direction because the longitudinal direction of the fiber can be used effectively.

Here, theoretically, the above described effect can be produced if the fiber array direction is inclined from the vertical direction no matter how little it is but a definite effect has been confirmed when its inclination is within the range of ±30° with respect to the horizontal plane. Therefore, suppose "quasi" of "quasi-horizontal" includes the above inclination in this specification.

In this embodiment, the main fiber array component is equally configured also in the area lower than the top end of the communication opening 18. Thus, in the gas-liquid exchange operation shown in FIG. 1B, this prevents the gas-liquid interface L from varying in the area lower than the top end of the communication opening 18, eliminating the possibility of any ink supply defect due to an ink shortage.

Moreover, in this embodiment, the longitudinal direction on the cross portion in the horizontal direction of the capillary force generation material 13 coincides with the direction from the communication openings 18*a* and 18*b* to the ink supply port 12. Thus, even when ink is discharged at high speed from the ink supply port 12, the fluidity of ink is excellent in the longitudinal direction of fiber having an effect of insuring a stable supply of ink without causing a shortage of ink in the middle of supply.

Furthermore, in this embodiment, the capillary force generation material container 10 and the liquid supply container 30 are connected via two ink paths 32*a* and 32*b*. However, during a normal ink supply, if the amount of ink supply is small, gas-liquid exchange is mainly performed through air path 1 via ink path 32*a* and only a liquid is mainly introduced from the liquid supply container 30 to the capillary force generation material container 10 via the ink path 32*b*. However, if, for example, the amount of ink supply is extremely small, ink transport or gas transport need not be carried out via the ink path 32*b*. Furthermore, if, for some reasons, an air path 2 is formed via the ink path 32*b*, gas-liquid exchange can be performed using the ink path 32*b*.

Moreover, if the amount of ink supply is large, a gas can be mainly transported via the ink path 32*a* and a liquid can be mainly transported via the ink path 32*b*.

Here, if, for example, ink is supplied to the outside at high speed, multiple air paths may be formed in addition to the air paths 1 and 2, and in that case, bubbles may be trapped in the ink path 32*a* blocking the ink path 32*a*. In that case, gas-liquid exchange can be performed using the air path 2 via the ink path 32*b*.

(Embodiment 2)

Figure 2A:
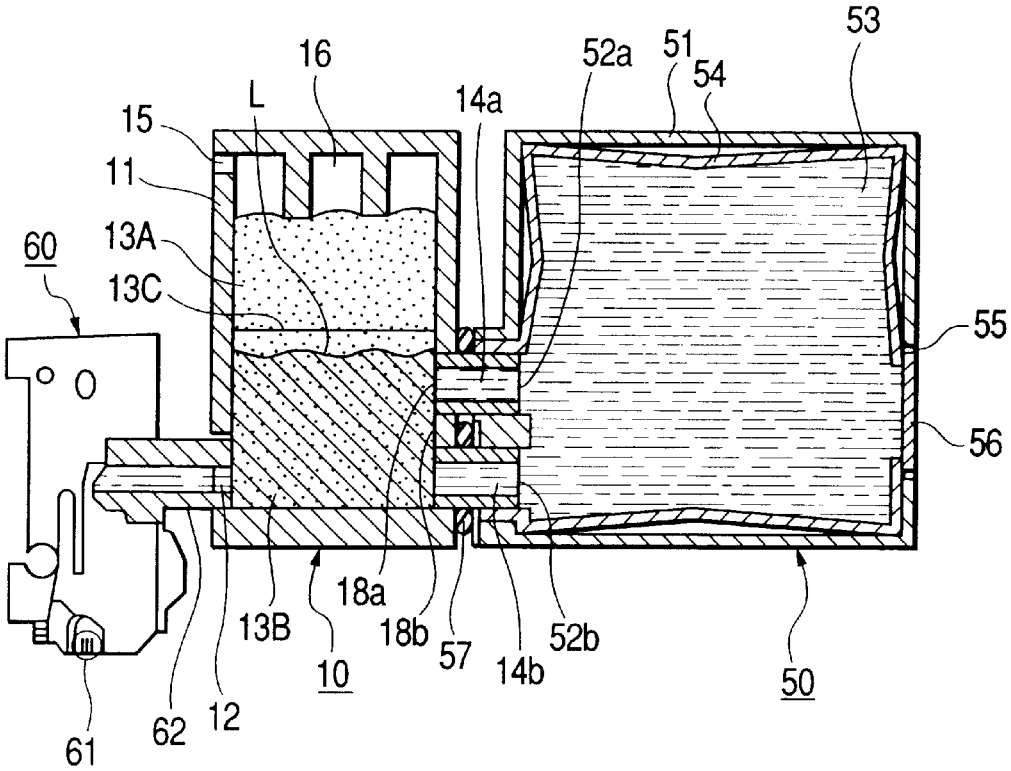
FIGS. 2A and 2B illustrate second embodiments of an ink tank to which a replaceable liquid supply system of the present invention can apply, FIG. 2A being a schematic cross-portional view of the embodiment, and FIG. 2B being a cross-portional view of an essential part of a modification.
Figure 2B:
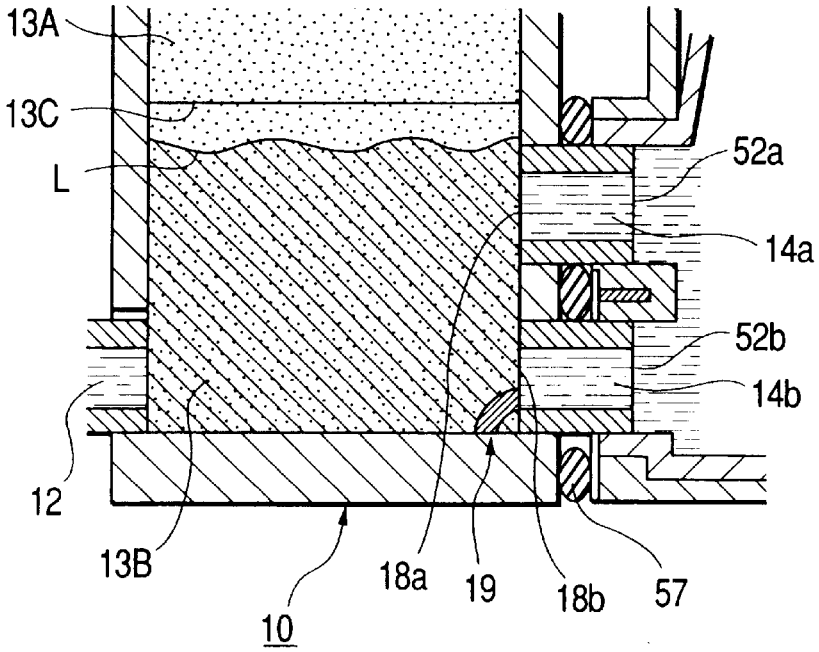

FIGS. 2A and 2B are drawings to explain a second embodiment on an ink tank to which the replaceable liquid supply system of the present invention is applicable and FIG. 2A is an outlined cross-portional view and FIG. 2B is a cross-portional view of the main part of its modification example.

As shown in FIGS. 2A and 2B, this embodiment differs from the first embodiment in the shape of the communication openings 18*a* and 18*b*, configuration of the capillary force generation material 13 and structure of the liquid supply container. Therefore, the capillary force generation material container 10 and liquid supply container 50 will be explained below separately, centered on the differences between the first embodiment and this embodiment.

(1) Capillary force generation material container

The capillary force generation material container 10 in this embodiment is provided with communication pipes (gas-liquid exchange paths) 14*a* and 14*b* that have contact with the capillary force generation material 13 through the communication openings 18*a* and 18*b* in the first embodiment to introduce a liquid from the liquid supply container 50. Furthermore, the capillary force generation material 13 consists of a first capillary force generation material 13A that communicates with the air vent and a second capillary force generation material 13B that has close contact with the first capillary force generation material 13A and contains fiber as in the case of the first embodiment, and the interface 13C between these materials is provided above the top end of the communication opening 18 as a path in the operating position.

By dividing the capillary force generation material 13 into a plurality of materials (two parts in FIGS. 2A and 2B) and providing their interface above the top end of the communication opening 18*a* as the path in the operating position, if ink exists in both materials, the ink in the upper capillary force generation material 13A can be first used up and then the ink in the lower capillary force generation material 13B can be used. Furthermore, when the gas-liquid interface L fluctuates due to environmental variations, after filling the second capillary force generation material 13B and the area around the interface 13C between the two capillary force generation materials 13, the ink enters the first capillary force generation material 13A. Therefore, it is possible to stably secure part of the capillary force generation material in the capillary force generation material container 10 as a buffer area other than the buffer space 16 in addition to the effect due to the fiber direction of the second capillary force generation material 13B.

Furthermore, making the capillary force of the second capillary force generation material 13B greater than the capillary force of the first capillary force generation material 13A in this embodiment ensures that ink is consumed from the first capillary force generation material 13A first.

Moreover, the interface layer 13C between the first capillary force generation material 13A and the second capillary force generation material 13B is pressed between two materials, and so compressibility near the interface layer 13C of the capillary force generation material 13 is higher than other portions, having a stronger capillary force. That is, suppose the capillary force of the first capillary force generation material 13A is P1, the capillary force of the second capillary force generation material 13B is P2 and the capillary force of the interface 13C and adjacent area (interface layer) is PS, then these have a relation of P1<P2<PS. With the provision of the interface layer with such a strong capillary force, even if the range of capillary force of P1 and P2 taking into account density variations overlaps due to density variations in the first capillary force generation material 13, the presence of the capillary force in the interface that satisfies the above conditions ensures the above described effect.

Here, the method of configuring the interface 13C in this embodiment will be explained below.

In this embodiment, the first capillary force generation material 13A is a capillary force generation material (P1=−80 mmAg.) using an olefin-based resin fiber material (6 denier) having a hardness of 1.88 kgf/mm. The hardness of capillary force generation material is obtained by measuring repulsion when the capillary force generation material is pushed into the capillary force generation material container using a ϕ15 mm rod and calculating the gradient of repulsion with respect to the amount of pushing.

On the other hand, the second capillary force generation material 13B is a capillary force generation material using the same olefin-based resin fiber material as the first capillary force generation material 13A and has stronger capillary force (P2=−110 mmAg.) with finer fiber material (2 denier) and lower rigidity of the absorbent (0.69 kgf/mm).

As shown above, the capillary force generation materials are combined so that the capillary force generation material with a smaller capillary force is harder than the capillary force generation material with a stronger capillary force. Then, by pressing them against each other in the interface between the capillary force generation materials of this embodiment, the part of the second capillary force generation material 13B close to the interface remains as it is and the part of the first capillary force generation material 13A close to the interface is crushed, and this results in the strengths of capillary force becoming P1<P2<PS. Furthermore, it is possible to ensure that the difference between P1 and PS is equal to or greater than the difference between P1 and P2. Here, with respect to the capillary force generation material, it is also possible to form a space 19 by partially separating the communication pipe from the lower end of the contact portion as shown in FIG. 2B.

(2) Liquid supply container

The liquid supply container 50 of this embodiment is formed by so-called direct blow molding. Though details will be described later, it is configured by a container (external wall) 51 composing the container and a wall (inner wall) 54 having an inner surface equivalent to or analogous to the inner surface of the container, incorporates an ink container 53 that contains ink and ink paths 52*a* and 52*b* connected to the gas-liquid exchange paths 14*a* and 14*b* of the capillary force generation material container 10 to introduce a liquid from the liquid container 53 into the capillary force generation material container 10.

In this embodiment, sealing materials 57 such as O rings are provided for couplings between the ink paths 52*a* and 52*b* and the gas-liquid exchange paths 14*a* and 14*b* to prevent ink from leaking or air from entering through the couplings. The inner wall 54 has flexibility and the ink container 53 is deformable according to discharging of ink contained. Furthermore, the inner wall 54 is provided with a pinch-off portion 56 and the inner wall 54 is supported, engaged with the external wall 51 by means of this pinch-off portion 56. The external wall 51 is provided with an external air vent 55 letting in air between the inner wall 54 and external wall 51.

Here, the liquid supply container 50 of this embodiment is configured by 6 planes forming a quasi-rectangular parallelepiped shape with cylindrical ink paths 52*a* and 52*b* added as curved surfaces and the plane with the maximum area of this rectangular parallelepiped is indirectly displayed in FIGS. 2A and 2B. The inner wall 54 is thinner in the vertices than the central part of each plane (hereinafter referred to as "corner portion" including a case where the vertices have a shape of micro curved surface) with its thickness gradually reducing from the central area of each plane to each of the above corner portions, having a convex shape inside the ink container 53. In other words, this direction is equal to the direction of deformation of the plane, having an effect of promoting deformation, which will be described later.

Moreover, since the corner portions of the inner wall 54 are configured by three planes, the strength of the corner portions of the inner wall 54 as a whole is relatively stronger than the strength of the central area. Furthermore, when viewed from extension of the plane, the inner wall is thinner in the corner portions than in the central area, allowing the plane to move, which will be described later. It is desirable that the parts configuring the corner portions of the inner wall 54 have quasi-identical thickness.

Since FIGS. 2A and 2B are schematic diagrams, the external wall 51 and internal wall 54 of the ink container are drawn as have been separated by a space, but the external wall 51 and internal wall 54 actually only need to be made separable from each other and it does not matter whether the external wall 51 and internal wall 54 touch each other or they are configured separated by a micro space.

In contrast to the first embodiment in which the moment the air enters the liquid supply container 30, ink inside the liquid supply container 50 is supplied to the capillary force generation material container 10, with the liquid supply container 50 of this embodiment whose ink container 53 is deformable, the ink inside can be supplied to the capillary force generation material container 10 even if no air is introduced into the ink container 53. On the contrary, even if air is introduced into the liquid supply container 50 as ink is consumed, ink may not be supplied to the capillary force generation material container 10 immediately. These phenomena are attributable to a dynamic and static balance of the negative pressure between the ink container 53 and capillary force generation materials 13A and 13B.

Though specific examples of this operation will be explained below, this configuration of the present invention can have a gas-liquid exchange operation different from the conventional ink tank configuration (having different timing from that of conventional gas-liquid exchange) and a time difference between discharging of ink from the ink container 53 during this gas-liquid exchange and introduction of a gas into the ink container 53 can produce a buffer effect against external factors, for example, drastic consumption of ink, environmental change and vibration and the timing difference can increase reliability for more stable ink supplies.

First, an outline of an ink consumption operation after the liquid supply container 50 shown in FIG. 2A is coupled with the capillary force generation material container 10 until the ink in the container is consumed will be given below.

Figure 3A:
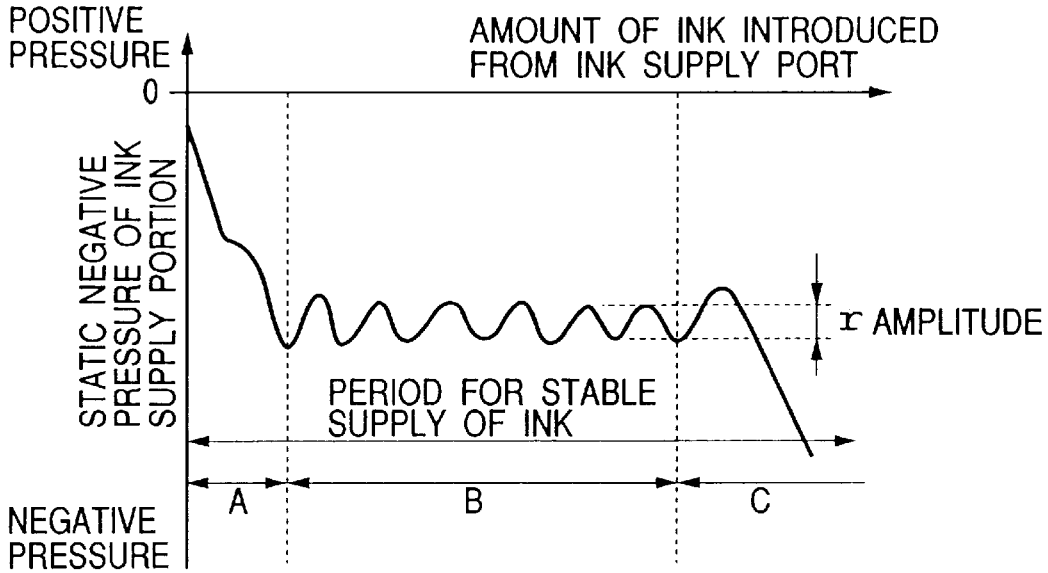
FIGS. 3A and 3B illustrate ink consumptions in the ink supply system in FIGS. 2A and 2B, FIG. 3A showing the amount of ink carried out by static negative pressure in the ink supply portion, and FIG. 3B being the amount of air introduced into the ink container and that of ink carried out of the portion.
Figure 3B:
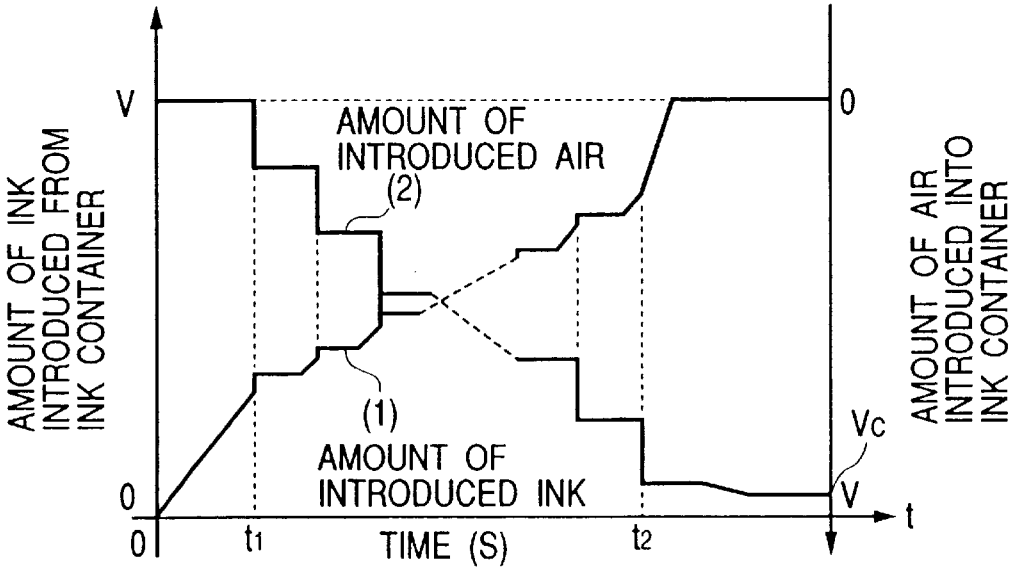

FIGS. 3A and 3B are drawings to explain the ink consumption operation in the ink supply system shown in FIGS. 2A and 2B. FIG. 2A illustrates the amount of ink introduced versus the static negative pressure of the ink supply portion and FIG. 2B illustrates the amount of air introduced into the ink container 53 and the amount of ink introduced from the ink container 53.

When the liquid supply container 50 is connected to the capillary force generation material container 10 forming the gas-liquid exchange paths 14*a* and 14*b*, ink moves through the gas-liquid exchange paths 14*a* and 14*b* until the static negative pressure produced by the capillary force generation material 13 in the capillary force generation material container 10 becomes equal to the pressure of the ink container 53 in the liquid supply container 50, making ink ready for use, and when consumption of ink is started by a liquid discharge/recording unit (a recording head portion 60 provided with a discharge port 61 and ink discharge pipe 62, etc. as shown in FIGS. 2A and 2B), the ink retained by both the ink container 53 and capillary force generation material 13 is consumed (a first ink supply state: area A in FIG. 3A) while keeping a balance in the direction in which the values of the static negative pressures generated by both the ink container 53 and capillary force generation material 13 increase.

Then, when a gas is introduced into the ink container 53, the capillary force generation material 13 enters into a gas-liquid exchange state (a second ink supply state: area B in FIG. 3A) in which the capillary force generation material 13 retains an almost constant negative pressure for the ink introduce while maintaining the gas-liquid interface L and then begins to consume the ink remaining in the capillary force generation material container 10 (area C in FIG. 3A).

Figure 4A:
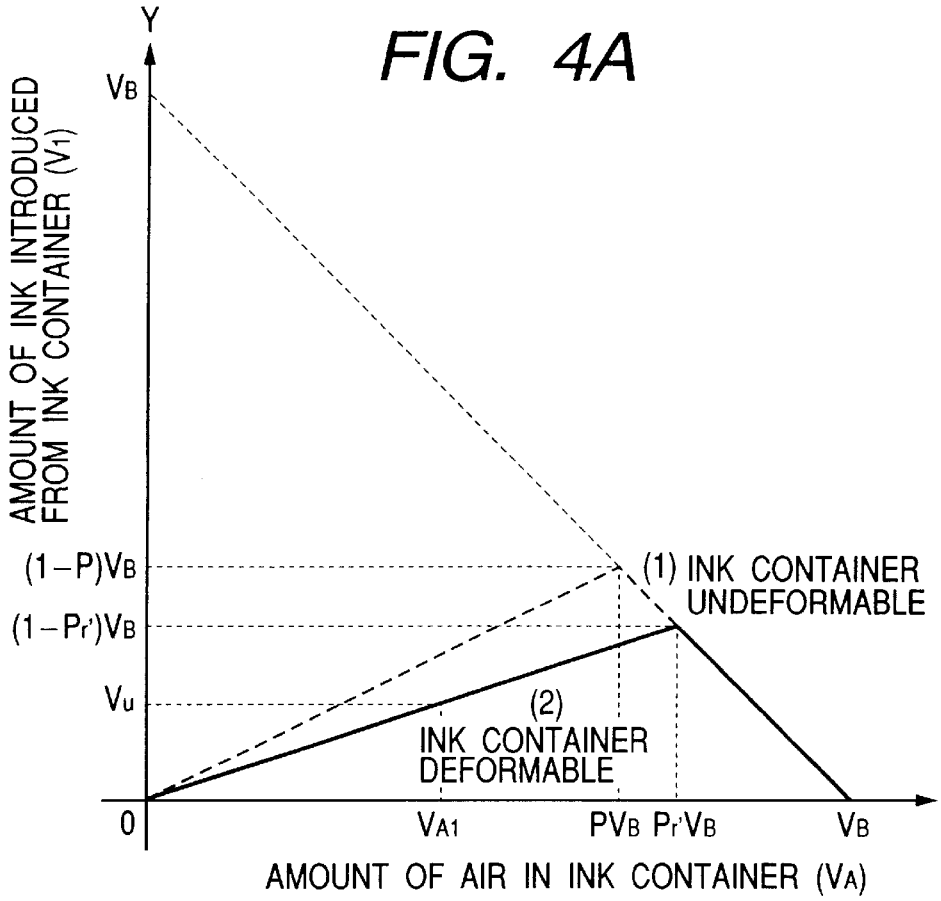
FIGS. 4A and 4B illustrate the effects of reducing internal-pressure variations due to deformation of the ink container of the liquid supply system in FIGS. 2A and 2B, FIG. 4A showing the relationship between the amount of air in the ink container and that of ink carried out of the ink container, and FIG. 4B showing changes in the amount of ink carried out of the ink container with time.

FIG. 4A is a schematic diagram showing an example of a rate of change of the negative pressure at the ink supply port 12 at this time. The horizontal axis expresses the amount of ink discharged from the ink supply port to the outside and the vertical axis expresses the negative pressure (static negative pressure) at the ink supply port.

As shown above, since the ink tank of the present invention has a process of using ink in the ink container 53 without introducing the air into the ink container 53, it is only necessary to consider the air introduced into the ink container 53 at the time of coupling with respect to restrictions on the internal volume of the liquid supply container 50 in this ink supply process (the first ink supply state). As a result, the ink tank of the present invention has an advantage that it can adapt to environmental changes even if the restrictions on the internal volume of the liquid supply container 50 are alleviated.

Moreover, a negative pressure can be stably generated irrespective of the state of the above areas A, B and C in which the liquid supply container 50 is replaced, thereby ensuring a reliable ink supply operation. That is, the ink tank of the present invention not only allows ink in the liquid supply container 50 to be almost completely consumed but also allows inclusion of air in the gas-liquid exchange paths 14*a* and 14*b* at the time of replacement, making it possible to replace the liquid supply container 50 without regard to the amount of ink retained in the capillary force generation material 13, thus providing an ink supply system capable of replacing the liquid supply container 50 without the need to provide a residual quantity detection mechanism as in the prior art.

Here, a series of operations in the ink consumption process described above will be explained in FIG. 3B from another viewpoint.

FIG. 3B shows the time on the horizontal axis and an example of the amount of ink introduced from the ink container and the amount of air introduced into the ink container 53 on the vertical axis. Here, suppose the amount of ink supply from the recording head 60 during this lapse of time is constant.

In the above viewpoint, the amount of ink introduced from the ink container is expressed by solid line (1) and the amount of the air introduced into the ink container is expressed by solid line (2).

The period from t=0 to t=t1 corresponds to the area before gas-liquid exchange (area A) shown in FIG. 3A takes place. In this area, as described above, ink is discharged from the head while keeping a balance between the ink from the capillary force generation material 13 and the ink from the ink container 53.

Then, the period from t=t1 to t=t2 corresponds to the gas-liquid exchange area (area B) in FIG. 3A. In this area, gas-liquid exchange takes place based on the above described negative pressure balance. As expressed by solid line (1) in FIG. 3B, when the air is introduced into the ink container 53 (expressed by the level difference of solid line (2)), ink is discharged from the ink container 53. In this case, the amount of ink equivalent to the amount of the air introduced is not immediately discharged from the ink container 53 following the introduction of the air, but the amount of ink equivalent to the amount of the air finally introduced is discharged after, for example, a lapse of a predetermined time following the introduction of the air. As is clear from this figure, this produces a timing difference unlike the operation of the conventional ink tank whose ink container 53 is not deformed. As shown above, this operation is repeated in the gas-liquid exchange area. The relationship between the amount of air and the amount of ink in the ink container 53 is reversed at a certain point.

When t=t2 is passed, the area after gas-liquid exchange (area C) shown in FIG. 3A is entered. In this area, the pressure in the ink container 53 reaches the quasi-atmospheric pressure as described above. Following this, an operation of returning to the initial state (state prior to the start of use) is started by the elastic force of the inner wall 54 of the ink container 53. However, the initial state cannot be restored completely due to so-called buckling. Thus, the final amount of the air introduced into the ink container 53 Vc becomes (V>Vc). In this area, too, all the ink from the ink container is used up completely.

As described above, one of features of phenomena of the gas-liquid exchange operation in this configuration of the present invention is that pressure variation during gas-liquid exchange (periodic variation of amplitude r in FIG. 3A) is relatively large compared to the conventional ink tank system that performs gas-liquid exchange.

This is because the inner wall 54 is deformed toward the inside of the tank due to ink discharge from the ink container 53 before gas-liquid exchange takes place. An outgoing force always applies to the inner wall 54 of the ink container 53 resultant from the elastic force of the inner wall 54. Because of this, to alleviate the pressure difference between the capillary force generation material 13 and ink container 53 during gas-liquid exchange, the air exceeding a predetermined value often enters the ink container as described above. Because of this, the amount of ink discharged from the ink container 53 to the capillary force generation material container 10 also tends to grow. In contrast, in the case of the conventional system having an ink container that is not deformable, introduction of a predetermined amount of air immediately causes ink to discharge to the capillary force generation material container 10.

For example, when performing 100% duty (solid mode) printing, a large quantity of ink is discharged from the head at a time. This is accompanied by drastic discharge of ink from the tank. The ink tank with the configuration according to the present invention, however, has relatively more ink discharge by gas-liquid exchange than the conventional configuration, which prevents an ink shortage and improves reliability.

Furthermore, with the configuration according to the present invention, since ink is discharged with the ink container 53 deformed inward, it also has a further advantage of having a high buffer effect on external factors such as vibration of the carriage and environmental variation.

As described above, the ink supply system of this embodiment can alleviate micro variations in the negative pressure through the ink container 53 and the configuration of this embodiment can further adapt to environmental variations in the case where the ink container 53 contains air, for example, in the second ink supply state by taking measures different from the conventional ones.

Then, a mechanism for stable retaining of the liquid of the ink tank shown in FIGS. 2A and 2B under varying environmental conditions will be explained using FIGS. 4A and 4B.

Figure 4B:
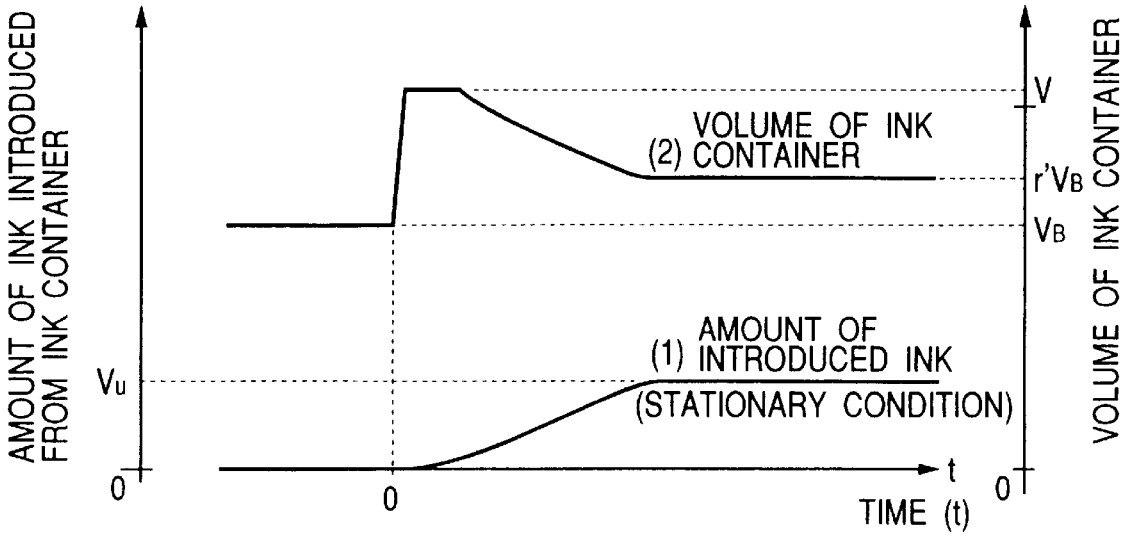

FIGS. 4A and 4B are drawings to explain an inner pressure variation suppression effect by deformation of the ink container 53 of the liquid supply system shown in FIGS. 2A and 2B. FIG. 4A illustrates the amount of ink introduced from the ink container versus the amount of air introduced into the ink container and FIG. 4B illustrates a time variation of the amount of ink introduced from the ink container.

According to the configuration of this embodiment, when the air in the ink container expands due to a decrease of the atmospheric pressure (or a temperature rise), the wall of the ink container 53 and liquid level are pressed and the inner volume of the ink container 53 increases and part of the ink flows out from the ink container 53 through the gas-liquid exchange path to the capillary force generation material container 10. Here, because the inner volume of the ink container 53 increases the amount of the ink introduced into the capillary force generation material 13 is by far smaller than the case where the ink container 53 is not deformable. Here, when the atmospheric pressure changes drastically, since the amount of ink flowing out through the gas-liquid exchange paths 14*a* and 14*b* alleviates the negative pressure inside the ink container 53 and increases the inner volume of the ink container 53, the resistant force on the wall surface produced by alleviating the inward deformation of the inner wall 54 of the ink container 53 and the resistant force for moving the ink and making the capillary force generation material 13 absorb the ink exert a dominant influence in the initial stage.

In this configuration in particular, since the flowing resistance of the capillary force generation material 13 is greater than the resistance against the restoring force of the ink container 53, the inner volume of the ink container 53 increases with an expansion of the air first. Then, if the voluminous increase due to the expansion of the air is greater than the upper limit of this increment, the ink flows out from the ink container 53 through the gas-liquid exchange paths 14*a* and 14*b* into the capillary force generation material container 10. That is, since the wall of the ink container 53 functions as a buffer against an environmental variation, the ink in the capillary force generation material 13 moves slowly, stabilizing the negative pressure characteristic at the ink supply port 12.

In this embodiment, the ink introduced into the capillary force generation material container 10 is retained by the capillary force generation material 13. In this case, the amount of ink in the capillary force generation material container 10 temporarily increases and the gas-liquid interface level increases, temporarily producing an inner pressure toward the positive side a little more than the ink inner pressure stabilization period as in the case of the beginning of use. However, the influence on the discharge characteristic of the liquid discharge recording means such as the recording head 60 is small and there is no problem in practical use. Furthermore, when the atmospheric pressure is restored to the level prior to decompression (returned to 1 atm.) (or returned to the original temperature), the ink leaked out into the capillary force generation material container 10 and retained by the capillary force generation material 13 returns to the ink container 53 again and the volume of the ink container 53 returns to its original state.

Then, the principle of operation when a stationary condition is reached under the changed atmospheric pressure after the initial operation following the atmospheric variation will be explained.

What is characteristic in this state is that the level of the ink retained in the capillary force generation material 13 changes in such a way as to keep a balance in not only the amount of ink introduced from the ink container 53 but also against the variation of the negative pressure due to a voluminous variation of the ink container 53 itself.

Here, regarding the relationship between the amount of ink absorbed by the capillary force generation material 13 and the liquid supply container 50, it is possible, from the standpoint of preventing leakage of ink from the air vent, etc. due to the aforementioned decompression or temperature variation, to decide the maximum amount of ink absorption of the capillary force generation material container 10 taking into account the amount of ink discharge from the liquid supply container 50 under the worst condition and the amount of ink retained by the capillary force generation material container 10 during ink supply from the liquid supply container 50 and provide a volume enough to contain the capillary force generation material 13 corresponding at least to that amount for the capillary force generation material 10.

FIG. 4A shows the initial spatial volume (volume of air) of the ink container 53 before decompression on the horizontal axis (X) and the amount of ink discharge when the pressure is decompressed to P atm. (0<P<1) on the vertical axis (Y) supposing that the ink container 53 does not deform at all despite an expansion of air and dotted line (1) shows this relationship.

Therefore, the amount of ink discharged from the ink container 53 can be estimated by assuming that if the maximum decompression condition of the atmospheric pressure is, for example, 0.7 atm., it is when ink of 30% of the volume VB of the ink container 53 remains in the ink container 53 that the amount of ink discharged from the ink container 53 reaches a maximum and if the ink below the lower end of the wall of the ink container 53 is also absorbed into the compressed absorbent of the capillary force generation material container 10, all the ink (30% of VB) remaining in the ink container 53 is leaked out.

In contrast, in this embodiment, since the ink container 53 deforms against an expansion of the air, the inner volume of the ink container 53 increases after the expansion and the ink retaining level in the capillary force generation material container 10 changes in such a way as to keep a balance against a variation of the negative pressure due to deformation of the ink container 53. Then, in a stationary condition, the ink from the ink container 53 keeps a balance of the negative pressure with the capillary force generation material 13 whose negative pressure has decreased compared to before the variation in the atmospheric pressure. That is, the amount of ink discharge decreases by the amount of expansion of the ink container 53. The result is expressed by solid line (2). As is clear from this dotted line (1) and solid line (2), the amount of ink discharge from the ink container 53 under the worst condition can be estimated to be smaller than the case where the ink container 53 does not deform at all against an expansion of the air. The above phenomenon equally occurs also when the temperature of the ink tank changes, but the amount of ink discharge even with a temperature rise of approximately 50 deg. is smaller than the above case of decompression.

In this way, the ink tank of the present invention can allow an expansion of the air in the liquid supply container 50 due to an environmental variation not only in the capillary force generation material container 10 but also in the liquid supply container 50 through a buffer effect of increasing the volume of the liquid supply container 50 itself until the external shape of the ink container 53 becomes substantially equal to the inner shape of the container 51 at the maximum, and therefore the present invention can provide an ink supply system flexible to an environmental variation even if the amount of ink contained in the liquid supply container 50 is increased drastically.

Furthermore, if the initial air volume is VA1, when the tank environment is changed from the atmospheric pressure at t=0 to a decompressed environment (0<P<1), the time variations of the amount of ink discharged from the ink container 53 and the volume of the ink container 53 are schematically shown in FIG. 4B. The horizontal axis expresses the time (t) and vertical axis expresses the amount of ink discharged from the ink container 53 and the volume of ink container 53 and solid line (1) shows a time variation of the amount of ink from the ink container 53 and solid line (2) shows a time variation of the amount of the volume of the ink container 53.

As shown in FIG. 4B, against a drastic environmental variation, mainly the liquid supply container 50 can cope with the air expansion before a stationary condition is finally reached where the capillary force generation material container 10 and liquid supply container 50 keep a negative pressure balance. Thus, when a drastic environmental variation takes place, it is possible to retard the timing at which the ink is discharged from the liquid supply container 50 to the capillary force generation material container 10.

Therefore, the present invention can provide an ink supply system capable of supplying ink under a stable negative pressure condition during the use of the liquid supply container 50 in various operating environments with improved flexibility to the expansion of the air introduced from the outside by gas-liquid exchange.

The ink supply system according to the present invention can arbitrarily decide the volume ratio between the capillary force generation material container 10 and ink container 53 by properly selecting the capillary force generation material 13 and the material of the ink container 53 used and even a ratio greater than 1:2 can be put to practical use. Especially when focused on the buffer effect of the ink container 53, the amount of deformation of the ink container 53 in a gas-liquid exchange state when ink is ready for use within the range of elastic deformation can be increased.

As shown above, the liquid supply system together with the configuration of the capillary force generation material container 10 according to the present invention can demonstrate a synergetic effect on variations in the external environment even if the capillary force generation material 13 occupies only a small volume.

Here, in the case of a normal ink jet cartridge, a plurality of tanks is incorporated in a limited space, and so the supply port of the liquid supply container has a slotted-hole shape. When this supply port has a larger slotted-hole shape, the supply pipe of the liquid supply container may be deformed as the ink is discharged. However, this embodiment has a plurality of separated ink paths, thus preventing deformation of the supply pipe.

(Embodiment 3)

Figure 5A:
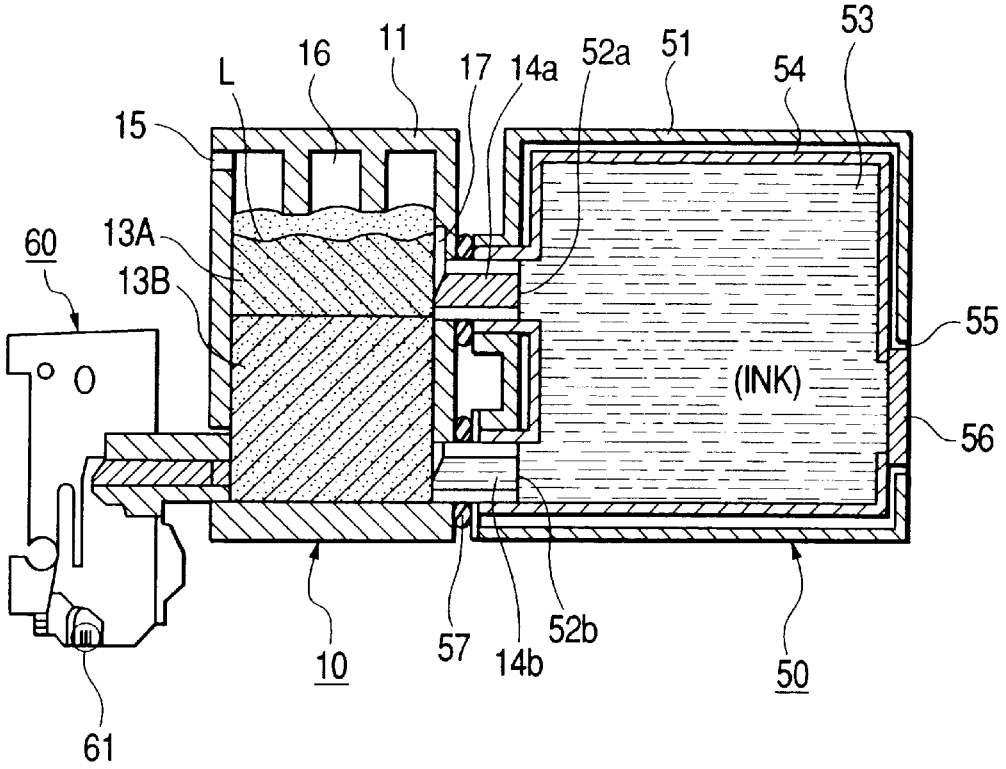
FIGS. 5A, 5B and 5C illustrate third embodiments of a liquid supply system of the present invention, FIG. 5A being a schematic cross-portional view of the embodiment, FIG. 5B showing a bundle of fibers used as a capillary force generating member, and FIG. 5C showing a tube member used as the capillary force generating member.
Figure 5B:
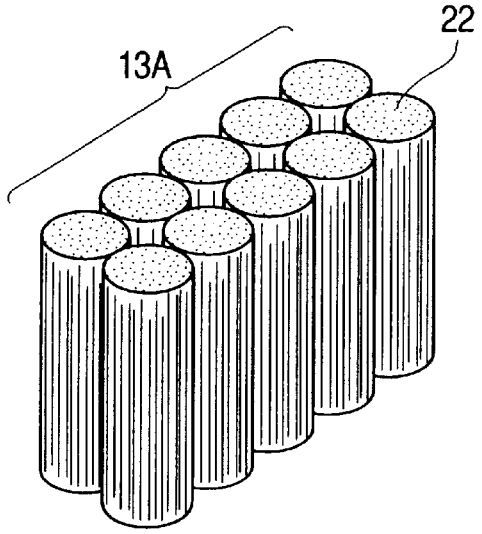
Figure 5C:
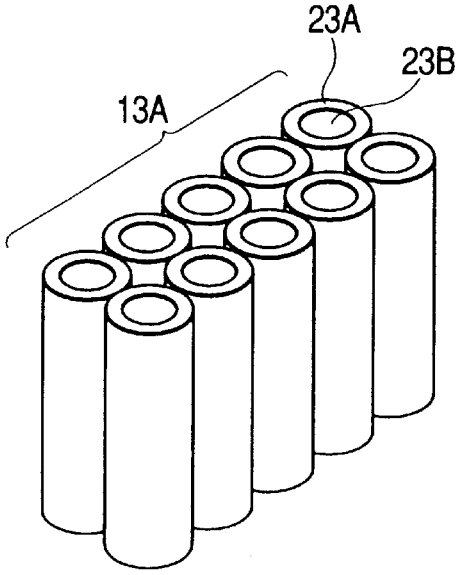

FIGS. 5A to 5C are drawings to explain a third embodiment of the liquid supply system of the present invention. FIG. 5A is an outlined cross-portional view, FIG. 5B illustrates a fiber bundle used as the capillary force generation material and FIG. 5C illustrates a tube-figured material used as the capillary force generation material.

This embodiment differs from the second embodiment in that an air introduction groove 17 to promote gas-liquid exchange is provided at the communication opening in the upper part.

The capillary force generation material container 10 of this embodiment includes the air introduction groove 17 to promote gas-liquid exchange and the above gas-liquid exchange path 14*a* has contact with the capillary force generation material 13A and its one end is connected to the air introduction groove 17 allowing a smooth liquid supply operation.

Moreover, the fiber layer in the aforementioned embodiments is provided in the top end area of the air introduction groove 17 where the gas-liquid interface for a gas-liquid exchange operation is formed. Providing the air introduction groove 17 in this manner has an effect of further stabilizing the position the gas-liquid interface L formed during the gas-liquid exchange operation and further ensuring the effect of the fiber layer provided in the top end area of the air introduction groove 17.

Moreover, since the air introduction groove 17 is continuously formed in the gas-liquid exchange path 14*a,* the air passing through the air introduction groove 17 during the above gas-liquid exchange can preferentially pass through the gas-liquid exchange path 14*a,* thus securing the air path. As a result, the air can easily pass through the gas-liquid exchange path 14*a,* making it easier to introduce the air into the ink container 53 and the ink is introduced from the ink container 53 into the capillary force generation material container 10 more securely and stably through the gas-liquid exchange path 14*b,* making gas-liquid exchange easier irrespective of the amount of ink retained in the capillary force generation material container 10.

While the second and third embodiments use a plurality of capillary force generation materials 13, the capillary force generation material 13A provided in the upper area can be either a cylindrical fiber bundle 22 as shown in FIG. 5B or tube-figured material 23A including an opening 23B as shown in FIG. 5C if at least it functions as a buffer area.

(Embodiment 4)

Figure 6:
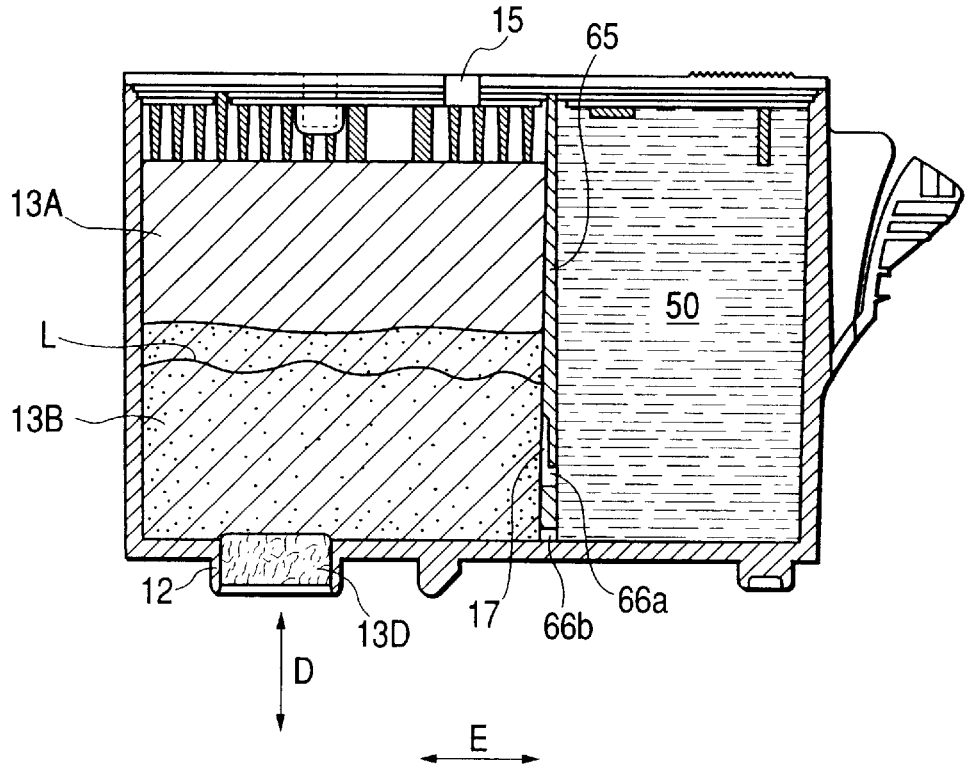
FIG. 6 is a cross-portional view showing a fourth embodiment of a liquid supply container of the present invention.

FIG. 6 shows a cross-portional view of an ink tank of a fourth embodiment of the liquid supply container of the present invention. The parts similar to those in the first to third embodiments are assigned the same reference numerals and their explanations will be omitted.

As shown in FIG. 6, the ink tank of this embodiment has the capillary force generation material container 10 and liquid supply container 50 of the first to third embodiments integrated in one body. That is, the capillary force generation material container 10 and liquid supply container 50 are placed in one container and separated by a partition wall 65. The ink is supplied from the liquid supply container 50 to the capillary force generation material container 10 through paths 66*a* and 66*b*.

Such a configuration eliminates the gas-liquid exchange path 14 between the liquid supply container 50 and the capillary force generation material container 10 in the first embodiment, preventing any unexpected air path from generating in this gas-liquid exchange path 14 due to an environmental variation, thus stabilizing the gas-liquid exchange operation.

The capillary force generation material container 10 of this embodiment includes an air introducing groove 17 to promote gas-liquid exchange and the path 66*a* has contact with the capillary force generation material 13B and its end is also continuous to the air introducing groove 17, allowing a smooth liquid supply operation.

The position of formation of the gas-liquid interface L during a gas-liquid exchange operation of this embodiment is in the top end area of the air introducing groove 17 and is inside the capillary force generation material 13B unlike the third embodiment. Provision of this air introducing groove has an effect of further stabilizing the position of the gas-liquid interface formed during a gas-liquid operation and also has an effect of ensuring the effect of the fiber layer provided in the top end area of the air introducing groove.

The capillary force generation material 13B of this embodiment needs only to be provided with a layer with a main fiber array component in the quasi-horizontal direction in the top end area of the air introducing groove 17, or more ideally, the area superior to the top end to stabilize the position of the gas-liquid interface L during a gas-liquid exchange operation irrespective of environmental variations. From another point of view, this layer needs only to be in the area connecting the ink supply port 12 and the top end area of the air introducing groove 17, and from still other point of view, this area needs to be on the gas-liquid interface during a gas-liquid exchange operation. If the latter is viewed from a operational point of view, the fiber layer having this array directionality has an effect of leveling the gas-liquid interface in the capillary force generation material in a liquid supply operation through gas-liquid exchange, having a function of regulating variations in the vertical direction of the gas-liquid interface L in the capillary force generation material caused by movement of the liquid from the liquid supply container 50.

Having such a layer in the capillary force generation material 13, the gas-liquid interface L can suppress variations in the gravitational direction in this area. In this case, it is more preferable that the main fiber array component be quasi-parallel to the longitudinal direction of the cross portion in the horizontal direction of the capillary force generation material, too, because this would allow effective utilization of the longitudinal direction of fiber.

Here, theoretically, the above described effect can be produced if the fiber array direction is inclined from the vertical direction no matter how little it is, but a definite effect has been confirmed when its inclination is within the range of ±30° with respect to the horizontal plane. Therefore, suppose "quasi" of "quasi-horizontal" includes the above inclination in this specification.

In this embodiment, the main fiber array component is equally configured also in the area lower than the top end of the air introducing groove 17. Thus, in the gas-liquid exchange operation, this prevents the gas-liquid interface L from unexpectedly varying in the area lower than the top end of the path 66*a,* eliminating the possibility of any ink supply defect due to an ink shortage.

Moreover, in this embodiment, the fiber direction of the capillary force generation material 13 almost coincides with the direction E connecting the "paths 66*a* and 66*b*" to the "interface between the capillary force generation materials 13B and 13D" and the longitudinal direction of the cross portion near the ink supply port 12 of the capillary force generation material 13D coincides with the ink supply direction from the ink supply port 12. Thus, even when ink is discharged at high speed from the ink supply port 12, the fluidity of ink in the fiber longitudinal direction is excellent having an effect of stable supply of ink without causing a shortage of ink in the middle of supply.

Next, the two materials shown in this embodiment, the capillary force generation materials 13A and 13B will be explained in more detail with reference to FIGS. 1A to 1D.

The capillary force generation materials 13A and 13B are configured by a double structured fiber with a polypropylene core 21B and polyethylene sheath 21A and an individual fiber piece composing the negative pressure generation material of this embodiment has a length of approximately 60 mm. The cross portion of this fiber has a quasi-concentric shape and this fiber is formed using polyethylene with a relatively low melting point as the sheath material and polypropylene with a relatively high melting point as the core material. The capillary force generation material of this embodiment, though not shown in the figure, is manufactured by arranging the fiber direction of a fiber lump made up of short fiber using a carding machine, well arranging the fiber direction using a pipe-figured material, then applying re-heating by means of pre-heating and hot blast stove, etc. (it is desirable to set the heating temperature higher than the melting point of polyethylene with a relatively low melting point and lower than the melting point of polypropylene with a relatively high melting point), making bundles of fiber with a desired thickness by passing it through the nozzle and cutting it to desired lengths.

The capillary force generation materials 13A and 13B manufactured in this way include in their manufacturing process a process of rubbing the outside of the material, and so their surface area has slightly higher fiber density than the inner area and the fiber directionality uniformly arranged. Therefore, providing the part constituting the interface between the two materials, the capillary force generation materials 13A and 13B, with this directionality close to the gas-liquid interface L during gas-liquid exchange, in other words, locating it in the upper area in the vicinity of the top end of the path and air introducing groove 17 has the aforementioned effect of promoting the stabilization of the gas-liquid interface L.

The interface of the capillary force generation materials 13A and 13B with the arranged fiber direction is where the convex and concave surfaces have contact and together with the nearby surface areas of the capillary force generation materials 13A and 13B provides ink with appropriate fluidity in the horizontal direction as a whole. That is, only the interface is provided with ink fluidity by far superior to the surrounding areas but this does not result in an ink path formed between the gap between the container 11 and the capillary force generation material, and the interface. Thus, providing the interface between the capillary force generation materials 13A and 13B in the upper part of the path in the operating position or ideally in the vicinity of the communication portion allows the interface between the ink and gas in the capillary force generation material during a gas-liquid exchange operation to be used as the boundary surface, leading to stabilization of the static negative pressure in the head portion in ink supply operation.

Here, the inner structure of the capillary force generation material will be further explained.

Figure 7A:
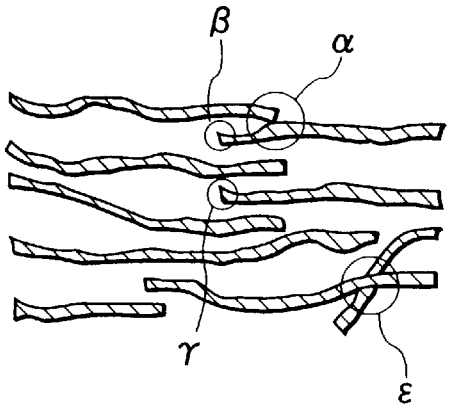
FIGS. 7A and 7B show fibers constituting a capillary force generating member used for a liquid supply system of the present invention, FIG. 7A showing the fibers before heating, and FIG. 7B showing the fibers after heating.
Figure 7B:
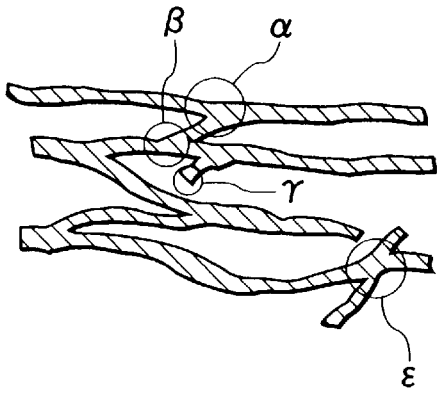

FIGS. 7A and 7B illustrate the fiber of a capillary force generation material used in the liquid supply system of the present invention. FIG. 7A illustrates the fiber before heating and FIG. 7B illustrates the fiber after heating.

The crimped short fiber shown in FIG. 7A with fiber directionality arranged to a certain degree becomes as shown in FIG. 7B after heating. Here, in an area a where a plurality of short fiber pieces overlaps in the fiber direction in FIG. 7A, the interportion of these fiber pieces is likely to be fused into one as shown in FIG. 7B, resulting in continuous and seamless fiber which is hardly cut in the fiber direction, that is, the F1 direction shown in FIG. 1C. Moreover, using crimped short fiber causes the end area (β, γ shown in FIG. 7A) of short fiber to be three-dimensionally fused with other short fiber piece (β) or remain as independent part (γ) as shown in FIG. 7B. In addition, since not all fiber pieces are oriented uniformly, a short fiber piece crossing another short fiber piece from the beginning (ϵ in FIG. 7A) is fused as it is after heating (ϵ in FIG. 7B). In this way, fiber with greater strength than the conventional unidirectional fiber bundle is also formed in the F2 direction.

Here, an additional explanation will be given about the fiber direction and ink supply operation in the ink tank and liquid supply system provided with the capillary force generation material of each embodiment of the present invention shown in FIGS. 1A to 6.

In each embodiment of the present invention, the air introduced through the air vent 15 in a gas-liquid exchange operation is dispersed in the main fiber direction when it reaches the a gas-liquid interface L. As a result, the interface during the gas-liquid exchange operation can be kept in the quasi-horizontal direction and stabilized. This results in an effect of ensuring that ink is supplied while maintaining a stable negative pressure. After the gas-liquid exchange operation, the ink is consumed almost uniformly in the horizontal direction since the main fiber direction in each embodiment of the present invention is quasi-horizontal. As a result, each embodiment can also provide an ink supply system with less leftover with respect to the ink in the capillary force generation material container. Thus, since the system in the first to third embodiments in particular, that uses a replaceable liquid supply container that directly contains a liquid can effectively create an area that does not retain ink in the capillary force generation material, it is possible to improve the buffer space efficiency and provide an ink supply system resistant to environmental variations with a reduced buffer space.

(Embodiment 5)

Figure 8:
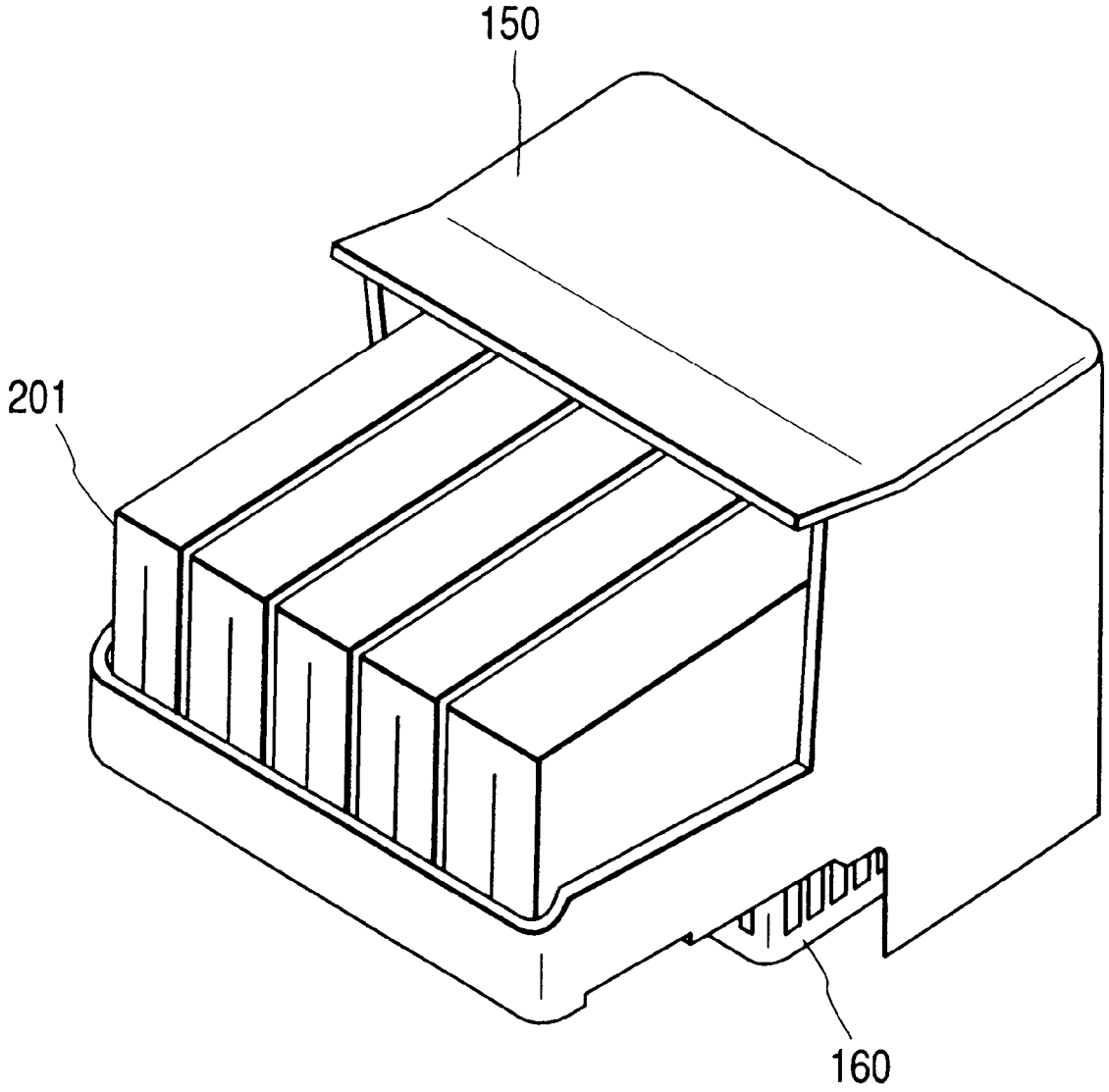
FIG. 8 is a perspective view of an ink-jet head cartridge of a fifth embodiment of the present invention.
Figure 9:
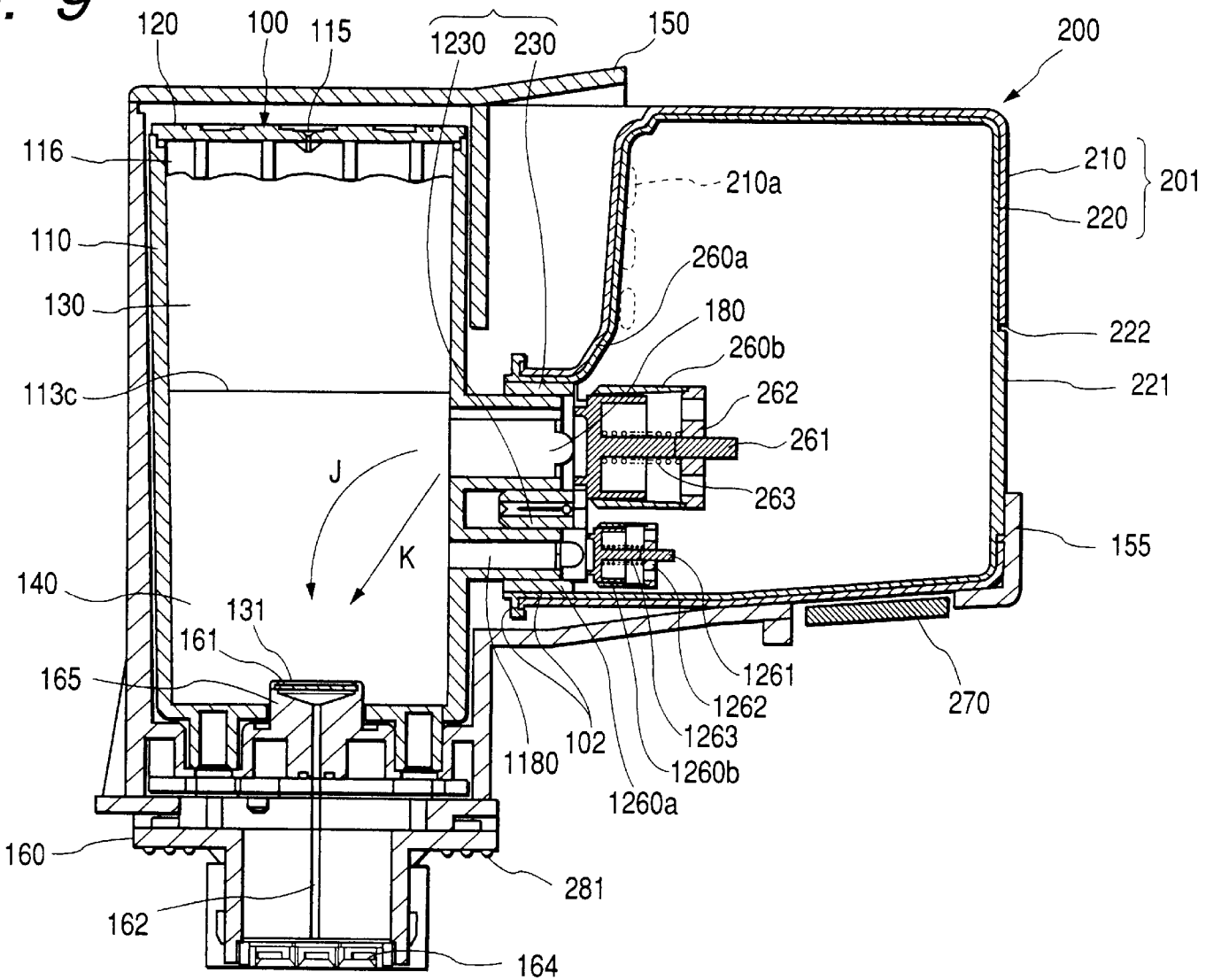
FIG. 9 is a cross-portional view of the ink-jet head cartridge in FIG. 8.

FIG. 8 shows a perspective view of an ink jet head cartridge of a fifth embodiment of the present invention and FIG. 9 shows its cross-portional view.

The present embodiment is an example of modification to the aforementioned second embodiment and describes each of the elements configuring the ink jet head cartridge to which the present invention is applied and the relationship between those elements. Since this embodiment is configured by applying various new technologies developed in the stage of establishment of the present invention, this whole embodiment will be explained while explaining these configurations.

<Overall Configuration>

As shown in FIG. 8 and FIG. 9, the ink jet cartridge of this embodiment is configured by an ink jet head unit 160, a holder 150, a negative pressure control chamber unit (capillary force generation material container) 100 and an ink tank unit (ink container) 200, etc. Inside the holder 150, the negative pressure control chamber unit 100 is fixed and the ink jet head unit 160 is fixed below the negative pressure control chamber unit 100 via the holder. Coupling between the holder 150 and the negative pressure control chamber unit 100 and coupling between the holder 150 and the ink jet head unit 160 explained here can be performed by means of screwing or engagement, etc. making those components easily detachable, providing an effect in terms of recycling and cost reduction in response to variations in the configuration due to version upgrade, etc. These components should also be made easily detachable from the standpoint that they vary in their useful life and it is possible to easily replace only components requiring replacement. However, it goes without saying that depending on conditions, they can also be completely fixed by means of fusion or thermal caulking, etc. The negative pressure control chamber unit 100 is configured by a negative pressure control chamber container 110 with an opening formed on its upper surface, a negative pressure control chamber cover 120 attached to its upper surface and two absorbents (capillary force generation materials) 130 and 140 filled in the negative pressure control chamber container 110 to impregnate with ink and retain ink. The absorbents 130 and 140 are stacked one atop another stuck to each other inside the negative pressure control chamber container 110 and since the capillary force generated by the lower absorbent 140 is greater than the capillary force generated by the upper absorbent 130, the lower absorbent 140 has a stronger ink retaining force. The ink in the negative pressure control chamber unit 100 is supplied to the ink jet head unit 160 through the ink supply pipe 165.

A filter 161 is provided below the supply port 131 at the end of the ink supply pipe 165 facing the absorbent 140 and the filter 161 pushes the absorbent 140. The ink tank unit 200 is housed in the holder 150 in a detachable manner. A joint pipe (connection pipe) 180, which is provided on the side of the negative pressure control chamber container 110 facing the ink tank unit 200 is inserted into and connected to a joint hole 230 of the ink tank unit 200 and a joint pipe (connection pipe) 1180 is inserted into and connected to the joint hole 1230 of the ink tank unit 200. The negative pressure control chamber unit 100 and ink tank unit 200 are configured in such a way that the ink in the ink tank unit 200 is supplied to the negative pressure control chamber unit 100 through the joint between the joint pipes 180 and 1180 and joint holes 230 and 1230. Though omitted in FIG. 9, an ID material 170 protruding from the side of the negative pressure control chamber container 110 to prevent erroneous mounting of the ink tank unit 200 is provided in the area superior to the joint pipe 180 of the negative pressure control chamber container 110 facing the ink tank unit 200.

On the negative pressure control chamber cover 120, an air vent 115 is formed to communicate the inside of the negative pressure control chamber container 110 with the external air, here to communicate the absorbent 130 housed in the negative pressure control chamber container 110 with the external air. In the vicinity of the air vent 115 in the negative pressure control chamber container 110, a buffer space 116 is provided, which is made up of a space formed with ribs protruding from the side of the negative pressure control chamber cover 120 facing the absorbent 130 and an area where no ink (liquid) in the absorbent exists.

A valve mechanism is provided inside the joint hole 230 and this valve mechanism is configured by a first valve frame 260*a*, a second valve frame 260*b*, a valve body 261, a valve cover 262 and a spring material 263. The valve body 261 is supported in a slidable manner inside the second valve frame 260*b* and is pressed against the first valve frame 260*a* side by means of spring by the spring material 263. While the joint pipe 180 is not inserted into the joint hole 230, the edge of the valve body 261 facing the first valve frame 260*a* is pressed against the first valve frame 260*a* by means of spring of the spring material 263, thus maintaining the inside of the ink tank unit 200 airtight. When the joint pipe 180 is inserted into the joint hole 230 and the valve body 261 is pressed by the joint pipe 180 to move in the direction departing from the first valve frame 260*a*, the inside of the joint pipe 180 communicates with the inside of the ink tank unit 200 through the opening formed on the side of the second valve frame 260*b*. This introduces air into the ink tank unit 200 and the ink in the ink tank unit 200 is supplied to the negative pressure control chamber unit 100 through the joint hole 230 and joint pipe 180. That is, the valve inside the joint hole 230 is opened and thereby the ink container of the ink tank unit, which has been kept airtight so far, becomes connected to the negative pressure control chamber unit 100 only through the above hole. The joint hole 1230 also has a substantially identical configuration, and therefore it is assigned a reference numeral with 1000 added and detailed explanations will be omitted here.

Furthermore, at the end of the ink supply pipe 165 of the ink jet head unit 160, a filter 161 is provided preventing the ink in the ink jet head unit 160 from leaking out even when the negative pressure control chamber unit 100 is separated. In addition, since the negative pressure control chamber unit 100 is provided with the buffer space 116 (including the areas in the absorbents 130 and 140 where no ink is retained) to prevent ink leakage from the ink tank and the interface 113*c* between the two absorbents 130 and 140 with different capillary forces are provided superior to the joint pipe 180 in the operating position (more preferably, the capillary force of the layer including the interface 113*c* and its surrounding is higher than the areas of the absorbents 130 and 140, as in the case of this embodiment), the structure integrating the holder 150, the negative pressure control chamber unit 100 and the ink tank unit 200 has little likelihood that the ink will leak out even if their position changes. For this reason, in this embodiment, the ink jet head unit 160 is provided with a fixing part on the bottom face, which is a side having the connection terminal of the holder 150 and is easily detachable even when the ink tank unit 200 is housed in the holder 150.

Figure 10B:
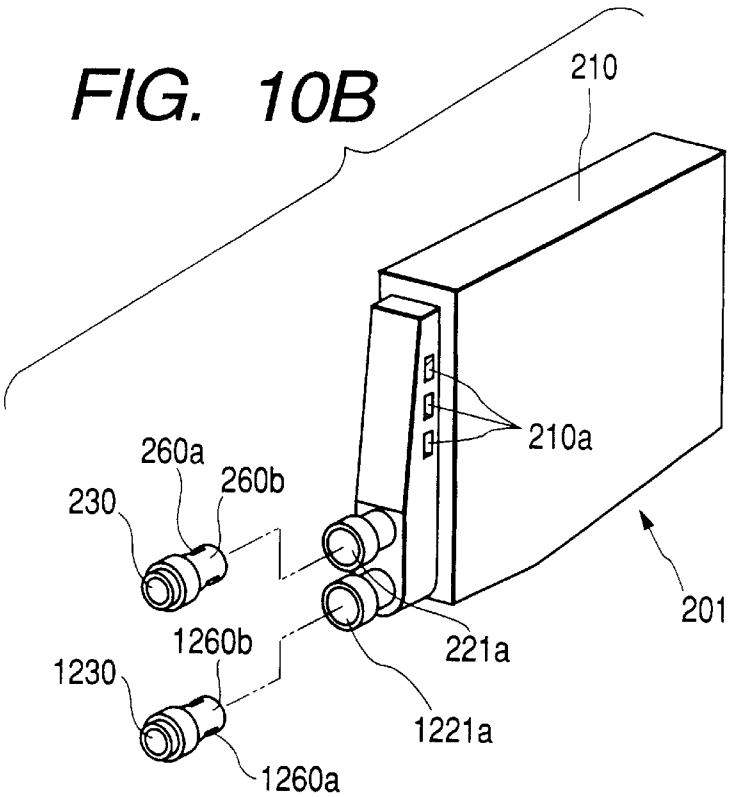
FIGS. 10A and 10B are perspective views illustrating the ink tank unit in FIG. 9.
Figure 10A:
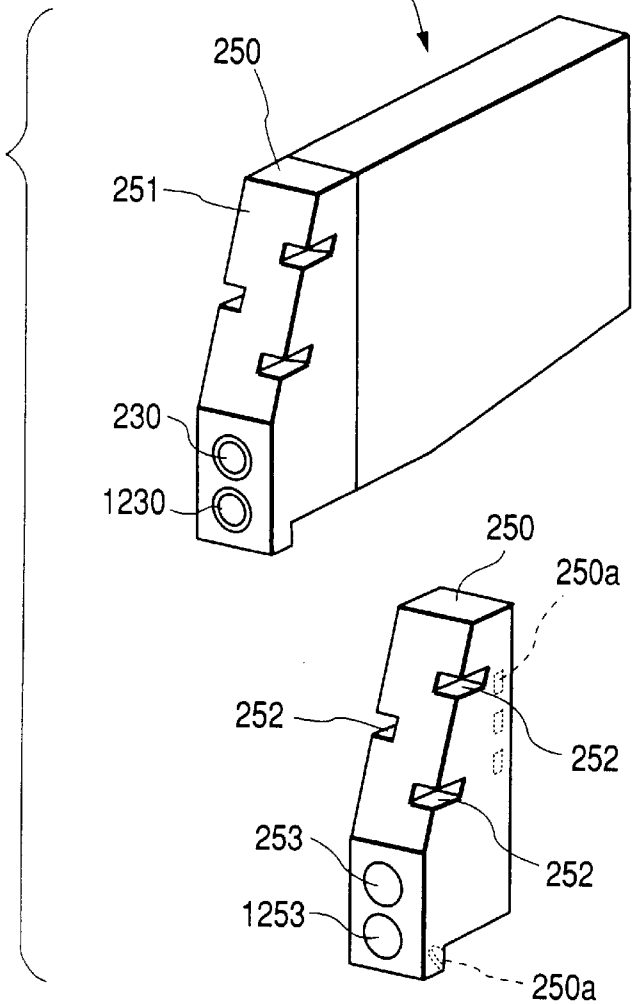

As shown in FIG. 9, FIG. 10A and FIG. 10B, the ink tank unit 200 is configured by an ink container 201, a valve mechanism including first valve frames 260*a* and 1260*a* and second valve frames 260*b* and 1260*b*, and an ID material 250 (omitted in FIG. 9). The ID material 250 is intended to prevent erroneous coupling of the ink tank unit 200 and the negative pressure control chamber unit 100.

The valve mechanism is intended to control the flow of ink inside the joint holes 230 and 1230 and carries out an opening/closing operation engaged with the joint pipes 180 and 1180 of the negative pressure control chamber unit 100. Friction during valve opening/closing at the time of attachment/detachment is prevented by means of a valve configuration, which will be described later, or a structure regulating the tank operation range using the ID material 170 and ID concave part 252.

<Ink Tank Unit>

FIGS. 10A and 10B are perspective views to explain the ink tank unit 200 shown in FIG. 9. FIG. 10A is a perspective view to show the ink tank unit 200 and FIG. 10B is a perspective view to show the ink tank unit 200 when disassembled.

With respect to the front of the ID material 250 facing the negative pressure control chamber unit 100, the portion superior to a supply hole 253 has an inclined surface 251. The inclined surface 251 is inclined from the forefront surface with the supply holes 253 and 1253 of the ID material 250 toward the ink container 201, that is, backward. On this inclined surface, a plurality of ID concave parts 252 (three in FIGS. 10A and 10B) to prevent erroneous mounting of the ink tank unit 200 is formed. In this embodiment, the ID material 250 is placed on the front side (side having a supply hole) of the ink container 201 facing the negative pressure control chamber unit 100.

The ink container 201 is a quasi-multi-lateral prismatic hollow container having a negative pressure generation function. The ink container 201 is configured by a container 210 and inner bag 220 (see FIG. 9) and the container 210 and inner bag 220 are mutually separable. The inner bag 220 has flexibility and is deformable when the ink contained therein is discharged. The inner bag 220 also includes a pinch-off portion (fusion portion) 221 and the inner bag 220 is supported by this pinch-off portion 221 with the inner bag 220 engaged with the container 210. Furthermore, an external air vent 222 is provided near the pinch-off portion 221 and it is possible to introduce the external air between the inner bag 220 and container 210 through the external air vent 222.

Figure 27:
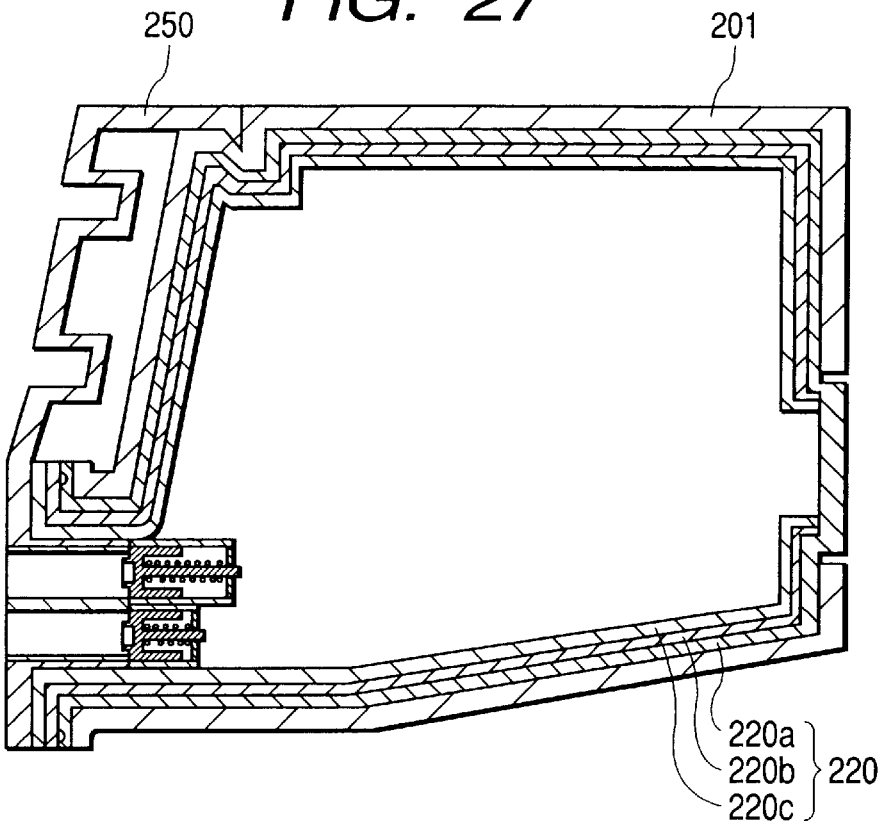
FIG. 27 is a cross-portional view of the internal structure of the ink container in FIG. 9.

As shown in FIG. 27, the inner bag 220 consists of three layers, a wetted layer 220*c* with ink fastness, an elastic modulus control layer 220*b* and a gas barrier layer 220*a* with an excellent gas barrier property, in order with the innermost part first, each layer having an independent function when connected. The elastic modulus of the elastic modulus control layer 220*b* is kept almost constant within the operating temperature range of the ink container 201, that is, the elastic modulus of the inner bag 220 is kept almost constant by the elastic modulus control layer 220*b* within the operating temperature range of the ink container 201. The inner bag 220 can also have a layered configuration with the medium layer and the external layer switched round, that is, the elastic modulus control layer 220*b* placed as the outermost layer and the gas barrier layer 220*a* as the medium layer.

This configuration of the inner bag 220 allows the inner bag 220 to exploit the capabilities of such a small number of layers, the ink-resistant layer, elastic modulus control layer 220*b* and gas barrier layer 220*a,* thus reducing influences of temperature variations on the elastic modulus of the inner bag 220. Furthermore, since the inner bag 220 secures an elastic modulus appropriate to control a negative pressure in the ink container 201 within the operating temperature range, allowing the inner bag 220 to have a buffer function, which will be described later, with respect to the ink inside the ink container 201 and the negative pressure control chamber unit 110 (details will be given later). This reduces the spaces of the buffer chamber provided in the upper part of the negative pressure control chamber container 110, that is, the area not filled with ink absorbent and the area of the absorbents 130 and 140 where ink is not present, thus reducing the size of the negative pressure control chamber unit 100 and providing a highly efficient ink jet head cartridge 70.

This embodiment uses materials such as polypropylene for the wetted layer 220*c,* the innermost layer of the inner bag 220, cycloolefin copolymer for the elastic modulus control layer 220*b,* the medium layer, and EVOH (EVA (ethylene-vinyl acetate copolymer) saponification) for the gas barrier layer 220*a,* the outermost layer. Here, inclusion of a functional adhesive resin material in the elastic modulus control layer 220*b* eliminates the need for especially providing an adhesive layer between these layers, which is desirable because this allows the thickness of the inner bag 220 to be reduced.

As the material for the container 210, polypropylene, the same material as for the innermost layer of the inner bag 220 is used. Polypropylene is also used as the material for the first valve frame 260*a*.

The ID material 250 is provided with a plurality of ID concave parts 252 on the right and left corresponding to a plurality of ID materials 170 to prevent erroneous coupling of the ink tank unit 200 and fixed to the ink container 201.

The ID concave parts 252 are formed on the ID material 250 in correspondence with a plurality of ID materials 170, which is provided on the negative pressure control chamber unit 100 side to provide an erroneous coupling prevention function, and thus it is possible to implement multi-type ID functions by changing the shapes and positions of the ID materials 170 and ID concave parts 252.

The ID concave parts 252 of the ID material 250 and joint holes 230 and 1230 of the first valve frames 260*a* and 1260*a* are on the front in the direction in which the ink tank unit 200 is attached/detached and configured by the ID material 250 and the first valve frames 260*a* and 1260*a*.

Furthermore, forming the ink container by blow molding and the ID material 250 and first valve frames 260*a* and 1260*a* by injection molding, and thus configuring the ink tank unit 200 with three materials makes it possible to mold the valve material and ID concave parts 252 with accuracy.

If these ID concave parts 252 are directly formed in the ink container 201, which is a blow tank manufactured by blow molding, this will influence on peeling of the inner bag 220 of the inner layer of the ink container 201, that is, the internal shape of the ink tank will be complicated, which can influence a negative pressure produced by the ink tank unit 200. However, as is the case with the configuration of the ink tank unit 200 in this embodiment, configuring the ID material 250 with a material different from that for the ink container 201 can avoid the above influence on the ink container 201 resulting from attaching the ID material 250 to the ink container 201, allowing stable generation and control of a negative pressure for the ink container 201.

The first valve frames 260*a* and 1260*a* are connected to the container 210 of the ink container 201 and the inner bag 220. The first valve frames 260*a* and 1260*a* are connected to the inner bag 220 by fusion between the inner bag exposed parts 221*a* and 1221*a* of the inner bag 220 corresponding to the ink path of the ink container 201 and the corresponding plane of the joint holes 230 and 1230. Here, since the container 210 is made of the same polypropylene as that used for the innermost layer of the inner bag 220, it is possible to fuse the first valve frames 260*a* and 1260*a* with the container 210 even around the joint holes 230 and 1230.

This not only improves the positional accuracy but also completely seals the supply hole of the ink container 201 and prevents leakage, etc. of ink from the sealed portion of the first valve frames 260*a* and 1260*a* and ink container 201 at the time of attachment/detachment, etc. of the ink tank unit 200. When connection is made by means of fusion as in the case of the ink tank unit 200 of this embodiment, it is desirable for reasons of improving the sealing characteristic that the material of the layer forming the adhesion surface of the inner bag 220 be the same as the material of the first valve frames 260*a* and 1260*a*.

Regarding connection between the container 210 and ID material 250, the ID material is engaged with and fixed to the ink container 201 by engagement between the plane facing the sealed surface 102 connected with the ink container 201 of the first valve frames 260*a* and 1260*a,* click portion 250*a* formed in the lower part of the ID material 250, the engagement part 210*a* of the side of the container 210 and the click portion 250 on the corresponding ID material 250 side. For "engagement and fixing" here, it is preferable to provide a structure that can be easily disassembled by means of, for example, engagement by projections and depressions, fit system, etc. Thus, engaging and fixing the ID material 250 with/to the ink container 201 allows both the ID material 250 and ink container 201 to be mutually movable on a micro scale, making it possible to absorb force produced by contact between the ID materials 170 and ID concave parts 252 at the time of attachment/detachment and prevent the ink tank unit 200 and the negative pressure control chamber unit 100 from being damaged.

Furthermore, coupling the ID material 250 with the ink container 201 partially engaged or fixed in this way allows the ink tank unit 200 to be easily disassembled, which is effective in terms of recycling. Moreover, providing a concave part for engagement as the engagement portion 210*a* on the side of the container 210 provides a simple configuration when manufacturing the ink container 201 by blow molding, also simplifying both the die material for molding and control of coating thickness.

Furthermore, the container 210 and the ID material 250 are connected with the first valve frames 260*a* and 1260*a* connected to the container 210, and around the joint holes 230 and 1230, the click portion 250*a* is engaged with the engagement portion 210*a* with the first valve frames 260*a* and 1260*a* sandwiched, making it possible to improve the ink tank unit 200 at the time of attachment/detachment, especially the strength of the joint portion.

Furthermore, the part covered with the ID material 250 of the ink container 201 has a concave shape with the protruding supply port, and so fixing the ID material 250 to the ink container 201 can eliminate the protruding shape from the front of the ink tank unit 200. Moreover, the concave-convex relationship between the engagement portion 210*a* of the container 210 and click portion 250*a* of the corresponding ID material 250 can be reversed.

Furthermore, it is possible to perform position control between the ink container 201 and ID material 250 in vertical and horizontal directions. The method of connecting the ink container 201 and the ID material 250 is not limited to the modes described above, but other means can also be used as the engagement position and fixing method.

Figure 28:
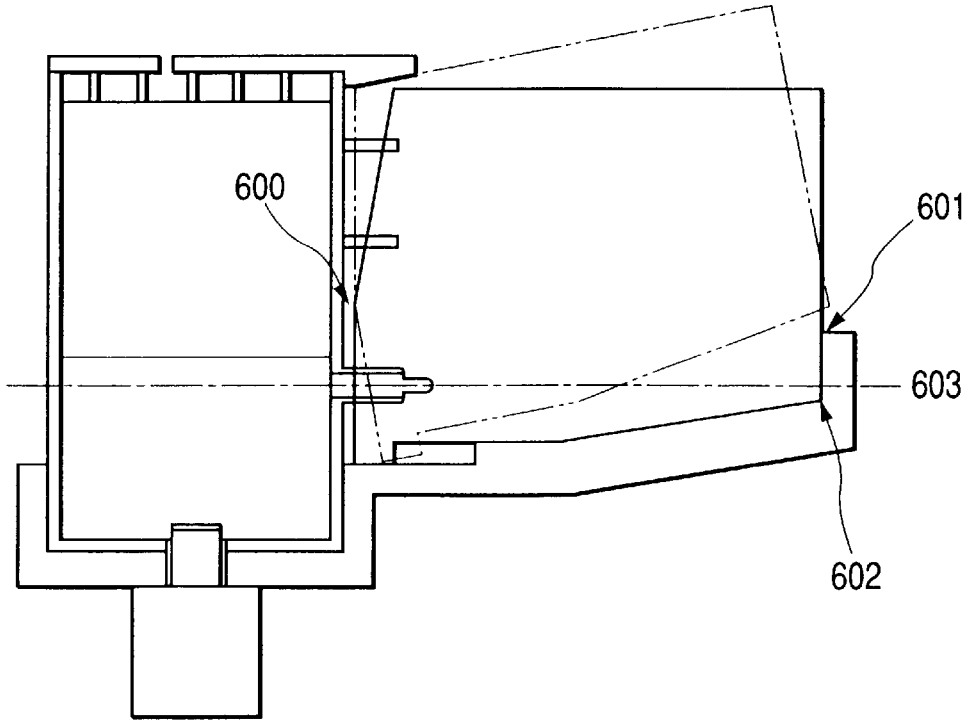
FIG. 28 illustrates installation and removal of the ink tank unit in FIG. 9 by rotation.

As shown in FIG. 9 and FIG. 28, the bottom of the ink container 201 is inclined in the direction in which the ink container is lifted and the lower part opposite to the joint holes 230 and 1230 of the ink container 201 is engaged with the ink tank engagement portion 155 of the holder 150. When the ink tank unit 200 is removed from the holder 150, the part of the ink container 201 that engages with the ink tank engagement portion 155 is allowed to be lifted and the ink tank unit 200 rotates when the ink tank unit 200 is attached or detached. In this embodiment, this rotation center is near the supply hole (joint hole 230). However, in the strict sense, the rotation center is changed as described later. In the case of an attachment/detachment operation of the ink tank unit 200 by quasi-rotation, in the relationship between the distance from the fulcrum of rotation to the corner of the ink tank unit 200 facing the ink tank engagement portion 155 and the distance from the fulcrum to the ink tank engagement portion 155, the longer the first than the latter, the greater the friction between the ink tank unit 200 and the ink tank engagement portion 155, which may produce problems such as unnecessary force during the coupling operation, deformation of the pressed parts of the ink tank unit 200 and holder 150, etc.

As in the case of the ink container 201 of the present invention, inclining the bottom and lifting the bottom end of the part of the ink container 201 facing the ink tank engagement portion 155 can prevent excessive friction in the rotation of the ink tank unit 200 by their respective engagement portions of the ink tank unit 200 and the holder 150, allowing optimal attachment/detachment operation of the ink tank unit 200.

In the ink jet head cartridge of the present invention, joint holes 230 and 1230 are formed in the lower part of one side of the ink container 201 facing the negative pressure control chamber unit 100 and the lower part of the side of the ink container 201 opposite to the joint holes 230 and 1230, that is, the lower part of the rear end is engaged with the ink tank engagement portion 155. Furthermore, the upper part of the ink tank engagement portion 155 extends from the bottom of the holder 150 upward up to almost the same height as the center height 603 of the joint hole 230. This ensures that horizontal movement of the joint holes 230 and 1230 is controlled by the ink tank engagement portion 155, making it possible to keep optimal connection between the joint holes 230 and 1230 and between joint pipes 180 and 1180. Here, to ensure connection between the joint holes 230 and 1230 and joint pipes 180 and 1180, the top end of the ink tank engagement portion is placed almost at the same height as the upper part of the joint hole 230. Then, through a rotation operation centered on part of the front of the ink tank unit 200 toward the joint holes 230 and 1230, it is attached to the holder 150 in a detachable manner. In an attachment/detachment operation of the ink tank unit 200, the part of the ink tank unit 200 that has contact with the negative pressure control chamber unit 100 becomes the rotation center of the ink tank unit 200. As described above about this ink jet head cartridge, because the bottom of the rear end of the ink tank container 201 is inclined, it is possible to reduce the difference between the distance from the rotation center 600 to the top end 601 of the ink tank engagement portion and the distance from the rotation center 600 to the lower end 602 of the ink tank engagement portion, preventing excessive friction when the ink tank unit 200 rotates in the engagement portions of the ink tank unit 200 and holder 150, allowing an optimal attachment/detachment operation of the ink tank unit 200.

Because the ink container 201 and the holder 150 have the above described forms, even when the joint holes 230 and 1230 are enlarged for high-speed supplying of ink, it is possible to reduce the area of friction between the lower end of the rear end of the ink container 201 and the ink tank engagement portion 155 during an attachment/detachment operation of the ink tank unit 200. This makes it possible to avoid excessive friction with the ink tank engagement portion 155 when the ink tank unit 200 is attached while maintaining stability of coupling between the holder 150 and ink tank unit 200.

Here, further details will be given using FIG. 27. If the distance from the rotation center 600 during an attachment/detachment operation of the ink tank unit 200 to the lower end 602 of the ink tank engagement portion excessively exceeds the distance from the rotation center 600 to the top end 601 of the ink tank engagement portion, the force necessary for an attachment/detachment increases considerably, increasing the possibility of causing the top end 601 of the ink tank engagement portion to be shaved or the ink container 201 to be deformed. Thus, it is desirable to minimize the difference between the distance from the rotation center 600 to the lower end 602 of the ink tank engagement portion and the distance from the rotation center 600 to the top end 601 of the ink tank engagement portion within the range without detriment to appropriate stability and excellent detachability.

Furthermore, if the rotation center 600 of the ink tank unit 200 is located lower than the center of the joint hole 230, the distance from the rotation center 600 of the ink tank unit 200 to the top end 601 of the ink tank engagement portion is greater than the distance from the rotation center 600 to the lower end 602 of the ink tank engagement portion, making it difficult to securely hold the ink container 201 at the height of the center of the joint hole 230. Therefore, to securely hold the center in the height direction of the joint hole 230, it is desirable that the rotation center 600 of the ink tank unit 200 be located higher than the center in the height direction of the joint hole 230.

On the other hand, if the rotation center 600 of the ink tank unit 200 is located higher than the center of the joint hole 230, the thickness of the part of the ink tank unit 200 that has contact with the ink tank engagement portion 155 increases, resulting in an increased area that has contact with the ink tank engagement portion 155, increasing the possibility of damaging the ink tank unit 200 and holder 150. Thus, it is desirable from the standpoint of the detachability of the ink tank unit 200 that the rotation center 600 of the ink tank unit 200 be closer to the center in the height direction of the joint hole 230. Moreover, while the height of the ink tank engagement portion 155 of the ink tank unit 200 can be determined based on the detachability of the ink tank unit 200 as appropriate, setting the position of the ink tank engagement portion 155 higher than the rotation center 600 increases the distance of contact of the engagement portion with the ink tank unit 200 and holder 150, resulting in an increased rubbing area by an attachment/detachment operation, and therefore it is desirable to set the position of the ink tank engagement portion 155 lower than the rotation center 600 of the ink tank unit 200 taking into account deterioration of the ink tank unit 200 and holder 150.

Furthermore, according to the ink jet head cartridge of this embodiment, the spring force to fix the position in horizontal direction of the ink container 201 derives from the spring material 263 that presses the valve 261 and the repulsion of the rubber joint portion 280 (see FIG. 11 to FIG. 15). However, the present invention is not limited to such a mode, but it is also possible to provide a spring means to fix the position in horizontal direction of the ink container 201 for the engagement portion at the rear end of the ink container 201, the side of the ink tank engagement portion 155 facing the ink container 201 or the negative pressure control chamber unit 100, etc. Here, when connected to the ink container, the rubber joint portion 280 stays pressed between the walls of the negative control chamber and ink tank, and thus can secure airtightness of the coupling portion (area peripheral to the joint pipe) (can at least reduce the area exposed to the external air even if it does not provide complete airtightness) and further play an auxiliary role of sealing with a sealing protrusion, which will be described later.

Next, the configuration of the internal part of the negative pressure control unit 100 will be described below.

A member generating a negative pressure and having a two-step structure, in which an upper step of an absorbing body 130 and a lower step of an absorbing body 140 are stacked, is contained inside the negative pressure control unit 100. Thus, the absorbing body 130 is connected to an atmosphere connecting port 115 and the absorbing body 140 contacts closely to the absorbing body 130 on the top surface thereof and contacts closely to a filter 161 on the bottom surface thereof. A boundary 113*c* between the absorbing body 130 and 140 is located over the top end of a joint pipe 180 as a connecting part in attitude on use.

The absorbing body 130 and the absorbing body 140 are made from a fiber body which are oriented to a certain direction of fibers and which are contained in a negative pressure control chamber container 110, with the major direction of fibers oblique (more preferably, to be in almost horizontal direction as the present embodiment) toward the perpendicular direction in the status in which the ink jet head cartridge 70 is loaded on a printer.

Such absorbing body 130 and 140, of which direction of fibers is oriented, are manufactured by using a short fiber (about 60 mm in length; for example, composed of a fiber prepared by blending polypropylene with polyethylene) made of such as thermoplastic resin crimped as fibers, orienting direction of fibers of a fiber clump made of the short fibers using a carding machine followed by heating (it is preferable that a temperature in heating is higher than a melting point of polyethylene of which melting point is relatively lower and lower than a melting point of polypropylene of which melting point is relatively higher), and cutting to a desired length. In the fiber member of the present embodiment, the direction of fiber of superficial layer thereof is relatively more regularly arranged in comparison with a central part and capillary force is larger than the central part. However the surface thereof is not a specular surface and has some irregularity mainly occurred in binding slivers to have a three-dimensional node welded to the superficial layer part. Therefore, in the boundary surface 113*c* between the absorbing body 130 and 140 of which fiber direction is arranged, contact between the surfaces having the irregular surface makes a status having moderate fluidity of ink toward a horizontal direction as a whole including the superficial region of the absorbing body 130 and 140 around there. Consequently, it is not caused that only the boundary surface 113*c* is distinctly superior to surrounding region thereof in fluidity of ink resulting in making an ink path between a space between the negative pressure control chamber unit 100 and the absorbing body 130 and 140 and the boundary surface 113*c*. Therefore, putting the boundary surface 113*c* between the absorbing body 130 and 140 on the top part of the joint pipe 180, preferably around the top of part of the joint pipe 180 as in the present embodiment, in the attitude on use allows making the interface between ink and gas to the boundary surface 113*c* in the absorbing body 130 and 140 in a work for exchange of gas with liquid in air-liquid exchange action mentioned later. As a result, the static negative pressure in a head part can be stabilized during an ink supplying work.

An effect in consideration of the direction of a fiber member is same as that of the above described second embodiment and therefore, omitted.

In addition, in the case where the ink jet head cartridge of the present embodiment is mounted on the printer of so-called serial type, it is installed in a carriage for reciprocatively scanning. And then, ink contained in the ink jet head cartridge receives a force of component of movement direction of the carriage according to reciprocating action of the carriage. In order to remove as possible a bad effect of the force on characteristic of ink supply from an ink tank unit 200 to the ink jet head unit 160, the fiber direction of the absorbing body 130 and 140 and arrangement direction of the ink tank unit 200 and the negative pressure control chamber unit 100 is preferably a direction from a joint port 230 of the ink tank unit 200 to a supply port 131 of the negative pressure control chamber container 110.

<Joint Pipe and Joint Port>

The present embodiment is characterized by having two pairs of a joint pipe (connecting pipe) and a joint port as shown in respective figures. Then, this point will be described below.

The negative pressure control chamber unit 100 of the present embodiment has the joint pipe 180 in a position to become perpendicularly upward position and the joint pipe 1180 in the position to become perpendicularly downward, respectively in the status on use of the liquid discharge head. The ink tank unit 200 has the joint ports 230 and 1230 corresponding to the joint pipe 180 and the joint pipe 1180, respectively. In the joint port 230 and 1230, valve bodies 261 and 1261, valve lids 262 and 1262, energizing members 263 and 1263, a first valve frame 260*a* and 1260*a*, and a second valve frame 260*b* and 1260*b*, which composes a valve mechanism mentioned later, are installed, respectively.

As described above, the negative pressure control chamber unit 100 and the ink tank unit 200 are connected with two joint pipes 180 and 1180. These two joint pipes 180 and 1180 are located in perpendicularly upward and downward positions in situation on use. Therefore, in a normal using condition, ink flows only from the ink tank unit 200 to the negative pressure control chamber unit 100 in the joint pipe 1180 and the joint port 1230 located in perpendicularly downward position. On the contrary, air flows from the negative pressure control chamber unit 100 to the ink tank unit 200 in addition to ink flow from the ink tank unit 200 to the negative pressure control chamber unit 100 in the joint pipe 180 located in perpendicularly upward position to carry out what is known as an air-liquid exchange operation. Specifically, when air located upward than the boundary surface of the negative pressure control chamber unit 100 flows toward the ink tank unit 200, naturally passes through the joint pipe 180 located in upward position. Therefore, normally, air never reach the joint pipe 1180 located in downward position to pass it. The joint pipe 180 located in upward position is seemingly a connecting pipe for air-liquid exchange. The joint pipe 1180 located in downward position is a connecting pipe for liquid supply exclusively used for flow of a liquid (ink) without any flow of a gas.

So far, the joint pipe with a large diameter was necessary for keeping a large quantity of ink flow. However, there is a problem: when the joint pipe with a large diameter is installed, air flows in the ink tank unit in connecting action and a desired pressure characteristic is not yielded to inhibit a pressure regulation effect. However, in the present invention, a plurality of the joint pipes are installed as described above and therefore, ink flow as a whole can be sufficiently increased even individual joint pipes have a small diameter. In addition, a whole portion of the pipe with the small diameter is filled with ink by force of the ink flow to inhibit a back flow of air in the situation of connection, because respective joint pipes have the small diameter. Thus, invasion of air into the ink tank unit is prevented and the predetermined pressure characteristic is yielded to the sufficient pressure regulation effect.

Further, in the present embodiment, the joint pipe 1180 located in downward position is longer than the joint pipe 180 located in upward position. In connecting action, the joint pipe 1180 and the joint port 1230 located in downward position are connected in a faster timing than the joint pipe 180 and the joint port 230 located in upward position. An effect thereof will be mentioned below.

As described above, the joint pipe 1180 located in perpendicularly downward position works as the connecting pipe for liquid supply through which only ink flows. Therefore, it is preferable to prevent leaving of a bubble inside the pipe in the connecting work as possible. On the other hand, the joint pipe 180 located in perpendicularly upward position works as the connecting pipe for air-liquid exchange through which air and ink flow and therefore, some bubbles may be allowed staying inside the pipe in the connecting work.

And then, in consideration of connecting action, ink contained in the ink tank unit flows out vigorously from the pipe earlier connected among a plurality of connecting pipe to flow away bubbles in the pipe toward the negative pressure control chamber unit side in one stroke. In contrast, in the pipe later connected, force of ink flowing from the ink tank unit to the negative pressure control chamber unit side becomes relatively weak (because ink has already flown through the pipe earlier connected). Therefore, bubbles inside the pipe may be not flown away to the negative pressure control chamber unit side in one stroke to leave ink in the pipe.

In consideration of the above described situation, the following configuration is preferable that the joint pipe 1180 located in perpendicularly downward position and working as the connecting pipe for liquid supply through which only ink flows is earlier connected than the joint pipe 180 located in perpendicularly upward position and working as the connecting pipe for air-liquid exchange. Besides, in the present embodiment, the above described configuration is achieved by that the joint pipe 1180 located in downward position is formed longer than the joint pipe 180 located in upward position, however, not restricted to this example.

According to the configuration of the present embodiment described above, In releasing action, the joint pipe 180 and the joint port 230 located in upward position release the connection in the faster timing than the joint pipe 1180 and the joint port 1230 located in downward position. An effect thereof will be mentioned below.

When the joint pipe 180 located in upward position is released from the joint port 230 to close a valve in the condition of connection of both the joint pipe 180 and 1180, at this point, the ink tank unit 200 is sealed except the joint port 1230. In this situation, if the ink tank unit 200 is further pulled out, the connecting part between the joint pipe 1180 and the joint port 1230 slightly widen to increase an area to raise a negative pressure. Therefore, before the joint pipe 1180 located in downward position is released from the joint port 1230 to close the valve, ink filled in the joint pipe 1180 is sucked into the joint port 1230 by the negative pressure. According to this process, it can be prevented that ink leaves in the joint pipe 1180 after complete release of the joint pipe 1180 from the joint port 1230 to stain other members by dropping of ink.

Details of action of the valve mechanism in connecting action and releasing action are mentioned later.

<Tank Installation Action>

The followings are descriptions of action to install the ink tank unit 200 in an integration of the negative pressure control chamber unit 100 and a holder 150 with reference to FIGS. 11 to 15.

FIGS. 11 to 15 are portional views to explain the action to install the ink tank unit 200 in the holder 150 to which the negative pressure control chamber unit 100 has been fitted. The ink tank unit 200 is installed by rotative motion along with a guide (not illustrated) in width direction and a bottom 151 of the holder 150, a guide part fitted to a negative pressure control chamber lid 120 of the negative pressure control chamber unit 100, and an ink tank locking part 155 of the rear part of the holder 150.

Figure 11:
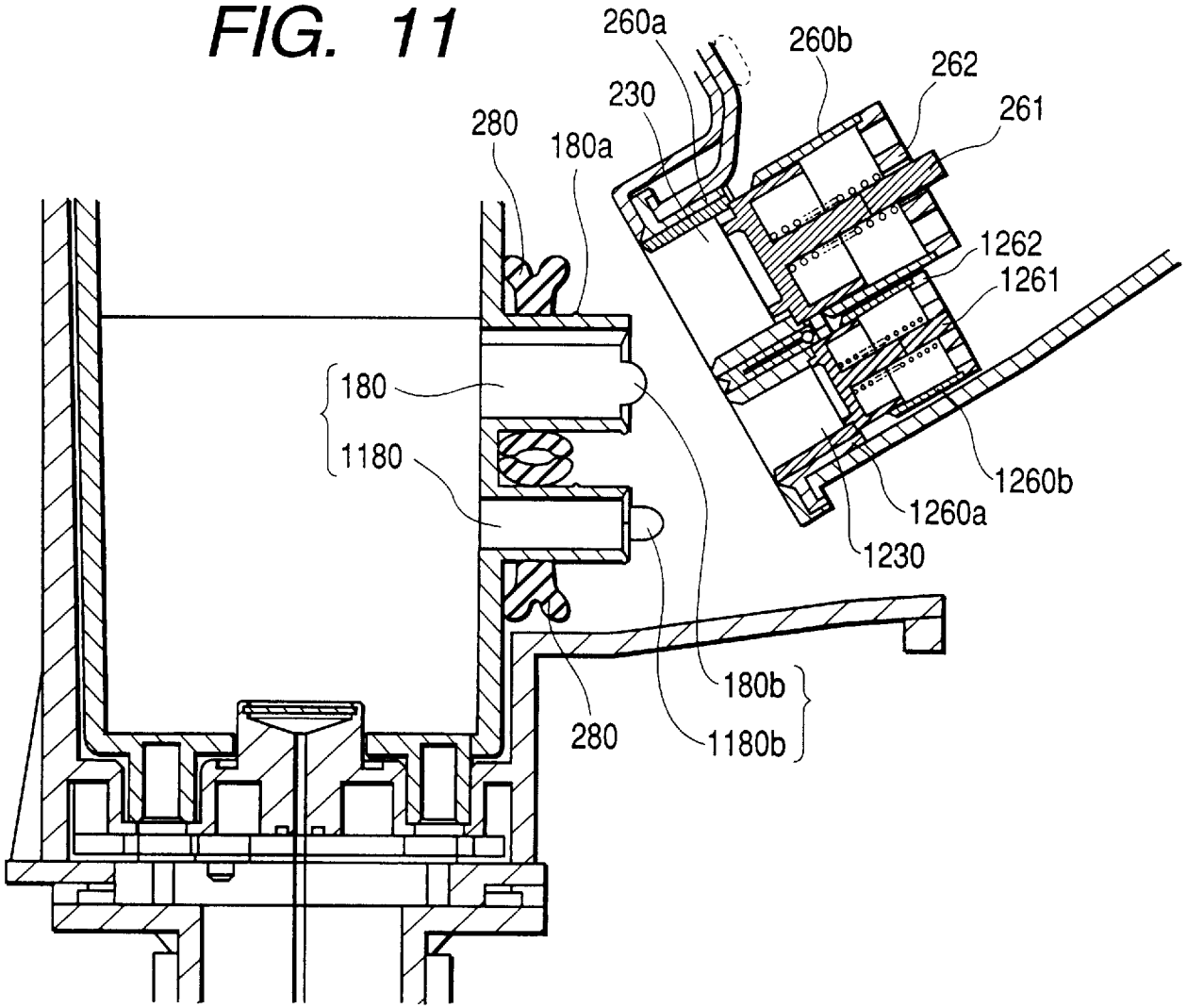
FIG. 11 is a cross-portional view illustrating a first step of installation of an ink tank unit in the negative pressure control chamber unit in FIG. 9.

First, as action of installing the ink tank unit 200, the ink tank unit 200 is moved to a position, i.e., the position in which a oblique surface 251 of the ink tank unit 200 contacts to an ID member 170 (refer FIGS. 9, 10A and 10B) for prevention of wrong insertion of the ink tank unit installed in the negative pressure control chamber unit 100, as shown in FIG. 11. At this point, the configuration does not allow contacting the joint ports 230 and 1230 with the joint pipe 180 and 1180. If wrong ink tank unit 200 is attempted to install at this point, the oblique surface 251 interferes to the ID member 170 to inhibit installation action of the ink tank unit 200 since then. On the basis of such configuration of the ink jet head cartridge 70, as described above, the configuration does not allow contacting the joint ports 230 and 1230 with the joint pipe 180 and 1180. Therefore, previous prevention can be achieved for unnecessary replacement, of the head and the ink tank in an apparatus of an ink-tank replacement type, caused by blending of ink color in a joint part in wrong installation and sticking (e.g., by a reaction of an anion to a cation) of ink (it is possible that sticking of absorbing bodies 130 and 140 occur to make use of the negative pressure control chamber unit 100 impossible according a component of ink). Besides, as described above, forming an ID part of the ID member 250 on the oblique surface allows that a plurality of the ID members 170 is almost simultaneously inserted in a recess for the ID corresponding to respective ID members 170 to confirm the ID, resulting in achievement of an assured function to prevent wrong installation.

Figure 12:
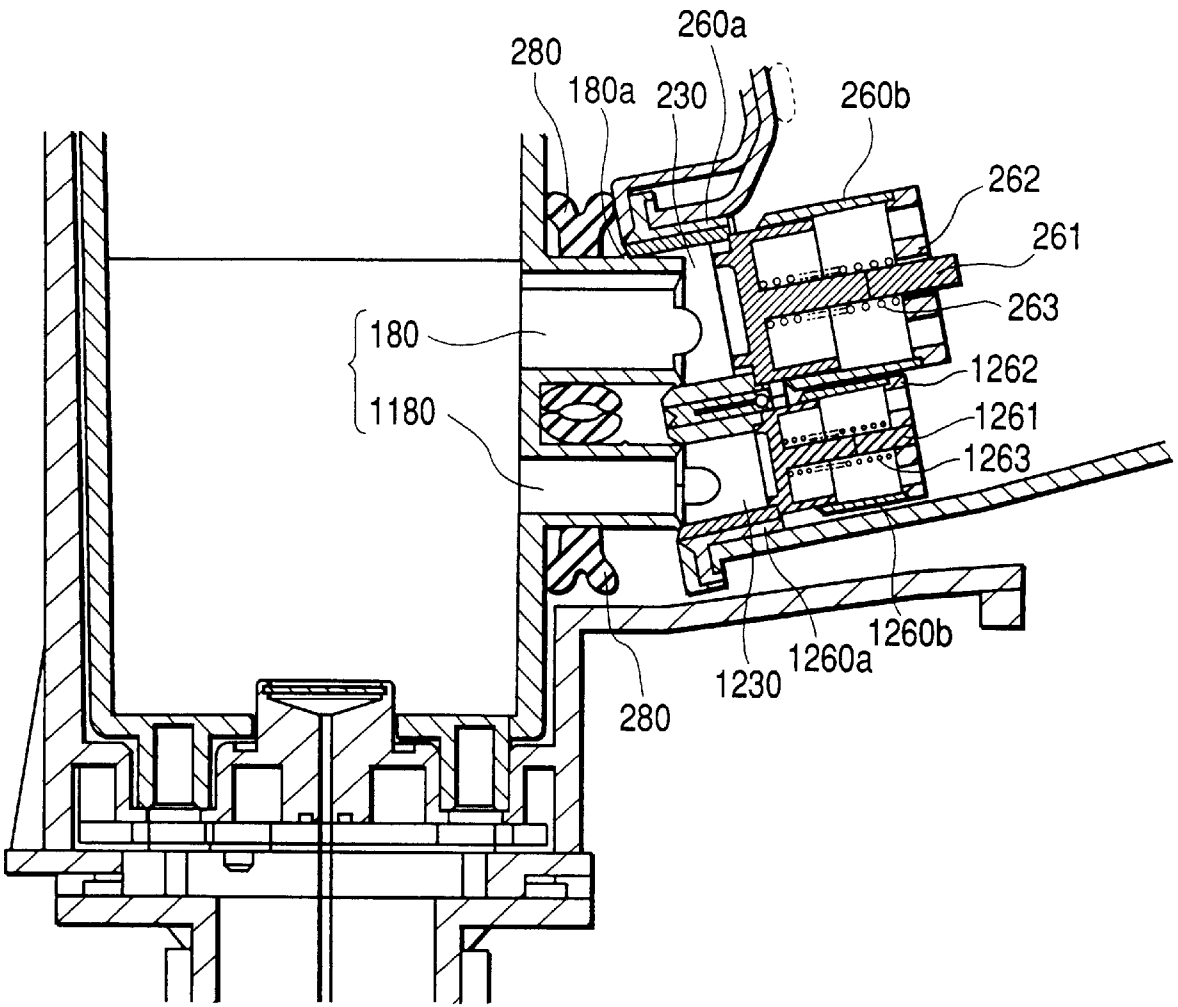
FIG. 12 is a cross-portional view illustrating a second step of installation of the ink tank unit in the negative pressure control chamber unit in FIG. 9.

Next, as shown in FIG. 12, the ink tank unit 200 is moved to the negative pressure control chamber unit 100 side to insert the ID member 170 in the recess 252 for the ID and insert the joint pipe 180 in the joint ports 230. At this point, both the valve bodies 261 and 1261 are in a closed status, the joint ports 230 has been sealed, and the joint ports 230 has been opened.

Figure 13:
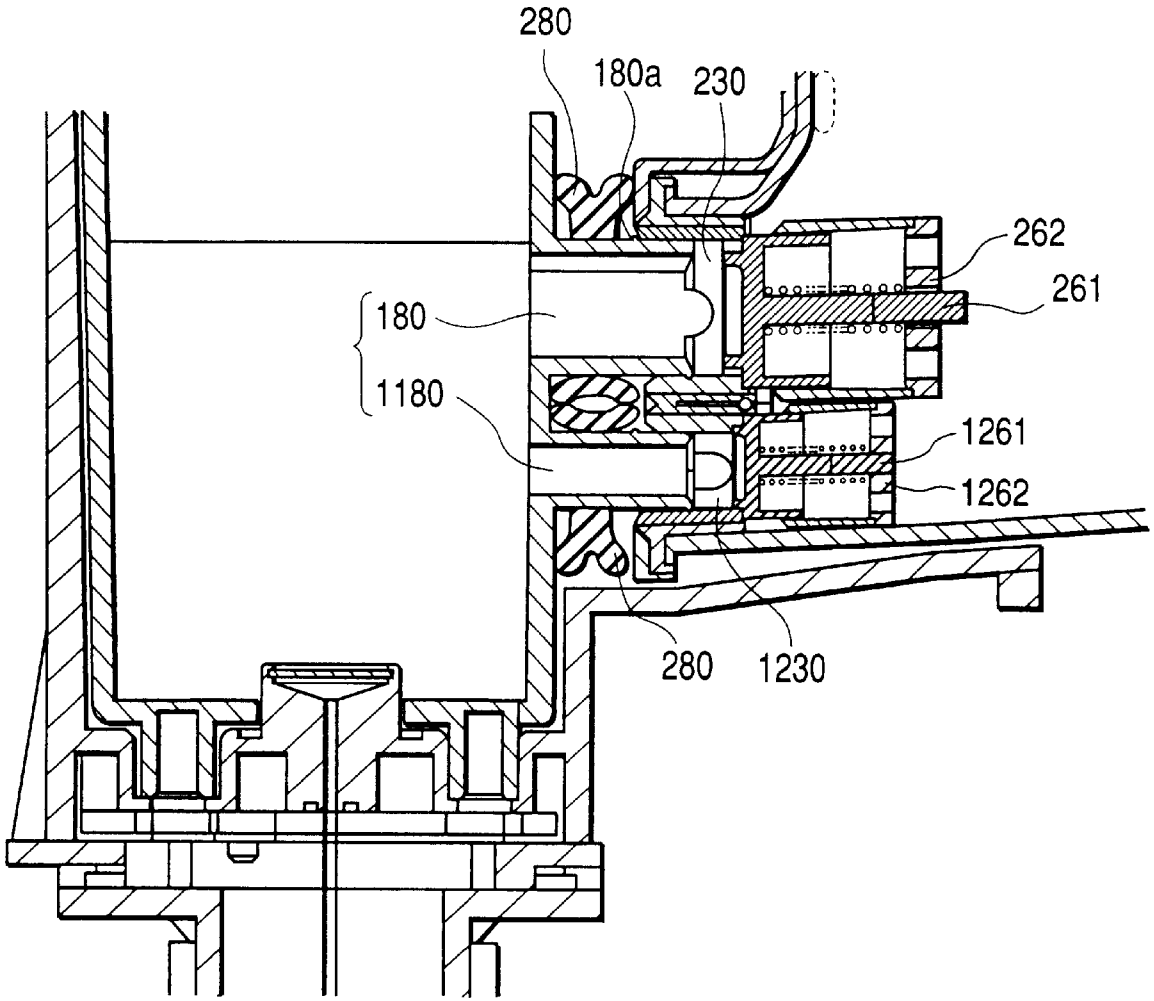
FIG. 13 is a cross-portional view illustrating a third step of installation of the ink tank unit in the negative pressure control chamber unit in FIG. 9.

When rotative motion of ink tank unit 200 is continued, as shown in FIG. 13, the joint pipe 180 is inserted in the joint ports 230, and the joint ports 1230 is also sealed. Both valve bodies 261 and 1261 are still in a closed status.

Figure 14:
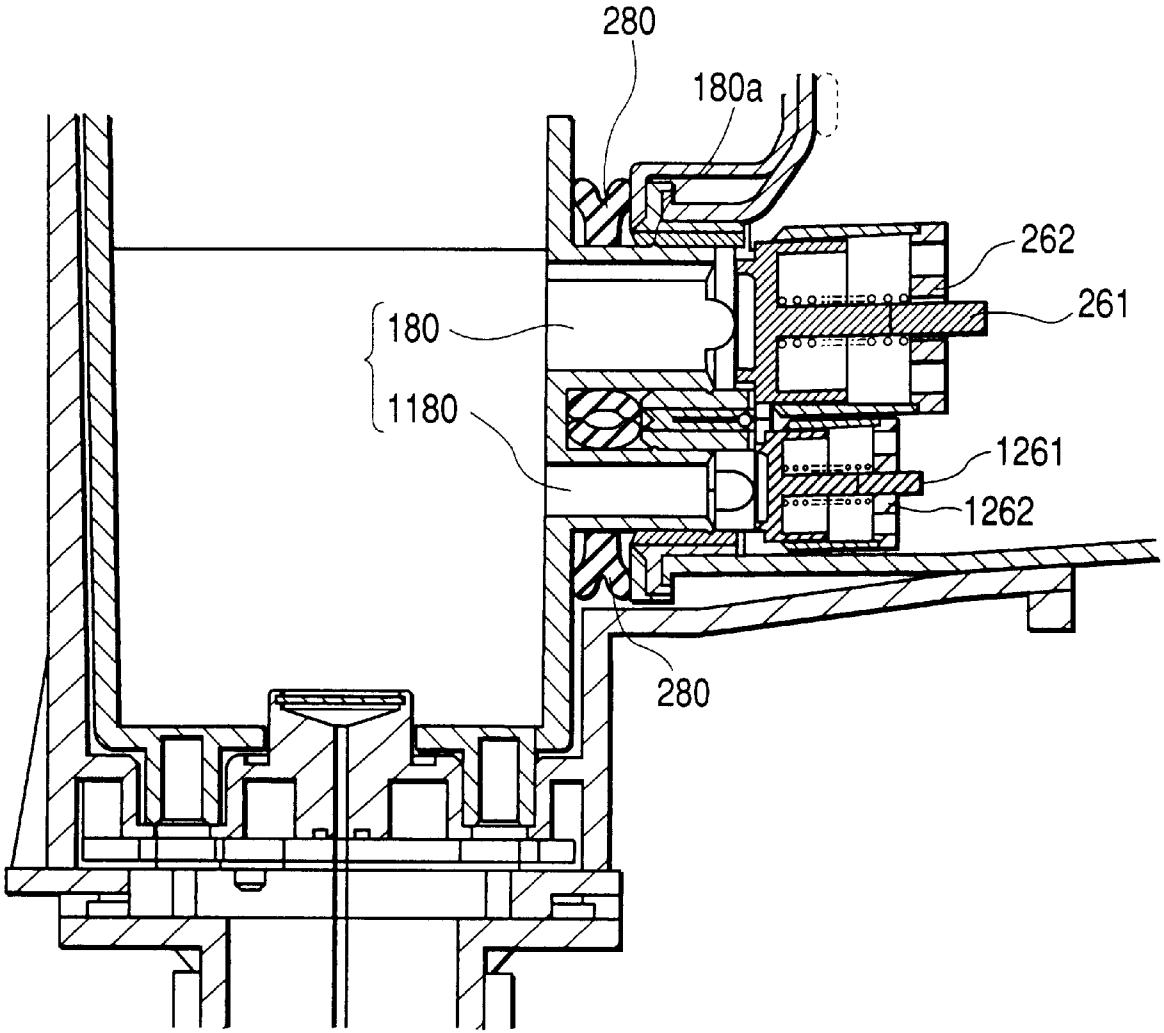
FIG. 14 is a cross-portional view illustrating a fourth step of installation of the ink tank unit in the negative pressure control chamber unit in FIG. 9.

Next, the ink tank unit 200 installed in a predetermined position is located in a position, i.e., the position where the ID member 170 corresponds to the recess 252 for the ID, shown in FIG. 14 and therefore, further moved to the back of the negative pressure control chamber unit 100. Further, when the ink tank unit 200 is rotatively moved to the direction of an arrow G, the end of the joint pipe 180 contacts with the valve body 1261 to push the valve body 1261. Through this step, the valve mechanism opens to connect inside of the ink tank unit 200 to inside of the negative pressure control chamber unit 100 through a downward connecting passage 14*b* and then, ink 300 contained in the ink tank unit 200 can be supplied to the negative pressure control chamber unit 100.

Figure 15:
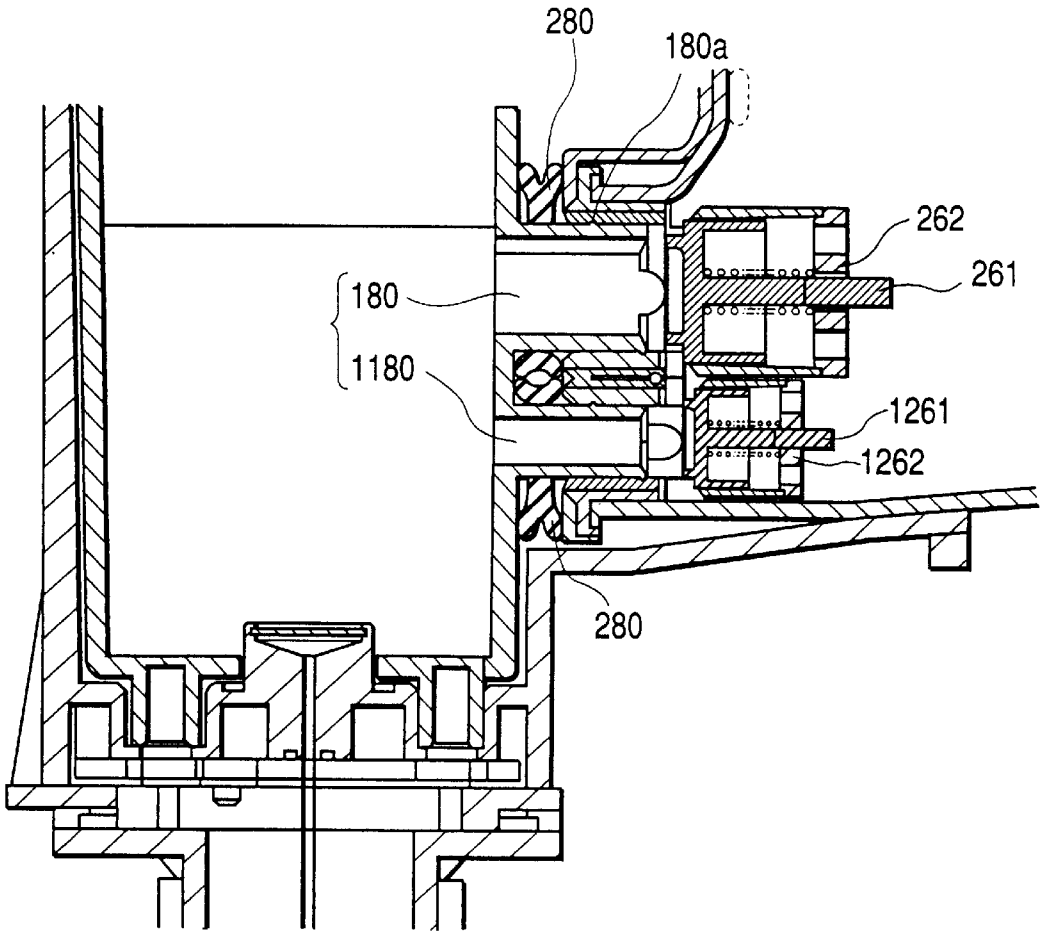
FIG. 15 is a cross-portional view illustrating a fifth step of installation of the ink tank unit in the negative pressure control chamber unit in FIG. 9.

Subsequently, as shown in FIG. 15, the end of the joint pipe 180 contacts with the valve body 1261 to push the valve body 261, the valve mechanism opens to connect inside of the ink tank unit 200 to inside of the negative pressure control chamber unit 100 also through an upward connecting passage 14*a* and then, ink 300 contained in the ink tank unit 200 can be supplied to the negative pressure control chamber unit 100. The details of opening and closing actions of the valve mechanism will be mentioned later.

After this step, the ink tank unit 200 is further rotatively moved to push the ink tank unit 200 in the position shown in FIG. 9. According to this action, the bottom part of the rear surface of the ink tank unit 200 is locked with the locking part 155 of the ink tank of the holder 150 to lock the ink tank unit 200 to the desired position in the holder 150. In this situation, the ID member 170 moves to the direction for slight release from the recess 252 for the ID. An energizing force to a rear direction (the holder locking part 155 side) for locking the ink tank unit 200 is applied by an energizing member 263 in the ink tank unit 200 and a rubber joint part 280 installed in the circumference of the joint pipes 180 and 1180.

In the ink tank unit 200 to mount and demount according to rotative motion as described above, the recess 252 for the ID is formed on the oblique surface 251 and the bottom surface of the ink tank unit 200 is tilted to make assured mounting and demounting of the ink tank unit 200 possible with a minimum space and without wrong installation and ink blending.

As described above, when the ink tank unit 200 and the negative pressure control chamber unit 100 are connected each other, ink moves until the pressures in the negative pressure control chamber unit 100 and a ink containing container 201 become equal and as shown in FIG. 15, reach equilibrium in a condition in which the pressures in the joint pipe 180 and 1180 and the joint ports 230 and 1230 becomes negative (This condition is named "condition of stating use".). Ink movement to reach the equilibrium condition is same as that of the above described second embodiment and description of details will be omitted. However, as a characteristic matter in the present embodiment, it is described herewith that even if air exists in the joint ports 230 and 1230 and the joint pipe 180 and 1180, the ink path formed by contact of ink in the ink containing container 201 to the absorbing body 140 deforms an internal bag 220 according to flowing out of ink. Thus, air easily moves to inside of the internal bag 220.

As described above, the ink tank unit 200 is installed in the holder 150 by nearly rotative motion as the external bottom surface thereof is obliquely inserted in the situation of mounting on the locking part 155 of the ink tank of the holder 150 and the ink tank unit 200 is moved over the locking part 155 and then pushed into the bottom surface of the holder 150. On the contrary, the ink tank unit 200 is removed from the holder 150 by reverse action of this. The opening and closing actions of the valve mechanism installed in the ink tank unit 200 are carried out according to the mounting and demounting actions of the ink tank unit 200.

<Opening and Closing Actions of the Valve Mechanism>

Opening and closing actions of the valve mechanism will be described below with reference to FIGS. 11 to 15.

FIG. 11 shows a condition before the ink tank unit 200 is obliquely inserted in the holder 150 with a downward oblique position of the joint ports 230 and the joint pipe 180 is inserted in the joint ports 230.

In the joint pipe 180, a sealing projection 180*a* is integrally formed in a whole range of the external circumferential surface thereof and also a valve opening and closing projection 180*b* is formed on end thereof. The sealing projection 180*a* contacts to a joint sealing surface 260 of the joint ports 230 when the joint pipe 180 is inserted in the joint ports 230 and is obliquely installed to make distance from the end of the joint pipe 180 in the top end larger than that in the bottom end.

The sealing projection 180*a,* as mentioned later, slides toward the joint sealing surface 260 in mounting and demounting actions of the ink tank unit 200 and a material good in a slidable and contacting performances to the joint sealing surface 260 are preferably used. The shape of the energizing member 263 energizing the valve body 261 toward a first valve frame 260*a* side is not specially restricted and a spring member such as a coil spring and a leaf spring or a member having elasticity like a rubber can be used. In consideration of recycling performance, an elastic member made of a resin is preferable.

In the condition shown in FIG. 12, the valve opening and closing projection 180*b* does not contact to the valve body 261 and the seal part formed in the outer circumferential part of the side end of the end of the joint pipe 180 of the valve body 261 is pressed to the seal part of the first valve frame 260*a* by the energizing force of the energizing member 263. Then, airtightness of the inside of the ink tank unit 200 is maintained.

When the ink tank unit 200 is further inserted in the holder 150, the joint sealing surface 260 of the joint ports 230 is sealed by the sealing projection 180*a*. Here, the sealing projection 180*a* is installed obliquely as described above. First, as shown in FIG. 12, the bottom end of the sealing projection 180*a* contacts to the joint sealing surface 260 and slides toward the joint sealing surface 260 according to inserting action of the ink tank unit 200 to widen gradually contacting area toward the upper part of the sealing projection 180*a,* and finally, top end of the sealing projection 180*a* contacts to the joint sealing surface 260. Then, the whole surrounding of the sealing projection 180*a* contacts to the joint sealing surface 260 and the joint ports 230 is sealed by the sealing projection 180*a*.

Furthermore, in the condition shown in FIG. 12, the valve opening and closing projection 180*b* does not contact to the valve body 261 and the valve mechanism has not opened. Thus, the joint ports 230 is sealed before the valve mechanism is opened and therefore, leak of ink from the joint ports 230 during installing action of the ink tank unit 200 is prevented.

Besides, as described above, the joint ports 230 is gradually sealed starting from the bottom side of the joint sealing surface 260. Therefore, until the joint ports 230 is sealed by the sealing projection 180*a,* air in the joint ports 230 is exhausted from a gap between the sealing projection 180*a* and the joint sealing surface 260. Consequently, air left in the joint ports 230 in the sealed situation of the joint ports 230 become minimum through exhaust of air contained in the joint ports 230. Therefore, excessive compression of air, i.e., an excessive rise of temperature in the joint ports 230, in the joint ports 230 by invasion of the joint pipe 180 into the joint ports 230 is prevented. As the result, careless opening of the valve according to the rise of pressure in the joint ports 230 and flowing out of ink to inside of the joint ports 230 thereby before the ink tank unit 200 is completely installed in the holder 150 can be prevented.

Subsequently, as shown in FIG. 13, the joint pipe 1180 seals the joint ports 1230 as like as the joint ports 230.

When the ink tank unit 200 is further inserted, as shown in FIG. 14, the valve opening and closing projection 1180*b* pushes the valve body 1261 in against the energizing force of the energizing member 1263, keeping seal of the joint ports 1230 by the sealing projection 1180*a.* An opening 1260*c* of the second valve frame 1260*b* connects to the joint ports 1230, air in the joint ports 1230 passes through the opening 1260*c* to be introduced to inside of the ink tank unit 200, and ink in the ink tank unit 200 passes through the opening 1260*c* and the joint pipe 1180 to be supplied to the negative pressure control chamber container 110 (refer to FIG. 9).

Consequently, as shown in FIG. 15, the valve opening and closing projection 180*b* of the joint pipe 180 presses in the valve body 261 to open the top valve as like as the bottom valve as described before.

Then, introducing air in the joint ports 230 and 1230 in the ink tank unit 200 decreases the negative pressure inside the internal bag 220 (refer to FIG. 9), when, for example, the ink tank unit 200 on use is installed again. Then, balance of the negative presses of the negative pressure control chamber container 110 and the internal bag 220 are improved to prevent malfunction of resupply of ink to the negative pressure control chamber container 110.

After the above described action, the ink tank unit 200 is pressed in the bottom surface of the holder 150 to install the ink tank unit 200 in the holder 150 as shown in FIG. 9, and then, the joint ports 230 and 1230 are completely connected to the joint pipes 180 and 1180 to allow a condition in which the above described air-liquid exchange is assuredly carried out.

In the present embodiment, the opening part 260*c* in the second valve frame 260*b* is made in the bottom side of the ink tank and around a valve frame seal part 264. According to the configuration this opening part 260*c,* in opening of the valve mechanism, the valve body 261 is pressed by the valve opening and closing projection 180*b* to move to the valve lid 262 and then immediately, ink in the ink tank unit 200 is started to supply to the negative pressure control chamber unit 100, and quantity of ink left in the ink tank can be the minimum when ink is finished to use.

Further in the present embodiment, a thermoplastic elastomer was used for a material to compose the joint seal surface 260 and 1260 of the first valve frame 260*a* and 1260*a,* i.e., the seal part of the first valve frame. Then, using the thermoplastic elastomer as a composing material allows formation of the valve frame in which the seal part made by the double-color injection molding is installed, realizing an assured sealing performance of the joint pipes 180 and 1180 with the sealing projections 180*a* and 1180*a* in the joint seal surface 260 and 1260 by an elastic force of the elastomer, and realizing an assured sealing performance of the valve bodies 261 and 1261 with the seal parts in the seal parts of the first valve frames 260*a* and 1260*a*. In addition, giving the elastic force over the elastic force minimally necessary to elastomer (for example, increase in thickness of the elastomer) to realize an assured sealing performance of the first valve frames 260*a* and 1260*a* with the joint pipes 180 and 1180 allows highly reliable sealing through suppressing a wobble in a shaft and torsion by bending of the elastomer in a joint pipe connecting position in serial scanning of the ink jet head cartridge. Besides, the elastomer used for composition material can be integrally molded with the first valve frames 260*a* and 1260*a* to yield the above described effect without use of more parts. A part using the elastomer as the component is not restricted to the above described component and the elastomer may be used for the component material of the sealing projections 180*a* and 1180*a* formed in the joint pipes 180 and 1180 and the component material of the seal parts of the valve bodies 261 and 1261.

On the other hand, when the ink tank unit 200 is removed from the holder 150, actions of releasing the seal of the joint ports 230 and 1230 and the valve mechanism are carried out in the reverse order to the above described action.

When the ink tank unit 200 is pulled out from the holder 150 with rotative motion reversal to that of installation, the valve body 261 first proceeds by energizing force of the energizing member 263, the seal part of the valve body 261 is pressed to the seal part of the first valve frames 260*a,* and then the joint ports 230 is closed by the valve body 261. Next, the joint ports 1230 is closed by the valve body 1261.

Then, the ink tank unit 200 is further pulled out to release the seal of the joint ports 1230 by the sealing projection 1180*a.* Subsequently, the seal of the joint ports 230 by the sealing projection 180*a* is closed. Then, the seal of the joint ports 230 and 1230 is released after closing of the valve mechanism and then, unnecessary ink supply to the joint ports 230 and 1230 is prevented.

In addition, the sealing projections 180*a* and 1180*a* are obliquely installed as described above and thus, the seal of the joint ports 230 and 1230 is released from the top end of the sealing projections 180*a* and 1180*a.* Before the seal of the joint ports 230 and 1230 is released, ink leaves in the seal of the joint ports 230 and 1230 and the joint pipes 180 and 1180. The top end of the sealing projections 180*a* and 1180*a* is first released and the bottom end is kept to seal. Therefore, ink does not leak from the joint ports 230 and 1230. Besides, the inside of the joint ports 230 and 1230 and the joint pipes 180 and 1180 are in the condition of the negative pressure. Thus, when the top end of the sealing projections 180*a* and

1180*a* is released, atmosphere enters the joint ports 230 and 1230 therefrom and then, ink left in the joint ports 230 and 1230 and the joint pipes 180 and 1180 is sucked into the negative pressure control chamber container 110.

As described above, leak of ink from the joint ports 230 and 1230, when the ink tank unit 200 is removed from the holder 150, is prevented by first opening of the top end of the joint pipes 180 and 1180 to move ink left in the joint ports 230 and 1230 to the negative pressure control container 110 in releasing the seal of the joint ports 230 and 1230.

As described above, according to the connection structure of the ink tank unit 200 to the negative pressure control container 110 in the present embodiment, the joint ports 230 and 1230 is sealed before the valve mechanism of the ink tank unit 200 works. Therefore, unnecessary leak of ink from the joint ports 230 and 1230 can be prevented. In addition, in connecting and removing the ink tank unit 200, when time difference is set between the top part and the bottom part in sealing timing and removing timing thereof, leak of ink left in the joint ports 230 and 1230 can be prevented in careless action and removal of the valve bodies 261 and 1261 for connection.

Further, in the present embodiment, the valve bodies 261 and 1261 are arranged in the back of the end of the opening of the joint ports 230 and 1230 and the valve bodies 261 and 1261 are acted through the valve opening and closing projections 180*b* and 1180*b* of the end of the joint pipes 180 and 1180 and thus, stain by ink attached to the valve bodies 261 and 1261 can be prevented without direct touch to the valve bodies 261 and 1261 by a user.

(Relation Between the Mounting and Demounting Action of the Joint Par and the ID)

Relation between the mounting and demounting action of the joint par and the ID will be described below with reference to FIGS. 11 to 15. FIGS. 11 to 15 are figures showing process of installing the ink tank unit 200 in the holder 150, respectively.

Installing operation is carried out up to the position shown in FIG. 11, i.e., the position where a plurality of the ID members 170 for prevention of wrong insertion of the ink tank unit 200 installed in the negative pressure control chamber unit 100 contacts to the oblique surface 251 of the ink tank. In configuration in this point, the joint ports 230 and 1230 do not contact to the joint pipes 180 and 1180. Here, if a wrong ink tank unit is attempted to install, the above described oblique surface 251 interferes to the above described ID members 170 to inhibit installation of more ink tank units. According to the present configuration, as described above, the joint ports 230 and 1230 never contact to the joint pipes 180 and 1180 and thus, ink blend in the joint part in wrong installation, ink sticking, no discharge, image defect, defect of apparatus, and unnecessary replacement of the head in an apparatus of ink tank replacement type can be previously prevented.

Next, the ink tank unit 200 installed in a correct position is installed in the position shown in 5, i.e., the position where the above described ID members 170 corresponds to the recess 252 for the ID and thus, further inserted into the back (the negative pressure control chamber unit 100 side). In the ink tank unit 200 installed up to this position, the joint ports 1230 and the bottom end of the sealing projections 1180*a* of the joint pipes 1180 contacts to the seal surface 1260 of the joint ports 1230. Following this, as previously described process, the joint part is connected, and inside of the ink tank unit 200 is connected to inside of the negative pressure control chamber unit 100. Subsequently, the joint ports 230 and the bottom end of the sealing projections 180*a* of the joint pipes 180 contacts to the seal surface 260 of the joint ports 230, the joint part is connected as previously described process, and also where, inside of the ink tank unit 200 is connected to inside of the negative pressure control chamber unit 100.

In the above described present embodiment, the sealing projections 180*a* and 1180*a* are integrally installed with the joint pipes 180 and 1180. However, it may be the configuration that the sealing projections 180*a* and 1180*a* are separately installed from the joint pipes 180 and 1180, the sealing projections 180*a* and 1180*a* are substantially engaged with the projection or recess made around the joint pipes 180 and 1180, and then the sealing projections 180*a* and 1180*a* can move around the joint pipes 180 and 1180. Here, movable range of the sealing projections 180*a* and 1180*a* are designed to avoid contact of the valve opening and closing projections 180*b* and 1180*b* to the valve bodies 261 and 1261 until the sealing projections 180*a* and 1180*a* within the movable range completely contact to the joint seal surface 260 and 1260 in installation of the ink tank unit 200 in the holder 150.

In the process of installation of the ink tank unit 200 in the holder 150 in the embodiment described above, it has been shown that the bottom end of the sealing projections 180*a* and 1180*a* contact to the joint seal surface 260 and 1260, contact area increases gradually toward the top end of the sealing projections 180*a* and 1180*a* according to insertion action with rotatable motion of the ink tank unit 200 sliding against the joint seal surface 260 and 1260, and finally, the top end of the sealing projections 180*a* and 1180*a* contact to the joint seal surface 260 and 1260. It may be allowed that the top end of the sealing projections 180*a* and 1180*a* contact to the joint seal surface 260 and 1260, contact area increases gradually toward the bottom end of the sealing projections 180*a* and 1180*a* according to insertion action of the ink tank unit 200 sliding against the joint seal surface 260 and 1260, and finally, the bottom end of the sealing projections 180*a* and 1180*a* contact to the joint seal surface 260 and 1260. Also, the top end may contact simultaneously to the bottom end. Here, even if air existing between the joint pipes 180 and 1180 and the valve bodies 261 and 1261 presses in the valve bodies 261 and 1261 to open the valve bodies 261 and 1261, ink 300 in the containing container 201 does not leak out, because the joint ports 230 and 1230 is completely sealed by the sealing projections 180*a* and 1180*a* and the joint seal surface 260 and 1260. In conclusion, the important point of the present invention is that the valve mechanism is opened after the joint pipes 180 and 1180 and the joint ports 230 and 1230 are completely sealed. According to the present configuration, ink 300 in the ink tank does not leak out in installation of the ink tank unit 200. Air pressed in enters the ink tank unit 200 to push out ink 200 in the ink containing container 201 toward the joint ports 230 and 1230 and finally resulting in fast supply of ink from the ink containing container 201 to the absorbing body 140

<Valve Mechanism>

The above described valve mechanism installed in the joint ports 230 of the ink tank unit 200 will be described below in detail with reference to FIGS. 17A to 17D.

Figures 17A, 17B, 17C, 17D:
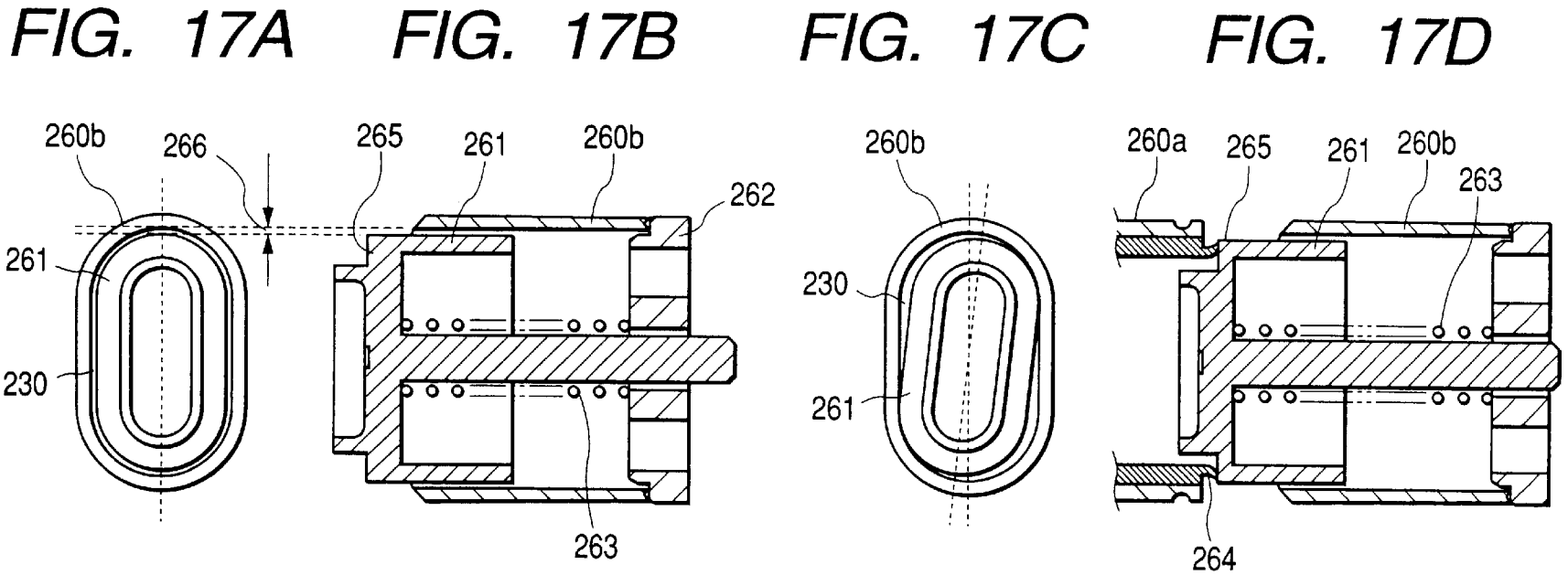
FIGS. 17A, 17B, 17C and 17D illustrate the relationship between a valve frame and a valve body in a valve mechanism which is applicable to the present invention.

FIG. 17A is a frontal view of relation between the second valve frame 260*b* and the valve bodies 261, FIG. 17B is a side portional view of FIG. 17A, FIG. 17C is a frontal view of relation between the second valve frame 260*b* and the valve bodies 261 rotated, and FIG. 17D is a side portional view of FIG. 17C.

Here, as shown in FIG. 17A and FIG. 17B, the shape of the opening of the joint ports 230 is a long hole shape extending to one direction in order to increase performance of ink supply of the ink containing container 201 and the area of the opening of the joint ports 230 is enlarged. However, enlarging the width of the opening of the joint ports 230 toward the transverse direction vertical to the length direction of the joint ports 230 increases a space of the ink containing container 201 to cause upsizing of the apparatus. This tendency is particularly effective for parallel aligning of ink tanks transversely (direction of carriage scanning) according to recent color copying and photograph copying. Therefore, in the present embodiment, the shape of the opening of the joint ports 230 which is an ink supplying port of the ink containing container 201 is a long hole shape.

In addition, the ink jet head cartridge of the present embodiment, the joint ports 230 a role to supply ink to the negative pressure control chamber unit 100 and a role to introduce air in the ink containing container 201. Therefore, the joint ports 230 having the long hole shape which has the length direction in a vertical direction to a gravity direction easily allows separation of functions as that the bottom part of the joint ports 230 is mainly ink supply passage and the top part of the joint ports 230 is mainly air introducing passage to achieve assured ink supply and air-liquid exchange.

As described above, the joint pipe 180 of the negative pressure control chamber unit 100 is inserted in the joint ports 230 according to insertion of the ink tank unit 200. Then, the valve opening and closing projections 180*b* of the end of the joint pipe 180 presses the valve body 261 to open the valve mechanism the joint ports 230 and then, ink in the ink containing container 201 is supplied to the negative pressure control chamber unit 100. Twisting of the valve body 261 can be prevented through semicircular-shaped portion of the end of the sealing projection 180*a* arranged on the side surface of the joint pipe 180 even if only one side of the valve opening and closing projection 180*b* contacts a valve member according to the attitude in which the ink tank unit 200 is inserted in the joint pipe 180. Here, in order to make stable sliding of the valve body 261 possible, a clearance 266, as shown in FIG. 17A and FIG. 17B, is put between the seal surface 260 inside the joint ports 230 and the outer circumference of the part of the first valve frame 260*a* side of the valve body 261.

Furthermore, in the end of the joint pipes 180, at least the top part has been opened and therefore, formation of main atmosphere introducing passage is not inhibited in the joint pipes 180 and the top part of the joint ports 230 in the case where the joint pipes 180 is inserted in the joint ports 230 to make rapid air-liquid exchange possible.

On the contrary, in removing action of the ink tank unit 200, the joint pipes 180 is released from the joint ports 230 and then, the valve body 261 slides to the frond of the first valve frame 260*a* side by the elastic force applied from the energizing member 263, and as shown in FIG. 17D, the valve frame seal part 264 of the first valve frame 260*a* engages with the valve body seal part 265 of the valve body 261 of the valve body 261 to block the supply passage for ink.

Figure 18:
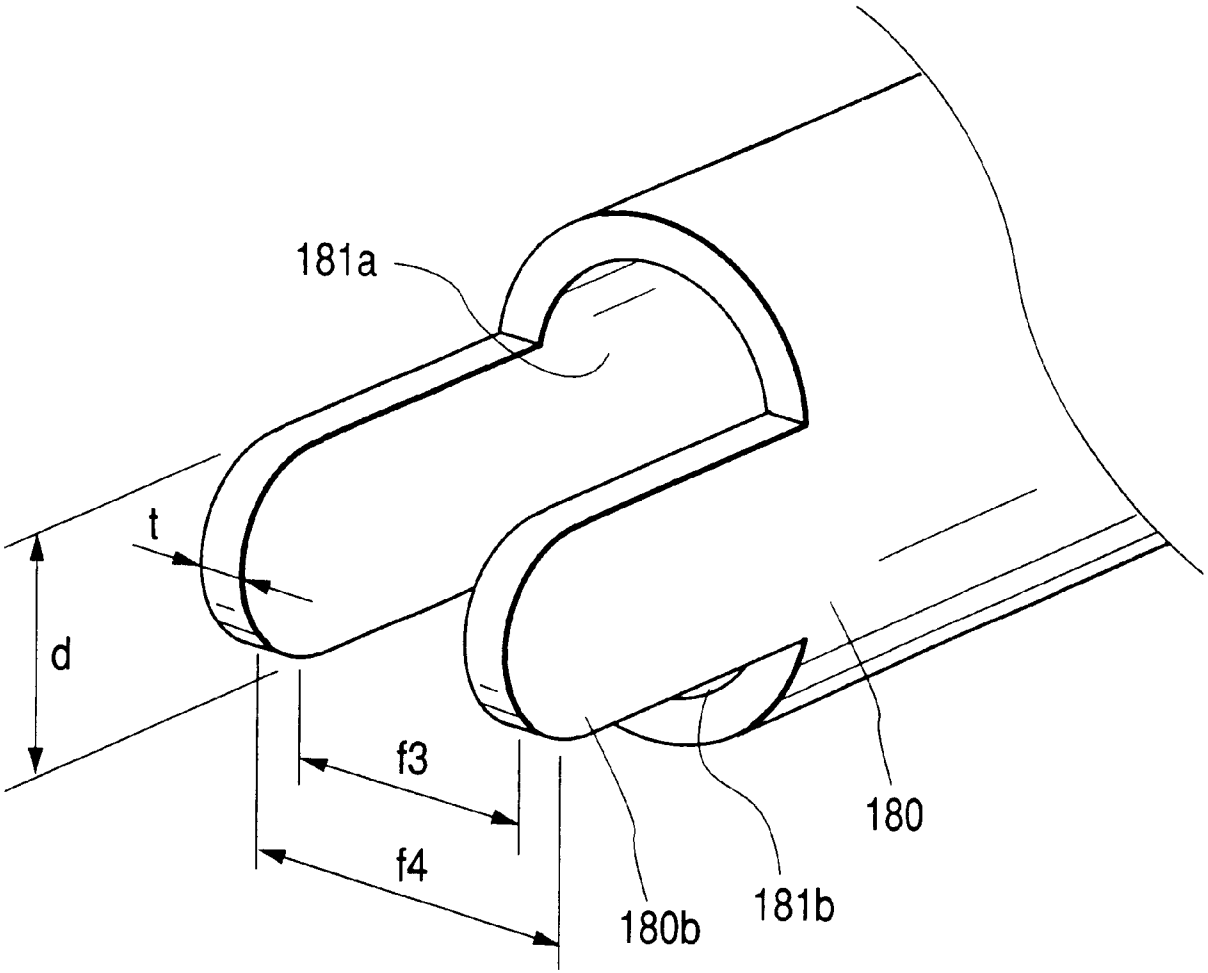
FIG. 18 is a perspective view of an example of the end shape of a joint pipe which engages when a valve mechanism applicable to the present invention opens or closes.

FIG. 18 is a perspective side view showing an example of the end of the joint pipes 180. As shown in FIG. 18, an upper opening part 181*a* is formed in the top part of the end part of the long hole shaped the joint pipes 180 and a lower opening part 181*b* is formed in the lower part of the end thereof. The lower opening part 181*b* is the ink passage and the upper opening part 181*a* is an air passage, however, ink may be passed through the upper opening part 181*a*.

For the value of energizing force of the valve body 261 to the first valve frame 260*a*, it is set that even if difference between internal and external pressures of the ink containing container 201 occurs in a change of ambient on use, the energizing force of the valve body 261 is kept almost constant. In the case where the ink tank unit 200 with a closed valve body 261 is carried in ambient under a 1.0 atmospheric pressure after using such the ink tank unit 200 in a high land under a 0.7 atmospheric pressure, the pressure inside the ink containing container 201 reduces from the atmospheric pressure to apply the force to the valve body 261 toward the direction to press and open the valve body 261. In the present embodiment, a force FA by which atmosphere presses the valve body 261 is expressed by $$FA=1.01\times10^5\ [\mathrm{N/m^2}](1.0\ \text{atmospheric pressure})$$

On the other hand, a force FB by which gas in the ink tank presses the valve body 261 is expressed by $$FB=0.709\times10^5\ [\mathrm{N/m^2}](0.7\ \text{atmospheric pressure})$$

In order to make always the valve body 261 generate the energizing force the even in such changed ambient factor, the energizing force FV of the valve body 261 should satisfy the following formula:

$$FV-(FA-FB)>0$$

Where, in the present embodiment, the following formula is held.

$$FV>1.01\times10^5-0.709\times10^5=0.304\times10^5\ [\mathrm{N/m^2}]$$

This value is of the case where the valve body 261 engages with the first valve frame 260*a*. In the case where the valve body 261 is distant from the first valve frame 260*a*, it is obvious that the value of energizing force to energize the valve body 261 toward the first valve frame 260*a* further increases, because displacement of the energizing member 263 to generate energizing force toward the valve body 261 increases.

In the valve mechanism with such configuration, a friction coefficient of the sliding surface of the valve opening and closing projections 180*b* on the valve body 261 may increase. In this case, what is known as a torsion phenomenon may occur as follows: the valve body 261 does not slide on the sliding surface of the valve opening and closing projection and then, the valve body 261 strokes being lifted up upward in the figure by the valve opening and closing projections 180*b* according to rotative motion action.

Thus, a shape of the valve in consideration of occurrence torsion phenomenon influencing on sealing performance will be described below with reference to comparative examples.

Figure 19:
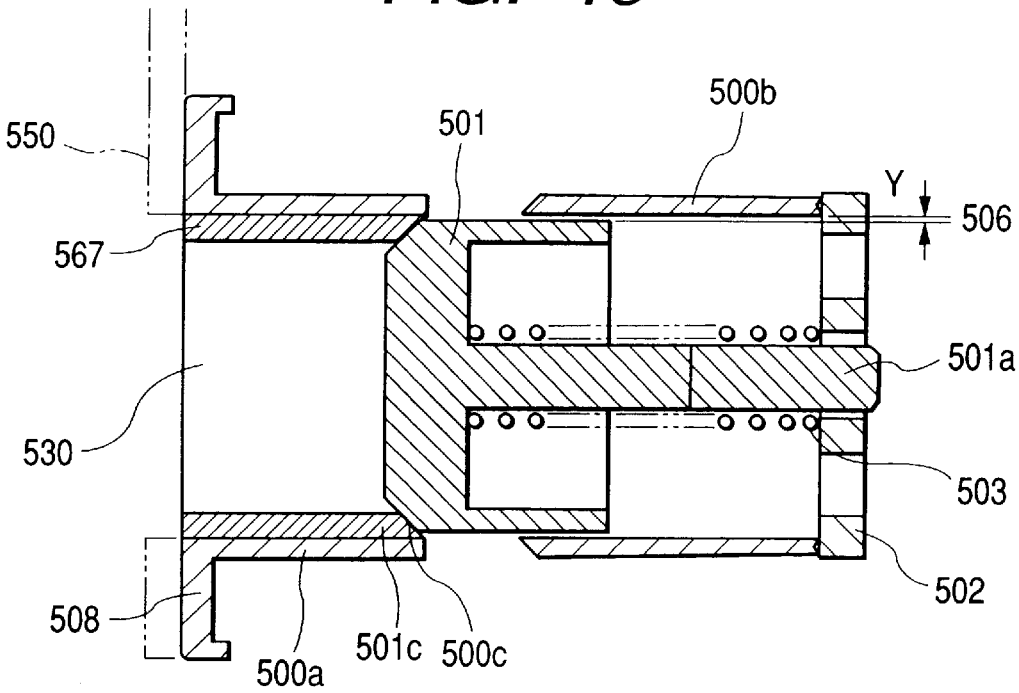
FIG. 19 shows an example for comparison with a valve mechanism applicable to the present invention.
Figure 20:
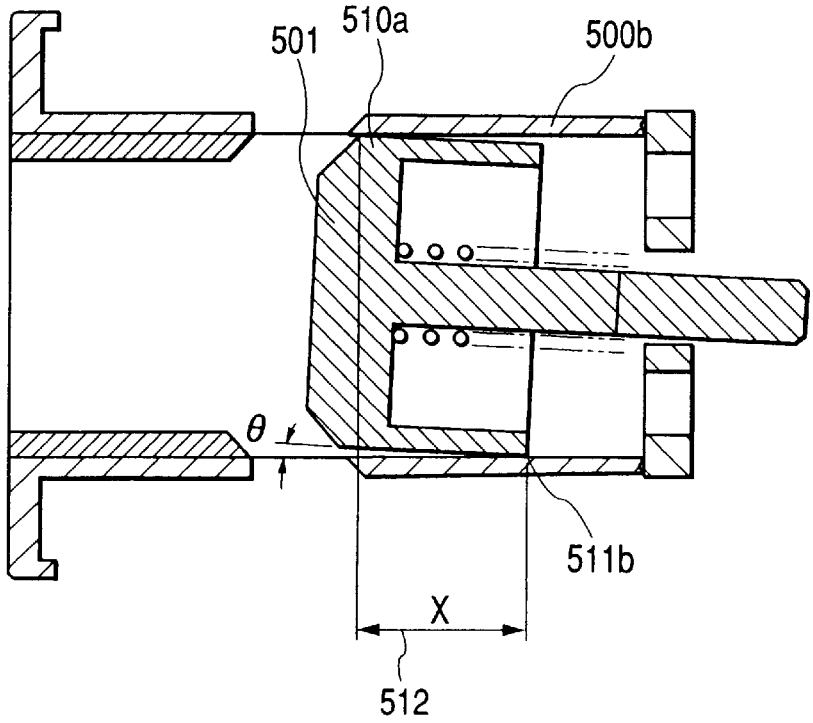
FIG. 20 shows the valve mechanism of FIG. 19 as torsioned.
Figure 21:
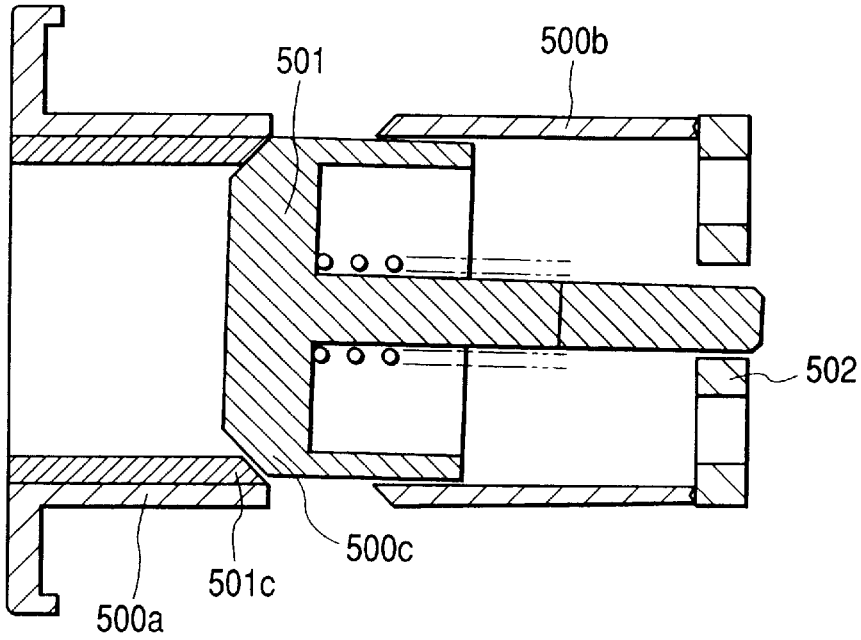
FIG. 21 shows the valve mechanism of FIG. 19 as sealed.

FIG. 19 is an example of a shape for comparison with the valve mechanism of the present embodiment. FIG. 20 and FIG. 21 show torsion and sealing condition in the valve mechanism of FIG. 19. In the comparative example of FIG. 19, the clearance 506 between the long hole-shaped valve body 501 and the second valve frame 500*b* for sliding is a fixed value. The valve body 501 is pressed to the first valve frame 500*a* by the energizing member 503 and then, seals the joint port 530 by close contact of a tapered valve body sealing part 501*c* in the second valve frame 500*b* side of the valve body 501 with the tapered sealing part 500*c* of the first valve frame 500*a*. When the above described torsion phenomenon occurs in the structure of such comparative example, as shown in FIG. 20, the valve body 501 and the second valve frame 500*b* contact with two positions, a contact surface 510*a* and a contact surface 511*b*. If it is assumed that distance between these two contact surfaces is X and the clearance is Y, its torsion angle θ is expressed by the equation $\theta=\tan^{-1}(2Y/X)$ and thus, the larger the distance X between these two contact surfaces the smaller the torsion angle become possible, if clearance is equal.

However, in this comparative example, The distance X between these two contact surfaces is relatively small (in comparison with such as the diameter of the valve body) and thus, the torsion angle θ is relatively large. In other words, correction of torsion requires a relatively large angle rotation action and then, it is known that probability of correction of torsion occurred is low.

In situation of no correction of torsion, as shown in FIG. 21, when contact with the first valve frame 500*a* is made again, the tapered valve body sealing part 501*c* and particularly an R part in the long hole shape of the first valve frame sealing part 500*c* differ from each other in contact semidiameter and the contact part does not completely closely contacts to cause leak of ink.

The second valve frame 500*b* is welded to the valve lid 502 by an ultrasonic wave. However, the valve lid of the comparative example has a simple plane to cause deviation of a position by ultrasonic vibration and precision degree of the center position of the-hole of the valve lid 502 in which a sliding shaft 501*a* of the valve body 501 is inserted may varies. Therefore, the hole of the valve lid 502 should be large in order to prevent contact of the hole of the valve lid 502 with the sliding shaft 501*a* of the valve body 501. The minimum diameter of the energizing member 503 is determined by the diameter of the hole of the valve lid 502 and therefore, miniaturization of the energizing member 503 and miniaturization of a whole valve mechanism become difficult.

Figure 22:
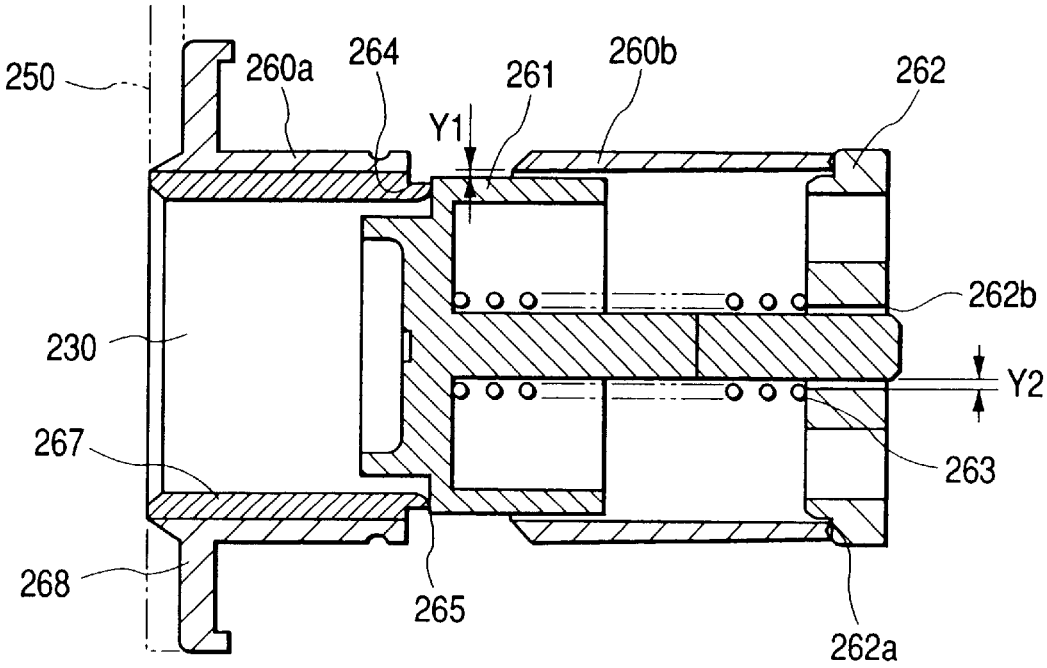
FIG. 22 shows a valve mechanism applicable to the present invention.
Figure 23:
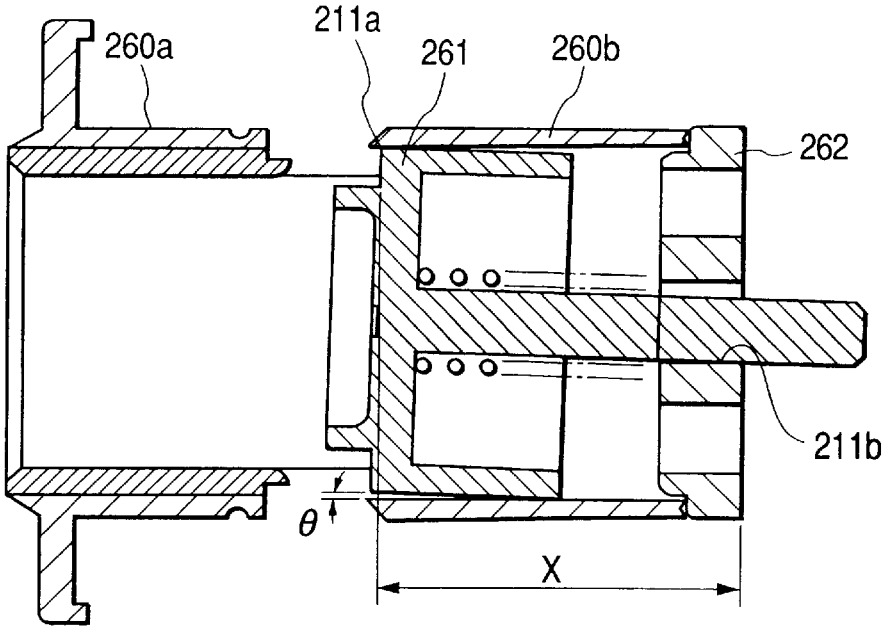
FIG. 23 shows the valve mechanism of FIG. 22 as torsioned.
Figure 24:
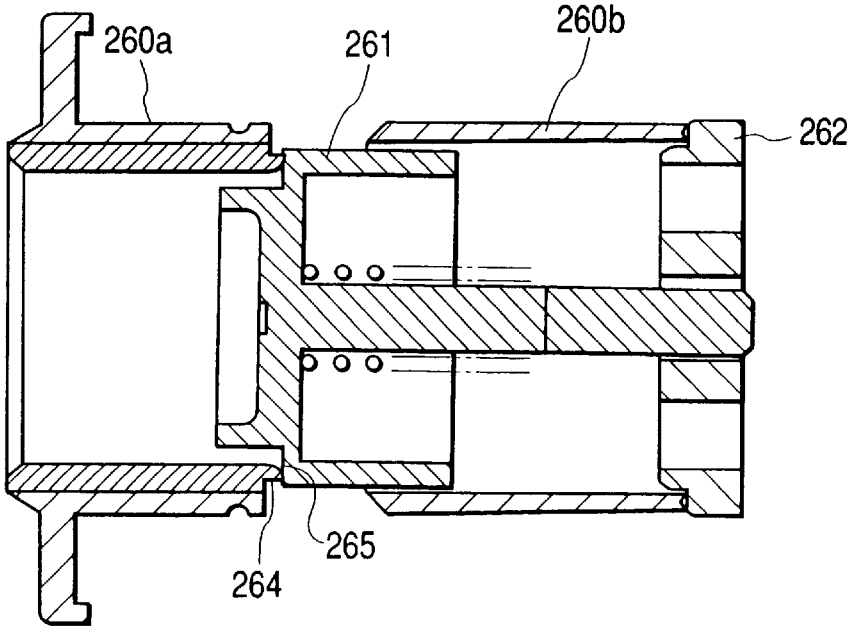
FIG. 24 shows the valve mechanism of FIG. 22 as sealed.

In contrast to such comparative example, the valve mechanism of the present embodiment has the following configuration. FIG. 22 shows the valve mechanism of the embodiment of the present invention. FIG. 23 and FIG. 24 show torsion and sealing condition in the valve mechanism of FIG. 22. As shown in FIG. 22, in the present embodiment, the valve body 261 is tapered to a direction in which the diameter (at least the longer diameter) decreases to the stroke direction (the right-hand direction in the figure). The inner circumferential part of the second valve frame 260*b* is tapered to the direction in which the inner diameter increases to the stroke direction. When the valve body 261 torsion in this configuration, a very large angle is required for contact of the valve body 261 with the second valve frame 260*b* in the position of the contact surface 511*b* in the comparative example of FIG. 20. Before reaching the angle, the sliding shaft of the valve body 261 contacts with the hole of the valve lid 262 (refer to FIG. 23). Then, distance X between contact surfaces can be set longer resulting in the torsion angle θ can be reduced. Therefore, even if the valve body 261 contacts with the first valve frame 500*a* in the situation in which torsion is not corrected, as shown in FIG. 24, good close contact of the valve body sealing part 265 with the first valve frame seal part 264 is yielded, because the torsion angle θ is very small in comparison with the comparative example.

The torsion angle θ is in his case is expressed by θs=tan−1 (Y1+Y2/X), if it is assumed that distance between contact surfaces is X, clearance between the valve body 261 and the second valve frame 260*b* is Y1, and clearance between the sliding shaft of the valve body 261 and the hoe of the valve lid 260*b* is Y2.

A welding guide 262*a* of the valve lid, which is a step (insertion distance of the valve lid is 0.8 mm) allowing the valve lid 252 to insert in the inside of the valve lid 260*b* and contact with the end of the valve lid 260*b,* is made on the valve lid 252. Therefore, in the valve lid 262, the diameter of the hole, which the sliding shaft of the valve body 261 enters, is prepared smaller than that of the comparative example. Thus, precision degree of the center position of the hole of the valve lid 262 can be improved by that the welding guide 262*a* decreases displacement of the position of the valve lid 262 caused by vibration in ultrasonic welding of the valve lid 262 to the valve lid 260*b*. Thus, the diameter of the hole of the valve lid 262 can be reduced to reduce further the minimum diameter of the energizing member 263, and the valve mechanism can be miniaturized. On the other hand, even if a force is applied to the valve lid 262 through the sliding shaft of the valve body 261 by torsion of the valve body 261, rigidity of the valve lid 262 can be kept by the welding guide 262*a* of the valve lid.

In addition, the R part 262*b* is made on a ridge line of the hole of the valve lid 262. This R part 262*b* is made only in non-welding surface side (right-hand side of the figure) among the ridge lines of the hole. According to this configuration, action of the valve body 261 keeping torsioned, particularly contact resistance of the sliding shaft of the valve body 261 with the valve lid 262, can be reduced particularly in closing the valve.

The end part to which the first valve frame 260*a* side of the valve body 261 contacts is the valve body sealing part 265 with a plane. On the other hand, a part to which the valve body sealing part 265 of the first valve frame 260*a* contact is the valve frame seal part 264 made of the elastomer 267 installed in inside of the first valve frame 260*a*. Then, making the sealing parts of the valve body 261 and the first valve frame 260*a* flat allows complete contact, even if the valve body contact torsioning, the R part of the elliptic valve body 261 coincides the first valve frame 260*a* in the contacting semidiameter. Furthermore, the valve frame seal part 264 is a tongue-like projection to assure sealing in contacting.

In the case where the clearance for sliding between the valve body 261 and the second valve frame 260*b* is made in the valve mechanism with such configuration, as shown in FIG. 17C, the valve body 261 may rotate in the second valve frame 260*b* around the shaft thereof as the center in mounting and demounting actions of the ink tank unit 200. However, in the present embodiment, even if the valve body 261 rotates around the shaft thereof to energize to the first valve frame 260*a* in the situation having the maximum rotation angle, the valve frame seal part 264 and the valve body sealing part 265 contact each other in their planes to allow keeping hermetic seal of the valve mechanism.

The shape of the joint ports 230 and the valve mechanism made like the long hole allows making the rotation angle of the valve body 261 to sliding of the valve body 261 minimum and improving responsibility of the valve. Therefore, sealing performance of the valve mechanism of the joint ports 230 can be held. On the other hand, the shape of the joint ports 230 and the valve mechanism made like the long hole allows fast sliding of the sealing projection 180*a* and the valve body 261, which are arranged in the side surface of the joint pipe 180, in the joint ports 230 in mounting and demounting actions of the ink tank unit 200, and a stable connection action is operated.

Figure 25A:
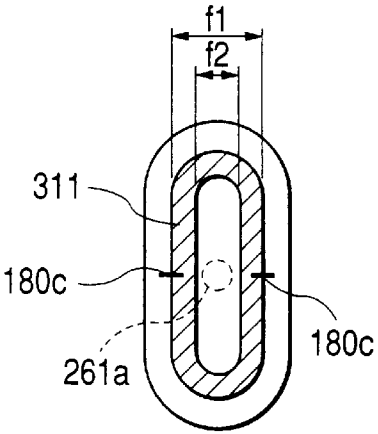
FIGS. 25A, 25B, 25C and 25D illustrate the valve body which are engaged with the end of a joint pipe in the valve mechanism of FIG. 22.
Figure 25B:
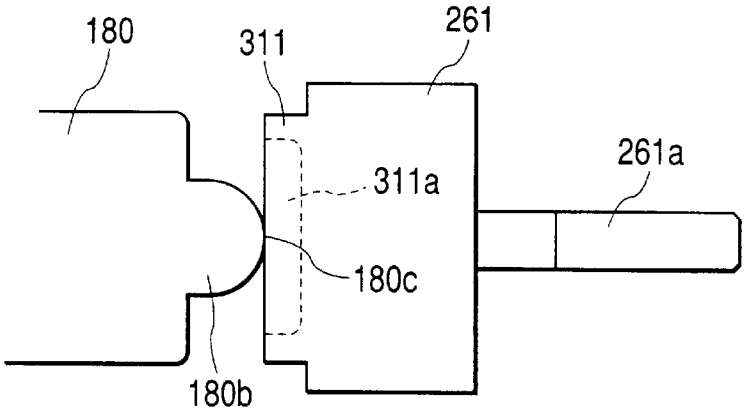
Figure 25C:
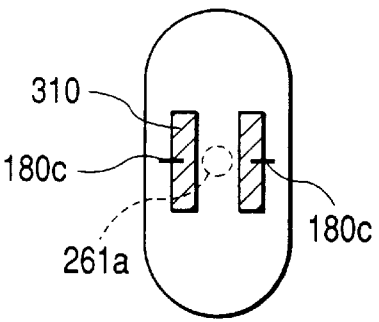
Figure 25D:
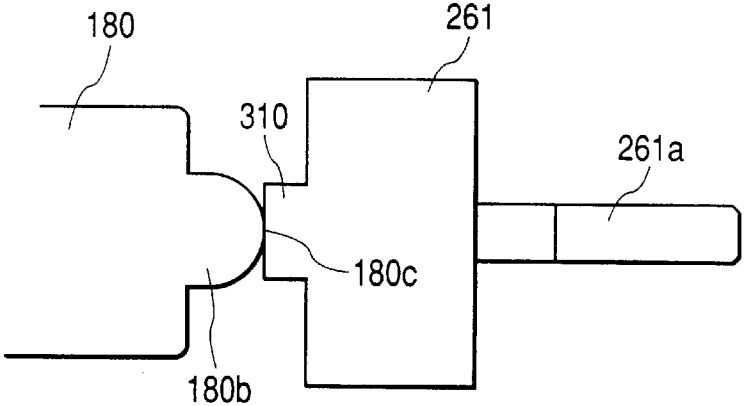

As shown in FIG. 18, the contact part of the joint pipe 180 with the valve body 261 is two left and right oppositely located valve opening and closing projections 180*b* forming the upper opening part 181*a* and the lower opening part 181*b* for air-liquid exchange and liquid supply. Therefore, as shown in FIGS. 25C and 25D, it can be proposed that two contact ribs 310 corresponding to the projection 180*b* in a position, excluding the valve body sealing part 265 to contact closely with the first valve frame seal part 264, of the valve body 261 contacting with the projection 180*b*. However, the valve body 261 in opening of valve is pressed back by the pressing force of the energizing member 263 and thus, the rib part thereof requires rigidity to inhibit deformation. For arrangement and shape of the contacting rib part, even if the position of the contacting rib part of the valve body 261 to two valve opening and closing projections 180*b* of the joint pipe 180 moves to near the shaft of the sliding shaft 261*a* of the valve body 261, it is required that moments applied to two contact positions around the sliding shaft 261*a* as the center is canceled in view of reliability. Then, in the present embodiment, as shown in FIGS. 25A and 25B, a long hole-shaped rib 311 (for example, width 0.6 mm and height 1.3 mm) which has similar figure with the long hole-shaped joint pipe 180 is installed in the valve body 261. In other words, a long hole-shaped recess part 311*a* is made in the central part, which is a position excluding the valve body sealing part 265 to contact closely with the first valve frame seal part 264, of the valve body 261. According to this configuration, the valve body 261 is adapted to that having strength and reliability in contacting to the valve opening and closing projection 180*b*. The rib is made as an annular shape having a recess part in the central part and therefore, moldability of the valve body is improved. In addition, in view of this point, it is preferable to make a microscopically curved plane in the region of the side in which the recess part of proximal part of the annular rib is formed.

As shown in FIGS. 9, 10A and 10B, the ink tank unit 200 is adapted to one in which the ID member 250 is assembled by welding and engaging after the valve mechanism, which contains the first valve frames 260*a* and the second valve frame 260*b*, is inserted in the supply port part of the ink containing container 201. Particularly, the internal bag is exposed to the edge surface of opening of the supply port of the ink containing container 201, a flange part 268 of the first valve frames 260*a* of the valve mechanism is welded to the exposing part of the internal bag, and the ID member 250 is welded to the point of the flange part 268 and engaged with the engaging part 210*a* of a tank case 210.

In such mode of assembly, for example, as described in the comparative example of FIG. 19, in the case where the flange part 508 of the first valve frame to which the ID member 550 is joined is flat, there is no the elastomer 567 inside the hole of the supply port made in the ID member 550 and therefore, leak from the seal may occur in connecting action of the joint pipe 180 shown in FIGS. 11 to 15. Then, in the present embodiment, the welding plane, which was in the same plane as the opening plane of the joint 530, of the ID member 550 of the flange part 508 has been moved back to the opposite side of installation the tank. In other words, as shown in FIG. 9 and FIG. 22, when the ID member 250 is installed in the flange part 268 of the first valve frames, the flange part 268 of the first valve frames is arranged to arrange the outer surface of the ID member 250 in the same plane as the plane of opening of the joint port 230. According to this configuration, the elastomer 267 is surely present inside the hole of supply port made in the ID member 250 and therefore, the valve mechanism has a high reliability without possibility of leak from the seal described above. In addition, the flange part 268 of the first valve frames is moved from the plane of opening of the joint port 230 and thus, the opening part of the joint port 230 projects from the flange plane of the flange part 268 of the first valve frames to make positioning easy through guiding the position of the ID member 250 by the opening part of the joint port 230 in assembling of the ID member 250.

Respective the ink containing container 201 of the ink tank unit 200, according to the present embodiment, is adapted to be installed in the holder 150 and supply a liquid to respective the negative pressure control chamber container 110 through the valve mechanism of the joint pipe 180 and the joint port 230 of a container 201. The holder 150 in which the ink containing container 201 has been installed by such manner is, as mentioned later, mounted on the carriage in a recording machine (refer to FIG. 36) of the serial scanning type is reciprocated in a parallel direction to moving direction of a recording paper. In this case, it is preferable in view of product reliability that any measures is established to prevent deterioration of sealing condition of the inner side surface of the joint port 230 of the ink containing container 201 and the outer side surface of the joint pipe 180 of the negative pressure control chamber container 110 by torsion in connecting position caused by the wobble of the shaft of the joint pipe 180 and displacement of the ink containing container 201 in reciprocation of the carriage.

There, in the present embodiment, the thickness of the elastomer 267 inside the first valve frame 260*a* of the valve mechanism shown in FIG. 9, FIG. 22, and the like is increased to a thickness minimum required or more for simple sealing between the first valve frame 260*a* and the joint pipe 180 to suppress shaft wobbling and torsion of the connecting position of the joint pipe in carriage reciprocation by bending of the elastomer to keep sealing of high reliability. As other measures, rigidity of the valve frame in which the joint pipe 180 inserted is increased than rigidity of the joint pipe 180 to suppress deformation of the valve frame by shaft wobbling and torsion of the connecting position of the joint pipe in carriage reciprocation to keep sealing of high reliability.

Next, the size of respective parts configuring the above described valve mechanism will be described below with reference to FIG. 18, FIGS. 25A to 25D, and FIG. 29.

Figure 29:
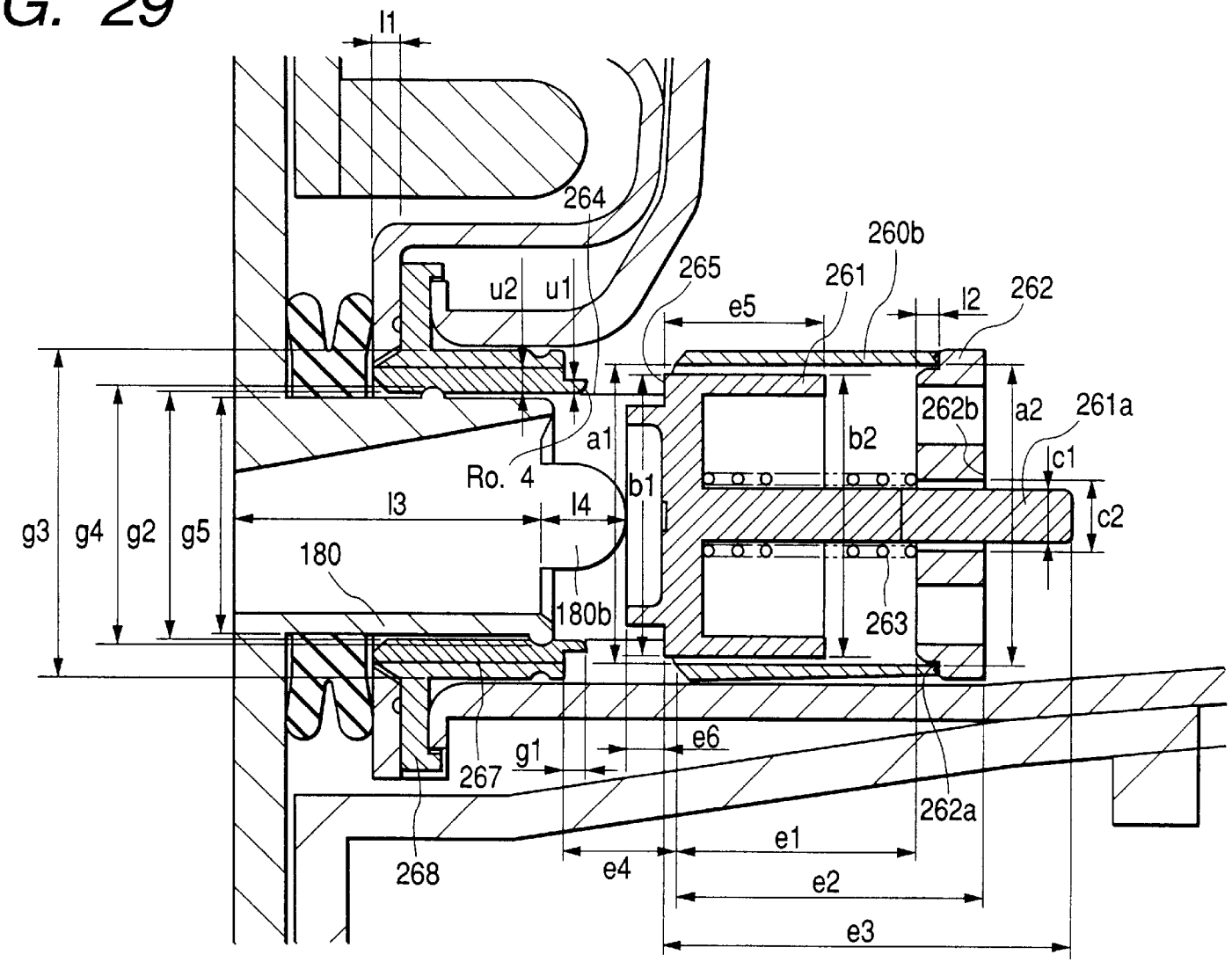
FIG. 29 shows the dimensions of components for connection with an ink tank unit applicable to the present invention.

In FIG. 29, length e5 in length direction of the valve body 261 is 5.7 mm, length e3 from the sealing part 265 of the valve body to the shaft of the sliding shaft 261*a* of the valve body is 14.4 mm, length e1 from the second valve frame 260*b* to the internal side surface the valve lid 262 is 8.7 mm, length e2 from the second valve frame 260*b* to the external side surface the valve lid 262 is 11.0 mm, length e4 of the opening part between the first valve frame 260*a* and the second valve frame 260*b* is 3.0 mm, projection e6 of the rib part from the valve body sealing part 265 of the valve body 261 is 1.3 mm, length 12 of the welding guide 262*a* of the valve lid is 0.8 mm, length b1 in length direction of sealing part 265 of the valve body 261 is 9.7 mm, length b2 in length direction of the valve lid 262 side of the valve body 261 is 9.6 mm, length a1 in length direction of the first valve frame 260*a* side of the second valve frame 260*b* is 10.2 mm, length a2 in length direction of the valve lid 262 side of the second valve frame 260*b* is 10.4 mm, the shaft diameter c1 of the sliding shaft 261*a* is 1.8 mm, hole diameter c2 in which the sliding shaft 261*a* of the valve body of the valve lid 262 is inserted is 2.4 mm, length of a spring as the energizing member 263 is 11.8 mm (spring constant is 1.016 N/mm), R part 262*b* R of the valve lid 262 is 0.2 mm (entire surrounding), length g1 of the first valve frame seal part 264 which is a part of the elastomer 267 is 0.8 mm, R part R of the first valve frame seal part 264 is 0.4 mm, thickness u1 of the first valve frame seal part 264 is 0.4 mm, thickness u2 of the elastomer 267 is 0.8 mm, internal diameter g2 in length direction of the elastomer 267 is 8.4 mm, external diameter g3 in length direction of the first valve frame 260*a* is 10.1 mm, external diameter g5 in length direction of the joint pipe 180 is 8.0 mm, external diameter g4 in length direction including the sealing projection 180*a* of the joint pipe 180 is 8.7 mm, retreating distance 11 of the flange part 268 of the first valve frame is 1.0 mm, length 13 of the joint pipe 180 is 9.4 mm, and length 14 of the valve opening and closing projection 180*b* is 2.5 mm.

Although the length g1 of the first valve frame seal part 264 is 0.8 mm, the preferable is the length exposing to outside of the valve frame by bending when the first valve frame seal part 264 is contacted to the sealing part 165 of the valve body and the length satisfactory for complete seal. For this purpose, the length g1 of the first valve frame seal part 264 may be in a range of $(g3-g2)/2>g1>(b1-g2)/2$.

Concerning the size of the valve opening and closing projection 180*b* of the joint pipe 180 and the rib 311 of the valve body 261 which are contacted each other as shown in FIG. 18 and FIGS. 25A to 25D, the thickness t of the joint pipe 180 and the rib 311 is 0.75 mm, internal distance f3 of the valve opening and closing projection 180*b* oppositely located is 1.7 mm, external distance f4 of the valve opening and closing projection 180*b* oppositely located is 3.2 mm, external distance f1 of the width direction of the rib 311 of the long hole-shaped valve body 261 is 2.6 mm, internal distance f2 of the width direction of the rib 311 is 1.4 mm, and length d of the rib 311 is 3.6 mm.

The thickness u2 of internal elastomer 267 of long hole-shaped first valve frame 260*a* is preferably equal in the circular part to linear part of the long hole-shape in view of molding preciseness. In upward and downward directions of the joint port 230, a dig length for seal between the elastomer 267 and the maximum diameter part (a position including the sealing projection 180*a*) of the joint pipe 180 is expressed by $g4-g2=0.3$ mm and this dig length is absorbed by the elastomer 267. Here, substantial thickness for absorption is 0.8 mm×2=1.6 mm. However, so large force is not necessary for deformation of the elastomer 267 because the above described dig length is 0.3 mm. On the other hand, also in the transverse direction of the joint port 230, dig length for seal was 0.3 mm to absorb the dig length by the elastomer 267 with the substantial thickness of 0.8 mm×2=1.6 mm. Here, a longitudinal direction shows a relation of "external diameter g5 of joint pipe<internal diameter g2 of length direction of elastomer" and transverse direction shows $g5<g2$, and thus, in the situation shown in FIG. 29, the elastomer contacts only to the sealing projection 180*a* of the joint pipe to allow smooth insertion and assured sealing of the connection part. Transverse rattling of the holder 150 of the ink containing container 201 is allowed in the range (±0.8 mm in the present embodiment) absorbed by the thickness of the elastomer. Allowance of rattling in the present embodiment was ±0.4 mm in the maximum. Here, in the present embodiment, in the case where transverse rattling quantity (displacement quantity from the center position) is larger than the half the absolute value of difference between the external diameter g5 of the joint pipe and the internal diameter g2 in length direction of the elastomer, namely, the case where transverse rattling in the present embodiment is ±0.2 mm or more, the outer wall of a pipe other than the sealing projection 180*a* of the joint pipe contacts and presses in a wide range of the elastomer to apply a force to return to the position of the center by the elastic force of the elastomer.

According to applying the above described sizes, the valve mechanism resulting in the above described effect is realized.

In the aforementioned explanation, the valve body 261 has been exemplified. Another valve body 1261 has substantially same configuration and therefore, an explanatory numeral is assigned thereto by adding 1000, and description is omitted herewith.

<Effect of Installation Position of Valve Mechanism>

In the ink jet head cartridge in the present embodiment, the valve lid 262 and the second valve frame 260*b* is deeply inserted into the internal bag 220 in the valve mechanism installed in the joint port 230 of the ink tank unit 200. Thus, in deformation of the internal bag 220 according to consumption of ink in the internal bag 220, even if a part of the internal bag 220 and around the joint port 230 falls from the case 210, deformation of the part around the joint port 230 in the internal bag 220 is suppressed by a part, of the valve mechanism and deeply inserted into the internal bag 220, namely the valve lid 262 and the second valve frame 260*b*. Hence, even if the internal bag 220 deforms according to consumption of ink, deformation of the part of the internal bag 220 and around the valve mechanism and surroundings thereof is suppressed by the valve mechanism and therefore, ink path around the valve mechanism in the internal bag 220 and air path for rise of bubbles in air-liquid exchange action are kept. Thus, supply of ink from the internal bag 220 to the negative pressure control unit 100 in deformation of the internal bag 220 and rise of bubbles in the internal bag 220 are not disturbed.

As described above, in the ink tank unit 200 having the deformable internal bag 220 and the ink jet head cartridge having the negative pressure control unit 100, it is preferred for increasing a buffer space in the case 210 to balance a negative pressure inside the internal bag 220 with the negative pressure inside the negative pressure control chamber container 110 to carry out air-liquid exchange action between the ink tank unit 200 and the negative pressure control chamber unit 100 after deforming the internal bag 220 larger as possible. For high speed ink supply, it is recommended to increase the joint port 230 of the ink tank unit 200. It is preferred that there is a large space in the area around the joint port 230 in the internal bag 220 and an ink supply path is fully kept in the area.

Large deformation of the internal bag 220 for keeping the buffer space in the case 210 for containing the internal bag 220 normally makes the space around the joint port 230 in the internal bag 220 small according to deformation of the internal bag 220. When the space around the joint port 230 in the internal bag 220 becomes small, high speed ink supply may be not realized, because rise of bubbles in the internal bag 220 is disturbed and the ink supply path around the joint port 230 is shortened. Consequently, in the case where the valve mechanism is not inserted in the internal bag 220 and deformation of surrounding part of the internal bag 220 and of the joint port 230 is not suppressed as in the ink jet head cartridge in the present embodiment, the negative pressure inside the internal bag 220 should be balanced with the negative pressure inside the negative pressure control chamber container 110 by suppressing deformation of the internal bag 220 to the deformation under a range not influencing largely on ink supply to realize high speed ink supply.

In contrast to this, in the present embodiment, as described above, the valve mechanism is inserted in the back of the internal bag 220 and deformation of the internal bag 220 and around the joint port 230 is suppressed by the valve mechanism. Then, even if deformation of the internal bag 220 is increased, area, namely the ink supply path connected to the joint port 230, around the joint port 230 in the internal bag 220 can be fully kept. Therefore, both keeping the large buffer space in the case 210 and supplying ink with a high flow can be realized.

In downward position of the bottom part of the above described ink tank unit 200 in the ink jet head cartridge, an electrode 270 used as residual ink detection means to detect a residual quantity of ink in the internal bag 220 is arranged as mentioned later. The electrode 270 is fixed to a carriage of a printer to which the holder 150 is installed. Here, the joint port 230, to which the valve mechanism is fitted, is installed in the bottom part of the front end surface, which becomes the negative pressure control chamber unit 100 side, of the ink tank unit 200 and the valve mechanism is deeply inserted in a direction parallel to the bottom surface of the ink tank unit 200. Therefore, when the internal bag 220 deforms, deformation of the bottom part of the internal bag 220 is suppressed by a part, of the valve mechanism, deeply inserted. In addition, deformation of the bottom of the internal bag 220 in deformation of the internal bag 220 is suppressed by that a part of the bottom part of the ink containing container 201 comprising the case 210 and the internal bag 220 is tilted. Movement of the bottom of the internal bag 220 to the electrode 270 is suppressed by further suppression of deformation of the bottom of the internal bag 220 by the valve mechanism in addition to an suppression effect on the bottom of the internal bag 220 by tilting of the bottom of the ink containing container 201 to make more accurate residual ink detection becomes possible. Thus, as described above, on the basis of that deformation of the part of the internal bag 220 and around the joint port 230 is suppressed by the valve mechanism, both keeping the large buffer space in the case 210 by increasing deformation of the internal bag 220 and ink supply with the high flow are realized, and further, a liquid supply system capable of more accurate residual ink detection is achieved.

In the present embodiment, as described above, the valve mechanism is deeply inserted to suppress deformation of the part of the internal bag 220 and around the joint port 230. However, deformation of the part of the internal bag 220 may be suppressed by inserting other member different from the valve mechanism in the internal bag 220. In addition, deformation of a part around the electrode 270 in the bottom part of the internal bag 220 may be prevented by inserting a plate member or the like from the joint port 230 to the internal bag 220 and extending the plate member along with the bottom part of the internal bag 220. Then, residual ink can be more accurately detected in detecting residual ink in the internal bag 220 by using the electrode 270.

In the valve mechanism fitted to the joint port 230 in the present embodiment, component parts of the valve mechanism is inserted in further back of the internal bag 220 from the opening 260*c* which is an ink path by connecting with the joint port 230. Thus, the ink tank unit 200 is adapted to the configuration to realize assured keeping of the ink path around the joint port 230 in the internal bag 220.

The above described explanation has exemplified the valve body 261. Another valve body 1261 has substantially same configuration and therefore, an explanatory numeral is assigned thereto by adding 1000, and description is omitted herewith.

<Manufacture of the Ink Tank>

Figure 26C:
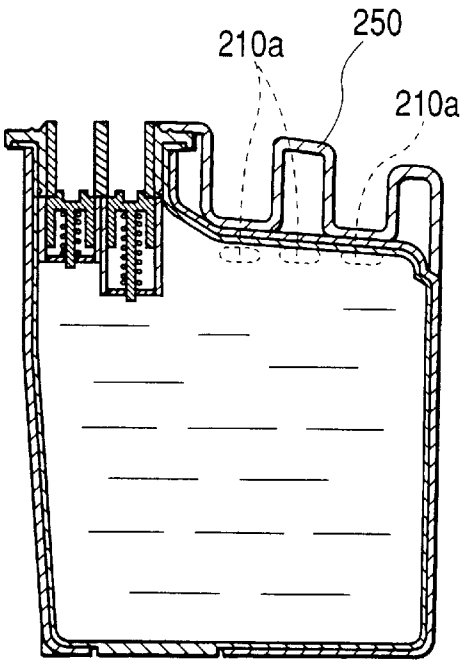
FIGS. 26A, 26B and 26C illustrate a method of producing an ink tank applicable to the present invention.
Figure 26B:
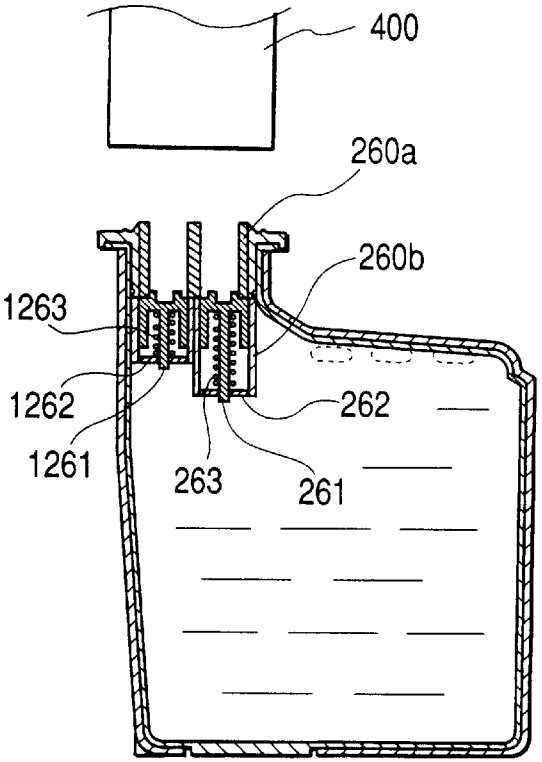
Figure 26A:
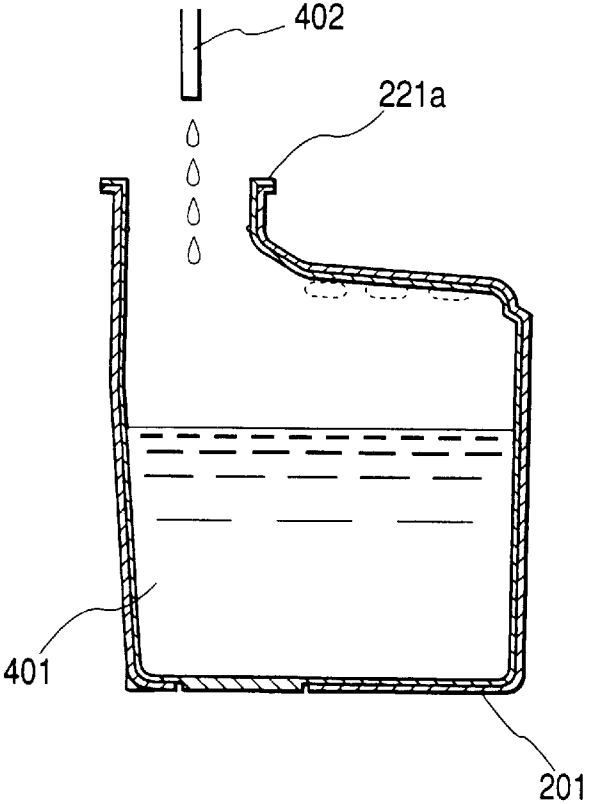

The following is description of manufacture of the ink tank of the present embodiment with reference to FIGS. 26A to 26C.

First, as shown in FIG. 26A, an exposed part 221*a* of the internal bag 220 of the ink containing container 201 is directed upward in a gravity direction and next, ink 401 is injected from an opening for ink supply to inside of the ink containing container 201 by an ink injecting nozzle 402. According to configuration of the present invention, ink can be injected under an atmospheric pressure.

Next, as shown in FIG. 26B, the valve bodies 261 and 1261, the valve lids 262 and 1262, the energizing members 263 and 1263, the first valve frame 260*a* and 1260*a*, and the second valve frame 260*b* and 1260*b* are previously assembled followed by dropping this valve unit in the supply port part of the ink containing container 201.

Here, the outer circumferential part of the sealing surface 102 of the ink containing container 201 is surrounded by a step shape outside the welded surface of the first valve frame 260*a* and 1260*a*, the positions of the ink containing container 201 and the first valve frame 260*a* and 1260*a* are determined to make positioning preciseness possible. Subsequently, a welding horn 400 is attached to the outer circumferential part of the joint port 230 and 1230 of the first valve frame 260*a* and 1260*a* and the first valve frame 260*a* and 1260*a* and the internal bag 220 of the ink containing container 201 are welded on a sealing surface 102. Then, in the outer circumferential part of the sealing surface 102, assured sealing becomes possible by welding of the first valve frame 260*a* and 1260*a* with the tank case 210 of the ink containing container 201. The present invention can be applied to ultrasonic welding and vibration welding. Furthermore, thermal welding and an adhesive are possible to apply.

As shown in FIG. 26C, the ink containing container 201, to which the first valve frames 260*a* and 1260*a* have been welded, is covered with the ID member 250. Here, an engaging part 210*a* formed in the side surface part of the case of the ink containing container 201 is engaged with a click part 250*a* of the ID member 250, and simultaneously then, the click part 250*a* in the bottom side of the ID member 250 engages with the case 210 located in an opposite direction to the sealing surface 102 of the ink containing container 201 in a situation of putting it between the first valve frames 260*a* and 1260*a* (refer to FIGS. 10A and 10B).

<Detection of Residual Ink in the Tank>

The following is descriptions about detection of residual ink in the ink tank unit.

As shown in FIG. 9, a plate-shaped electrode 270 having a narrower width than the width (back direction of the drawing) of the ink containing container 201 is installed in the bottom of a region, of the holder 150, in which the ink tank unit 200 is installed. The electrode 270 is fixed to the carriage (not illustrated) of the printer, in that the holder 150 is installed and connected to an electric control system of the printer through a wire 271.

On the other hand, the ink jet head unit 160 comprises the ink path 162 connected to the ink supply pipe 165, a plurality of nozzles (not illustrated) respectively having an energy generating device (not illustrated) generating energy for ink discharge, and a common liquid chamber 164 supplying ink supplied from the ink path 162 to respective nozzles by holding temporarily. The energy generating device is connected to a connecting terminal 281 installed in the holder 150 and the connecting terminal 281 is connected to the electric control system of the printer by installing the holder in the carriage. A recording signal from the printer is sent to the energy generating device through the connecting terminal 281. Ink is discharged from a discharge port, which is the opening end of the nozzle by applying discharge energy to ink in the nozzle, by actuation of the energy generating device.

In addition, the electrode 290 is installed to connect to the electric control system in common liquid chamber 164 through the connecting terminal 281 as it. These two electrodes 270 and 290 configure for the residual ink detection means in the ink containing container 201.

In the present embodiment, the joint port 230 of the ink tank unit 200 is made in the bottom end in using condition of a surface between surfaces of the maximum area of the ink containing container 201 shown in FIG. 9. A part of the bottom surface of the ink containing container 201 is tilted toward the horizontal surface in using condition. Specifically, if the end of a side in which the joint ports 230 and 1230 of the ink tank unit 200 is made is assumed as a front end and the opposite end is assumed rear end, around the frond end in which the valve mechanism is installed is a surface parallel to the horizontal surface and an area from there to the rear end is a sloped surface rising from the front end toward the rear end. Concerning the tilting angle of the bottom surface of the ink containing container 201, the angle making with the rear end of the ink tank unit 200 is preferably an obtuse angle in consideration of deformation of the internal bag 220 mentioned later, and made to be 95° or larger in the present embodiment.

According to such shape of the bottom surface of the ink containing container 201, the electrode 270 is arranged in a position opposite to the tilting area of the ink containing container 201 to be parallel to this tilting area.

Below, detection of residual ink left in the ink containing container 201 by using this detection means for residual ink is described.

Ink residue is detected by applying a pulsed voltage across the electrode 270 of the holder 150 side and the electrode 290 in the common liquid chamber 164 to detect a capacitance (static capacity) changing according to corresponding area of the electrode 270 to ink. For example, when a square wave pulse voltage of a peak value of 5 V with a pulse frequency of 1 kHz is applied across both these electrodes 270 and 290 to compute a time constant and gain of the circuit, residual ink in the ink containing container 201 can be detected.

When residual ink in the ink containing container 201 is reducing according to consumption of ink, an ink level drops to the bottom surface of the ink containing container 201. When residual ink further reduces and then ink level reaches the tilting area of the bottom surface of the ink containing container 201, corresponding area of the electrode 270 to ink gradually decreases (distance between the electrode 270 and ink is almost constant) according to consumption of ink to start reducing the capacitance.

Finally, there becomes no ink in a site corresponding to the electrode 270. Drop of gain and rise of an electric resistance caused by ink can be detected by computing the time constant by changing a pulse width of the pulse applied and changing a pulse frequency. Hence, very small quantity of ink left in the ink containing container 201 is known.

The above described is an outline of detection of residual ink. Practically, the ink containing container 201 is configured by the internal bag 220 and the case 210. The internal bag 220 deforms toward the inside in a direction of reduction of content volume performing air-liquid exchange between them and introducing air between the case 210 and the internal bag 220 through a connection port 222 to external air according to consumption of ink in order to keep a balance of the negative pressure inside the negative pressure control chamber container 110 with the negative pressure inside the ink containing container 201.

Figure 16:
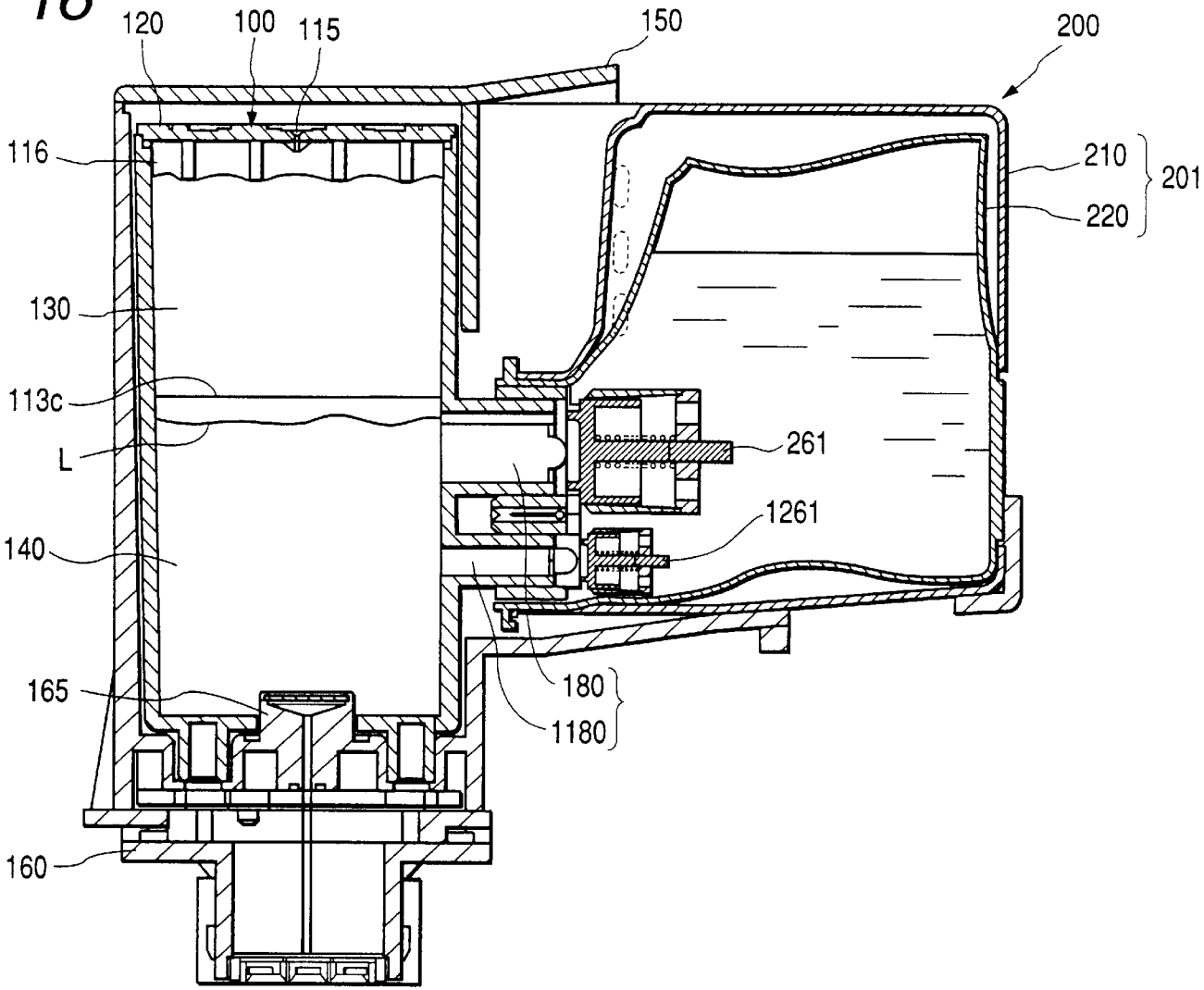
FIG. 16 is a cross-portional view illustrating ink supply from the ink-jet supply cartridge in FIG. 9.

In this deformation, as shown in FIG. 16, the internal bag 220 deforms being suppressed by a corner of the ink containing container 201. Deformation of the internal bag 220, or falling down or removal from the case 210, is maximum in the two planes which becomes the maximum area planes (a plane parallel to a portion as shown in FIG. 16) and is small in the bottom surface which is a surface abutting on the surface. Notwithstanding, distance between ink and the electrode 270 becomes large and capacitance decreases inversely to the distance according to deformation of the internal bag 220. However, in the present embodiment, the main area of the electrode 270 is located in the plane almost orthogonal to a deforming direction of the internal bag 220 and thus, even if the internal bag 220 deforms, the electrode 270 is kept almost parallel to an area around the bottom part of the internal bag 220. As a result, an area forming a static capacitance is kept to make assured detection possible.

In the present embodiment as described above, the angle of the corner part made by the bottom surface and the rear end of the ink containing container 201 is the obtuse angle 95° or larger and therefore, the internal bag 220 is easier to be released from the case 210 in comparison with other corners. As a result, configuration is made as when the internal bag 220 is deformed toward the joint port 230 and 1230, ink is easily exhausted toward the joint port 230 and 1230.

In the above portions, configuration of the present embodiment is individually described. The configuration can be practiced by combination and combination can yield more effect.

For example, combining the elliptic configuration of the joint part with the above described valve configuration can stabilize sliding movement in mounting and demounting and ensure opening and closing of the valve. Making to the elliptic shape can surely improve ink supply. Here, a fulcrum of installation by rotative motion moves upward. However, stable mounting and demounting resulting in little torsion become possible by tilting the bottom surface of the ink tank upward.

As described above, the above described configuration of the present embodiment is the configuration not provided so far, and respective components bring effects individually. In combined situation, an organized configuration yields on the basis of respective components of the configuration. In conclusion, respective configurations as described above are excellent invention individually and in view of combination and disclose examples of configurations preferable for the present invention.

(Embodiment 6)

A modified example of the sixth embodiment will be described below with reference to drawings.

Figure 30B:
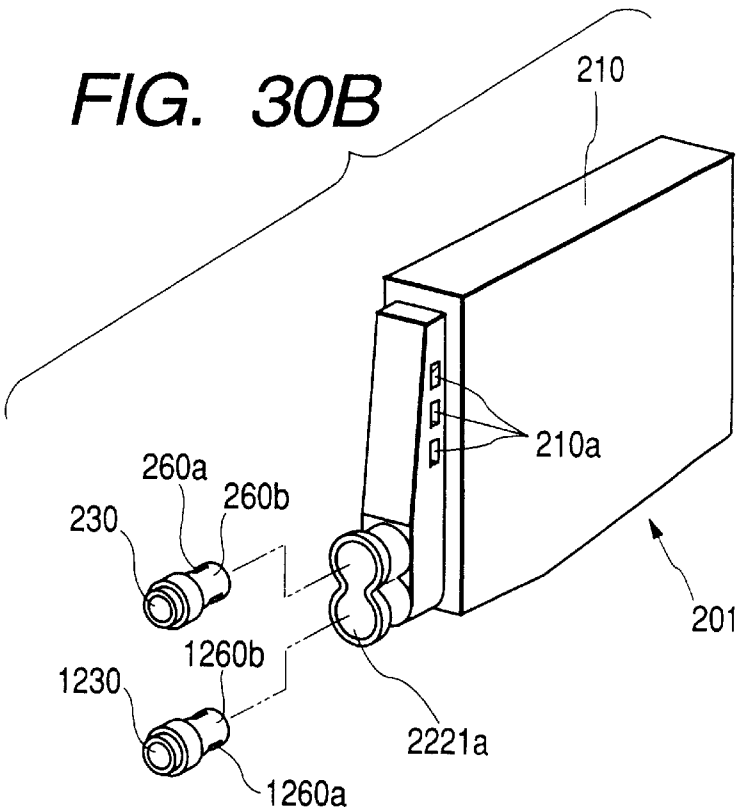
FIGS. 30A and 30B are perspective views of an ink tank unit of a modification of the present invention.
Figure 30A:
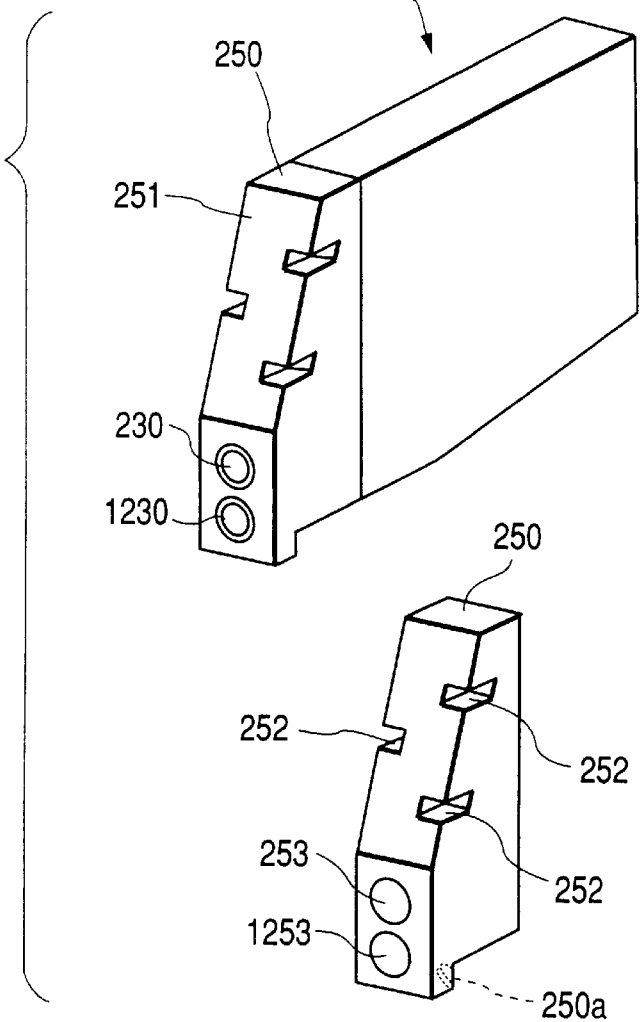

FIGS. 30A and 30B show the ink tank unit 2200 of the modified example of the fifth embodiment. In the modified example shown in FIGS. 30A and 30B, an exposed part 2221*a* of a single internal bag is configured to insert two second valve frames 260*b* and 1260*b*. Other than this configuration is same as that of FIGS. 10A and 10B.

Figure 31:
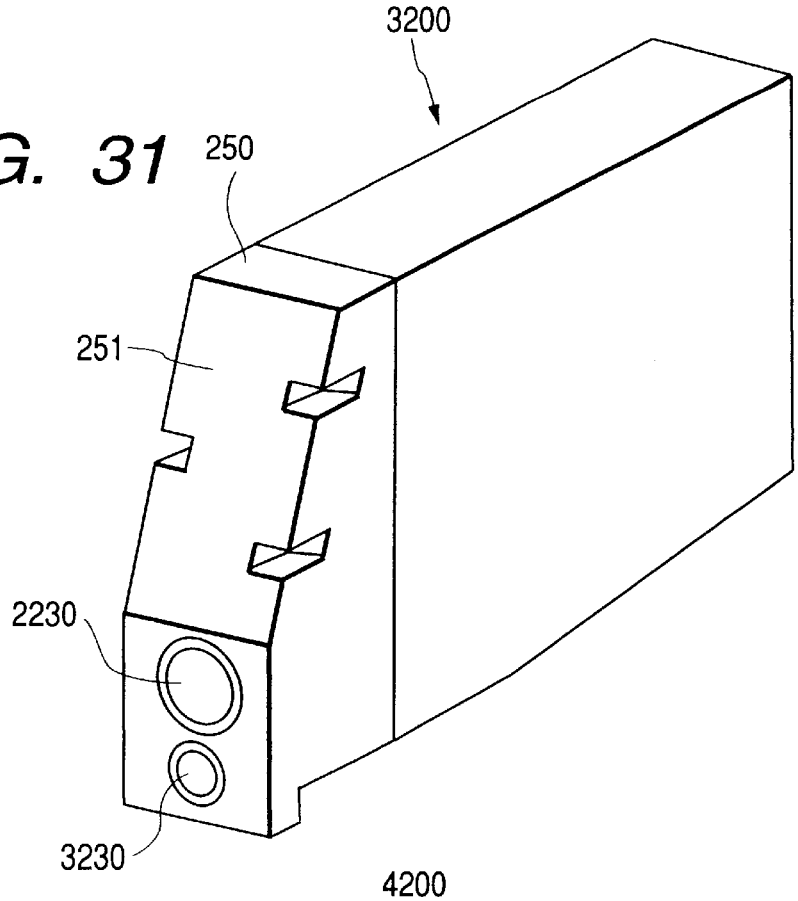
FIG. 31 is a perspective view of an ink tank unit of another modification.

FIG. 31 shows the ink tank unit 3200 of the modified example of the present embodiment. In the modified example shown in FIG. 31, a circular joint port 2230 which is located in perpendicularly upward has a diameter larger than that of the circular joint port 3230 located in perpendicularly downward. A joint pipe (not illustrated) connected to downward joint port 3230 is the connecting pipe for liquid supply to pass only ink and thus, continuous flow of liquid is easily kept regardless of a small diameter. The joint pipe (not illustrated) of the upward joint port 2230 is the connecting pipe for air-liquid exchange to pass air and ink and thus, the small diameter causes a large resistance against movement of bubbles (air), difficult movement of bubbles to the ink tank unit 200, and difficulty of smooth air-liquid exchange action. Then, the diameters of the upward joint pipe and the upward joint port 2230 are made large to realize a small resistance against movement of bubbles (air), easy movement of bubbles to the ink tank unit 200, and smooth air-liquid exchange action.

Figure 32:
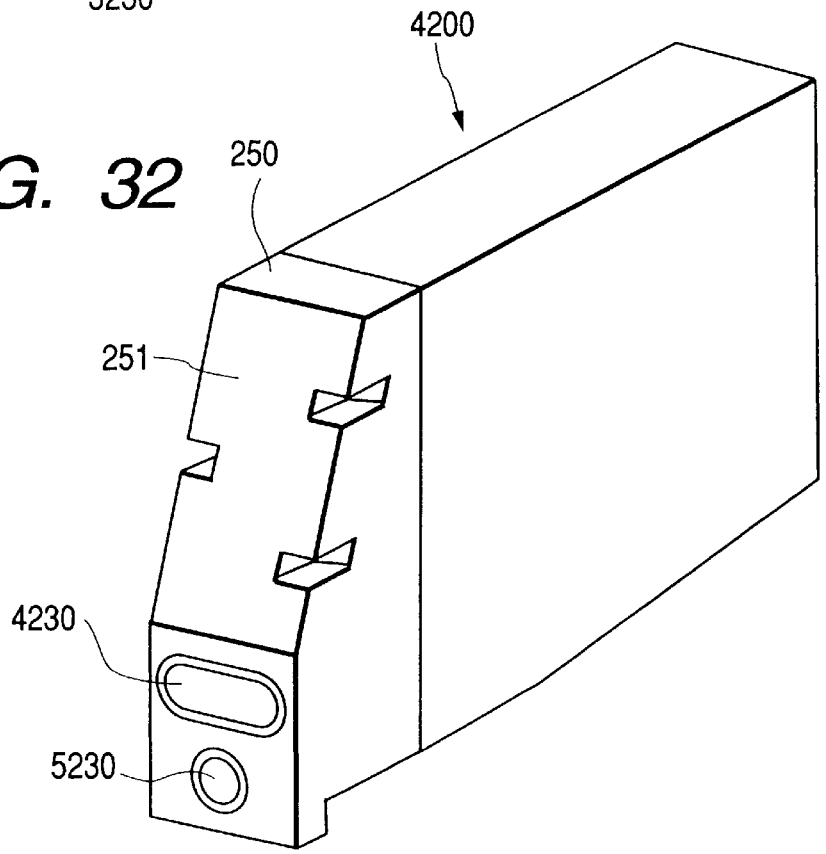
FIG. 32 is a perspective view of an ink tank unit of still another modification.
Figure 33:
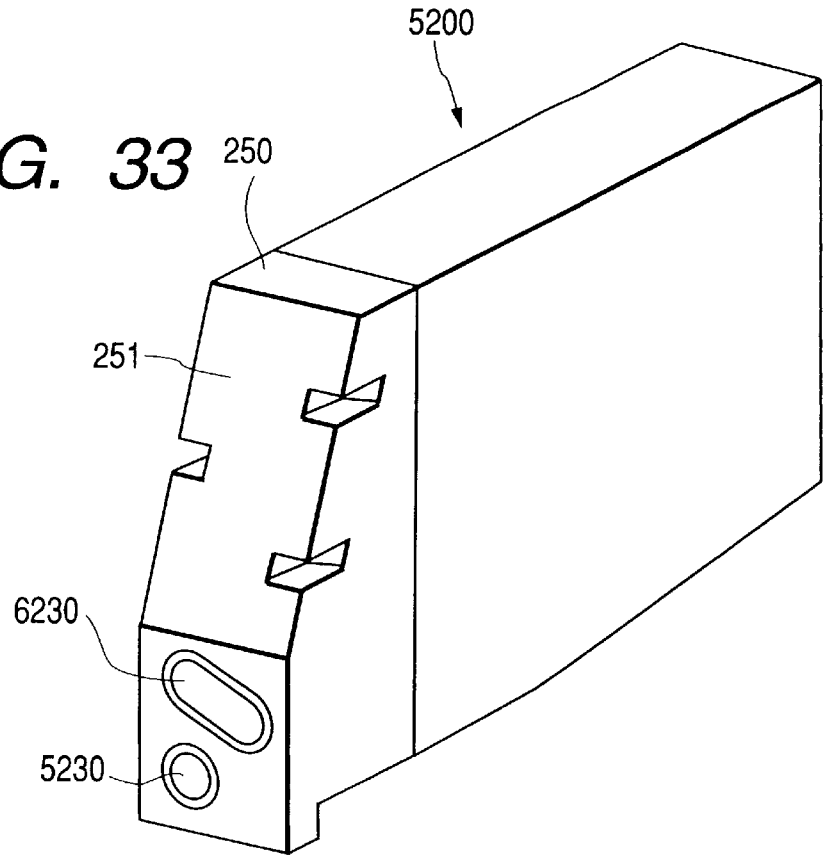
FIG. 33 is a perspective view of an ink tank unit of a further modification.

In the ink tank unit 4200 of the modified example shown in FIG. 32, as same as FIG. 31, a joint port 4230 located in perpendicularly upward has an area larger than that of the joint port 5230 located in perpendicularly downward. In the present embodiment, the upward joint port 4230 has a transversely elliptic shape of longitudinal to transverse ratio of 1:3. Similar to the ink tank unit 5200 of the modified example that is shown in FIG. 33, configuration may be one in which upward joint port 6230 with an elliptic diameter is obliquely formed.

Figure 34:
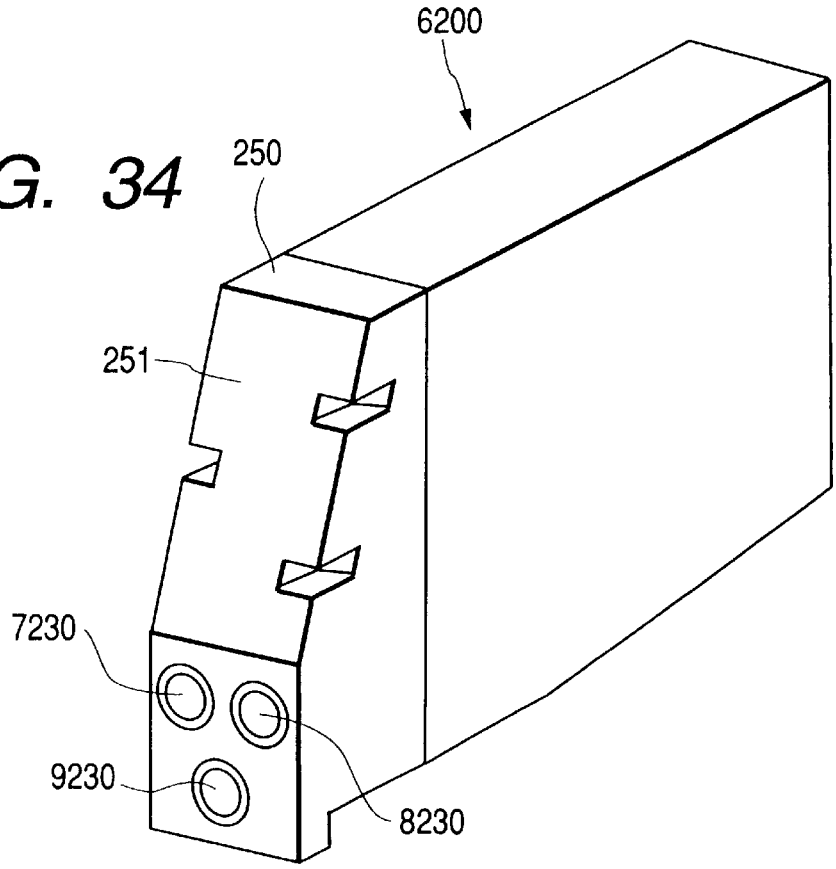
FIG. 34 is a perspective view of an ink tank unit of a still further modification.

The ink tank unit 6200 of the modified example shown in FIG. 34 is an example having three joint ports, 7230, 8230, and 9230. These three joint ports and their valves (not illustrated) have a circular portion respectively, two joint ports 7230 and 8230 are made upward, and sum of areas thereof is twice the portional area of the joint 9230*a* for ink supply.

In modified examples shown in FIGS. 30A, 30B, 31, 32 and 33, not described in detail, any one of them has a joint pipe and the valve mechanism corresponding to respective joint ports.

In the examples described above, the configuration described is that only the ink tank unit 200 has the valve mechanism (upward valve and downward valve) may be configured as that in the downward valve, the negative pressure control chamber unit 100 side has the valve mechanism and in the ink tank unit side, leaking out of ink (in the case where a single ink tank unit has been installed) is prevented by a meniscus caused by surface tension of the opening. In this case, it is preferable to seal the downward opening of the ink tank unit 200 with a seal tape or the like on sale in order to prevent leak of ink even in the case where the ink tank unit is pressed in commercial distribution.

The valve mechanism of the present invention can be most preferably used in the above described liquid containing container. However, the mode of the liquid containing container is not restricted to this mode, but can be applied to other container to contain directly a liquid through the supply port part.

(Another Embodiment)

The essential part of the present invention has been presented above. In addition, another embodiment and respective modified examples of respective embodiments applicable to respective embodiments are described below. The following descriptions can be applied to the above described embodiments unless specified otherwise.

<Structure of the Liquid Supply Container>

First, the following is addendum information about the structure of the liquid supply container 50 according to the second and third, fifth, and sixth embodiments.

The liquid supply container 50 according to the second and third embodiments are molded by direct blow molding. A case (outer wall) 51 and an ink containing part 53 (internal wall 54) separable each other are molded by expanding a cylindrical parison toward an almost polygonal pile mold keeping a coating-thickness ratio of the internal wall to the outer wall by air blow by replacing to this, a negative pressure according to flowing out of ink may be generated by installing, for example, a metal spring or the like in a flexible bag.

However, using blow molding not only allows easy manufacture of the ink containing part 53 having shapes of external appearances with a compatible or similar figure to the shape of the inner surface of the case, but also has an advantage of setting a negative pressure easily generated by changing a material and a thickness of the internal wall 54 composing the ink containing part 53. In addition, using a thermoplastic resin for the material of the internal wall 54 and the outer wall 51 can provide the liquid supply container 50 fully recyclable.

Here, addendum information is presented about the structure of "the outer wall 51" in respective embodiments above described and the structure resulted by influence of "the outer wall 51" on "the internal wall 54".

In the above described respective embodiments, the liquid supply container 50 is manufactured by blow molding and thus, the internal wall is formed thinner in the thickness of around a corner in comparison with the thickness of area around the center of the surface composing the container. In addition, the outer wall 51 is also formed thinner in the thickness of around a corner in comparison with the thickness of area around the center of the surface composing the container. Further, the internal wall 54 in comparison with the outer wall 51 is formed by layering on the outer wall 51 having the distribution of thickness gradually reducing from the central part of respective surfaces to the corner part of respective surfaces.

As the result, the internal wall 54 has an external surface coinciding to the internal surface of the outer wall 51. The external surface of the internal wall 54 follows the distribution of thickness of the outer wall 51 and thus, projects to the ink containing part 53 side formed by the internal wall 54. The internal surface of the internal wall 54 has the above described distribution of thickness of the internal wall 54 and thus, further projects to the ink containing part 53. These structures present the above described functions particularly in the maximum area part. Therefore, in the present invention, such projected shape may be in the maximum area part, be 2 mm or less in the internal wall of the projected shape, and 1 mm or less in the external surface of the internal wall. The projected shape may be in a range of a measurement error in a small area part; however, becomes a factor to bring a priority order of deformation in respective directions of the almost polygonal pile ink tank and is one of preferable condition of the present invention.

In addition, an addendum is presented herewith for the structure of the outer wall 51. Suppression of deformation of the corner part of the internal wall 54 was exemplified as a function of the above described outer wall 51. A structure to present this function may be those maintaining a shape against deformation of the internal wall 54 and having a structure (a member surrounding the corner part) covering surrounding of the corner part. Therefore, a structure may be formed by covering the above described outer wall 51 or the internal wall 54 with a material of plastic, metal or card paper. The outer wall 51 may have a full face, a surface structure only in the corner part bound with a bar and made of such as metal, or a meshed structure.

In the case where ink is exhausted in a region between an area around air-liquid exchange path 14*a* and 14*b* of a capillary attracting force generating member 13B and the area around the ink supply port 12 by any reason such as replacement of the liquid supply container 50 in case of the replacement type liquid supply container, the elastically deformable outer wall 51 is temporarily pressed by hands together with the internal wall 54 to move forcedly ink in the liquid supply container 50 to a container 10 containing the capillary attracting force generating member finally resulting in easy recovery. Such pressurizing recovery process may be automatically carried out and not manually and pressurizing recovery means for the purpose may be installed in a recording device later mentioned. In the case where a part of the internal wall 54 is exposed, only the exposed part of the internal wall 54 may be pressed.

In the second and third embodiments of the present invention, the ink containing part 53 is the almost polygonal pile shape, however, not restricted to this shape and may be at least deformable according to flowing out of ink and generable of a negative pressure by deformation.

More preferably, even if deformation and recovery of the ink containing part 53 is repeated, relation between deformation of the ink containing part 53 correspond to the negative pressure in a ink outlet 52*a* and a ink inlet 52*b* in almost 1:1 ratio. When the ink containing part 53 deforms in the range of doing elastic deformation, such preferable condition can be easily yielded.

In case of the second and third embodiments of the present invention, even if the pressure of the ink outlets 52*a* and 52*b* parts become zero after air-liquid exchange action, the ink containing part 53 somewhat maintains deformed condition. Thus, even if the ink containing part 53 does not carried out elastic deformation in a part of region, it should be treated as substantially doing elastic deformation in the case where elastic deformation is carried out a region excluding this part.

In addition, in the case where there is a condition in which a proportion of change of the negative pressure according to deformation caused by flowing out of ink changes abruptly (for example, a case of contact of deformed parts each other), it is preferable that even if it is in a rage of elastic deformation, the first ink supply condition is finished to start the second ink supply condition before this abruptly changed condition.

A material used for the liquid supply container 50 of the present invention may be that in which the outer wall 51 can be separated from the internal wall 54. A plurality of materials may be used for the internal wall 54 or the outer wall 51 to prepare a multilayer structure. A material with a high elasticity can be used for the internal wall 54 in comparison with a case independently using as a liquid containing container 50 of a negative pressure generating type. Therefore, in comparison with independent use of the liquid supply container 50 as the negative pressure generating container, the material in which the thickness of the internal wall 54 is thick or rigidity is high can be preferably used as the exchange liquid supply container for ink jet to allow a wide range of material selection as an advantage. Here, increasing the thickness of the internal wall 54 reduces gas permeability of the liquid supply container 50. Reducing gas permeability is preferable to prevent expansion of the liquid supply container 50 and leak of ink such as in commercial distribution and reservation in selling the liquid supply container 50 independently.

In consideration of effect on ink contained inside, the material used for the internal wall 54 can be such as polyethylene resin, polypropylene resin and the like preferably for use. In the above described respective embodiments and application examples, the internal wall 54 and the outer wall 51 are respectively described as those of a single layer, however, the internal wall 54 or the outer wall 51 may be made as a multilayer structure made of different materials. Particularly, in the present invention, in comparison with independent use of the liquid supply container 50 as the negative pressure generating container, such as that with thick internal wall 54 and a material with high rigidity can be preferably used as the exchange liquid supply container for ink jet and thus, there is an advantage of increase in a range of selection of combination of materials for the internal wall 54.

<Sealing Member and Hermetically Sealing Means>

In the first to third embodiments as described above, the sealing member 57 of a connecting part between the container 10 containing the capillary attracting force generating member and the liquid supply container 50 is installed in the liquid supply container 60 side. However, the sealing member 58 may be installed in either the liquid supply container 60 or the container 10 containing the capillary attracting force generating member or may be installed in both containers to increase sealing performance. In addition, it may be installed independently from respective the liquid supply container 50 and the container 10 containing the capillary attracting force generating member to fit to the connecting part between them in connecting work.

The liquid supply container 50 is mountable and demountable on the container 10 containing the capillary attracting force generating member. Therefore, in a connecting part between the liquid supply container 50 and the container 10 containing the capillary attracting force generating member, a hermetically sealing means is installed as a member to prevent leak of liquid and air from the connection part in connecting work and to prevent flowing out of ink contained in the ink containing part 53 before they are connected. In the present embodiment, any one of the hermetically sealing means uses film-like matter; however, a plug on a ball may be used. The air-liquid exchange path 14*a* and 14*b* may be a hollow needle and the hermetically sealing means may be a rubber plug.

<Ink Jet Cartridge>

Figures 35A, 35B:
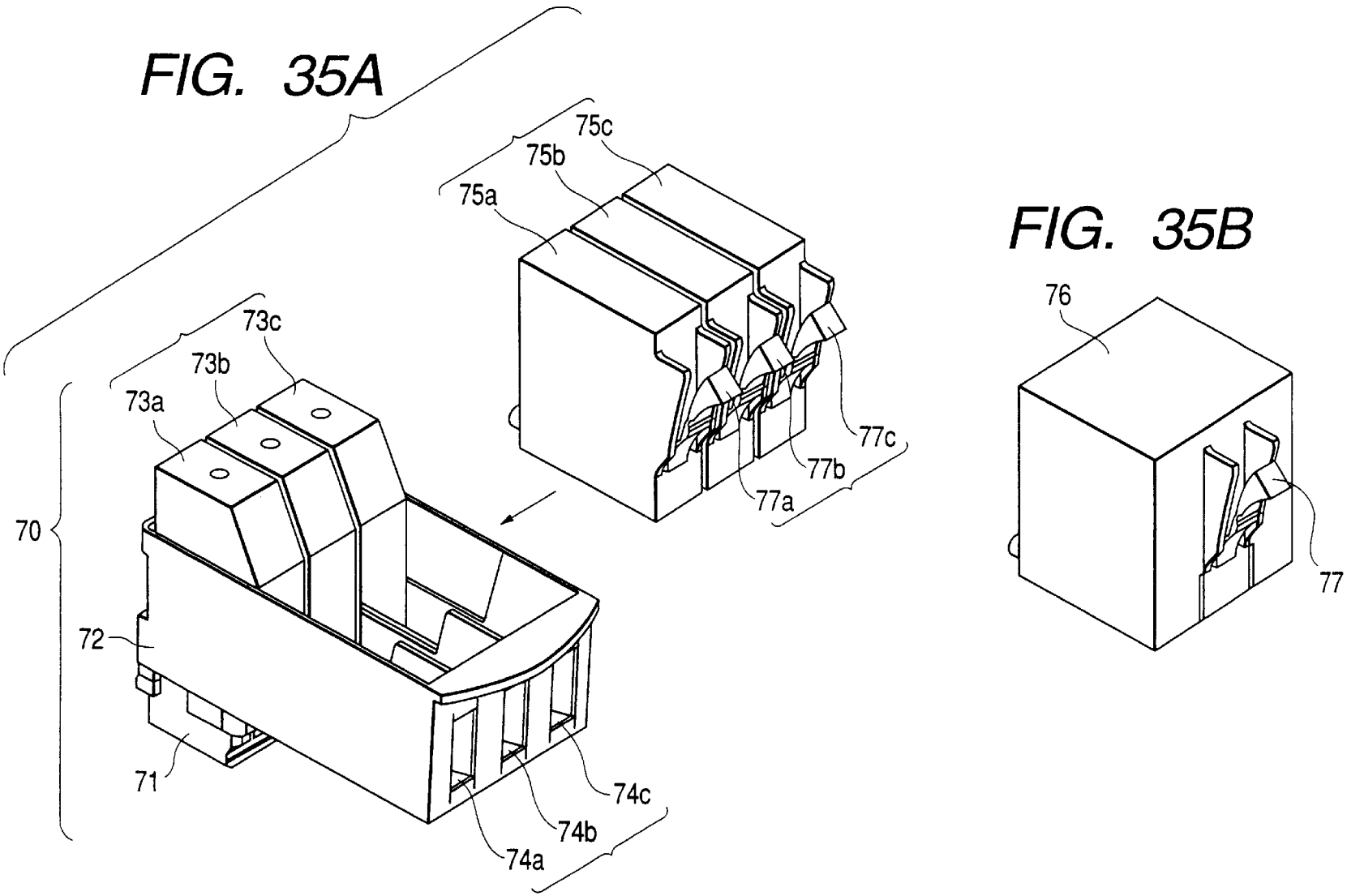
FIGS. 35A and 35B show ink-jet cartridges to which a liquid supply system of the present invention is applicable.

FIGS. 35A and 35B are figures showing an ink jet cartridge to which the liquid supply system of the present invention can be applied; FIG. 35A is an outlined perspective side view showing configuration of Ink jet cartridge using a separation type liquid supply container and FIG. 35B is an outlined perspective side view showing configuration of Ink jet cartridge using a whole-in-one type liquid supply container.

The present application example configures a head cartridge 70 integrally comprising the container 73*a,* 73*b,* and 73*c,* containing the capillary attracting force generating member, of which a liquid discharge part 71 which can eject a plurality of liquid (of three colors of yellow (Y), magenta (M), and cyan (C), in the present application example), receives respective liquids. Liquid containing containers 75A, 75B, and 75C, in which respective liquids are contained, are adapted to be alternately mountable and demountable on this head cartridge 70.

In the present embodiment, a holder part 72, which covers a part of the external surface of the liquid containing containers 75, is installed in the head cartridge 70 to connect surely respective liquid containing containers 75 to a corresponding the container 73 containing the capillary attracting force generating member. Besides, in the configuration, a connection condition after connecting is easy to keep by that latch levers 77A, 77B, and 77C having locking hooks are installed in the liquid containing containers 75 and engaging holes 74A, 74B, and 74C corresponding to the locking hooks are made in a guide member. Respective liquid containing containers 75A, 75B, and 75C have same shape and wrong installation of them can be prevented such as by putting a indication label (not illustrated) for prevention of wrong installation. The shape of the holder may be changed for each color and a configuration for prevention of wrong installation may be added. In this case, wrong installation may be prevented by changing the volume of the container according to frequency of use of each color.

As a modified example of the present embodiment, as shown in FIG. 35B, the container 76 is integrally configured by a plurality of the container containing the capillary attracting force generating member and this container 76 may be separable for the liquid discharge part each other. In this case, the latch lever installed in the liquid supply container 76 may be one. Integration as the present modification example provides an effect of prevention of wrong installation of the container 76.

In the present embodiment and modification example thereof, the kind of liquid to be contained may have other colors than Y, M, and C. Number and combination (for example, an independent tank is for black (Bk) and other Y, M, and C are for an integrated tank) of liquid containers to be installed are also free.

<Recording Machine>

Finally, an example of a liquid discharge recording machine to allow mounting of the above described liquid containing system (the ink tank) or the ink jet head cartridge will be described below.

Figure 36:
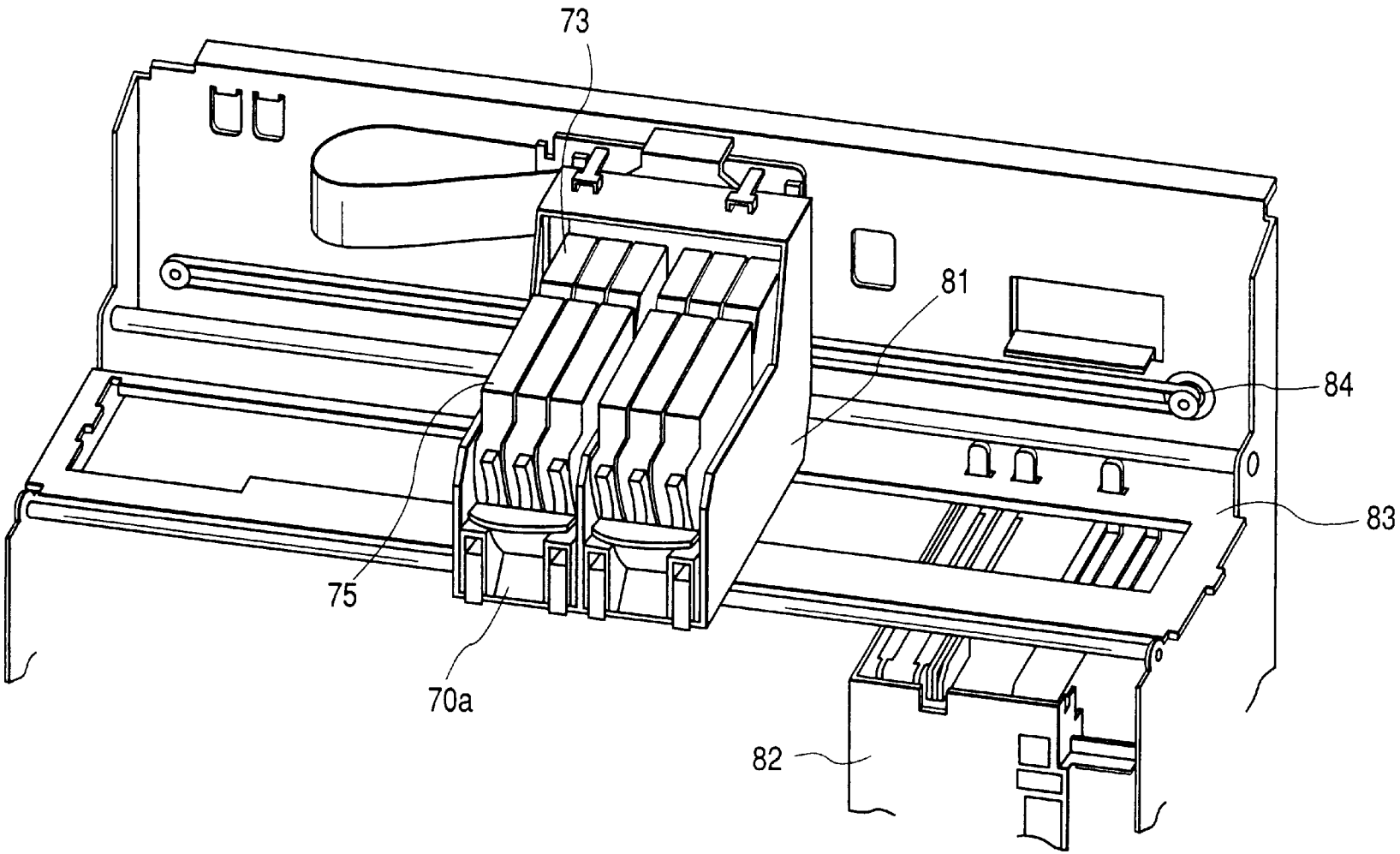
FIG. 36 shows an example of the structure of a liquid discharge recorder on which a liquid supply system of the present invention can be installed.

FIG. 36 is a figure showing a configuration example of the liquid discharge recording machine, which can be mounted, on the liquid supply system of the present invention.

In the liquid discharge recording machine shown in FIG. 36, reference numeral 81 denotes the carriage on which the liquid containing container 75 and the ink jet head cartridge 70*a* can be attachably and detachably mounted can be mounted, reference numeral 82 denotes a head recovery unit in which a head cap to prevent drying of ink by evaporation from a plurality of ports of the head and a suction pump to suck ink from a plurality of ports in malfunction of the head have been assembled, and reference numeral 83 denotes a paper supplying plane to carry a recording paper as a recording medium.

The carriage 81 has a position on the recovery unit 82 as a home position. Printing is started by scanning to the left-hand direction of the figure by driving a belt 84 by a motor or the like.

In the above described embodiment, the direction of fibers used as a member to generate a capillary attracting force is described as the transverse direction, however, the present invention is not restricted to this; the direction of fibers may be a longitudinal direction when an effect caused by the transverse direction is not expected.

What is claimed is:

1. A liquid supply system comprising:

a liquid supply container including a deformable liquid container for storing liquid in a hermetically sealed space, said liquid container deforming as liquid is supplied therefrom; and a negative pressure generating member container communicating with said liquid container through plural communication portions and containing a negative pressure generating member;

wherein said liquid supply system performs a liquid supply operation by gas-liquid exchange through said plural communication portions whereby gas is introduced into said liquid container and liquid is carried out of said liquid container into said negative pressure generating member container, wherein two of said plural communication portions are provided one above the other in a direction of gravitational force.

2. A liquid supply system, comprising:

a liquid supply container for containing liquid in a closed space;

a capillary force generating member container removably mounted on said liquid supply container and having a capillary force generating member for liquid therein;

a gas-liquid exchange connecting tube for connecting said liquid supply container and said capillary force generating member container; and a liquid supply connecting tube for connecting said liquid supply container and said capillary force generating member container;

wherein said liquid supply connecting tube is located vertically below said gas-liquid exchange connecting tube, and said liquid supply connecting tube communicates an interior of said liquid supply container with an interior of said capillary force generating member container prior to said gas-liquid exchange connecting tube when said liquid supply container is mounted to said capillary force generating member container;

wherein said liquid supply container is formed with an external layer and an internal, layer separable from said external layer;

wherein said external layer forms a substantially polyprism-like enclosure; and wherein said internal layer forms an internal bag which holds liquid, has internal surfaces congruent with or similar to the internal surfaces of the enclosure, and can deform as said liquid is carried out.

3. The liquid supply system according to claim 2, wherein said liquid supply connecting tube disconnects the interior of said liquid supply container from the interior of said capillary force generating member container after said gas-liquid exchange connecting tube when said liquid supply container is removed from said capillary force generating member container.

4. The liquid supply system according to claim 2, wherein the total of cross-sectional areas of gas-liquid exchange connecting tubes is larger than the total of cross-sectional areas of liquid supply connecting tubes.

5. The liquid supply system according to claim 4, wherein there are more gas-liquid exchange connecting tubes than liquid supply connecting tubes.

6. The liquid supply system according to claim 2, wherein connections of said capillary force generating member container include protrusions that protrude from said capillary force generating member container.

7. The liquid supply system according to claim 2, wherein:

said capillary force generating member container has an air communication port open to the outside; and said gas-liquid exchange connecting tube communicates through said negative pressure generating member with said air communication port.

* * * * *

UNITED STATES PATENT AND TRADEMARK OFFICE

CERTIFICATE OF CORRECTION

PATENT NO. : 6,505,923 B1 
DATED : January 14, 2003
INVENTOR(S) : Hajime Yamamoto et al.

It is certified that error appears in the above-identified patent and that said Letters Patent is hereby corrected as shown below:

Column 18,
Line 18, “a” should read -- an --.

Column 19,
Line 56, area a” should read -- area α --.

Column 28,
Line 26, “top of” should read -- top --.

Column 29,
Line 31, “even” should read -- even if --.

Column 30,
Line 13, “In” should read -- in --.

Column 32,
Line 1, “a” should read -- an --; and
Line 38, “on end” should read -- on an end --.

Column 37,
Line 51, “frond” should read -- front --; and
Line 61, “shaped” should read -- shaped by --.

Column 38,
Line 21, “the even in such” should read -- in the event of a --.

Column 39,
Line 6, “The” should read -- the --.

Column 40,
Line 31, “in inside” should read -- in the inside --.

Column 41,
Line 48, “no the” should read -- no --.

UNITED STATES PATENT AND TRADEMARK OFFICE

CERTIFICATE OF CORRECTION

PATENT NO. : 6,505,923 B1 
DATED : January 14, 2003
INVENTOR(S) : Hajime Yamamoto et al.

It is certified that error appears in the above-identified patent and that said Letters Patent is hereby corrected as shown below:

Column 45,
Line 26, “an” should read -- a --.

Column 47,
Line 14, “frond” should read -- front --; and
Line 30, “pulsed” should read -- pulse --.

Column 52,
Line 66, “a” should read -- an --.

Column 54,
Line 28, “internal,” should read -- internal --.

Signed and Sealed this

Ninth Day of September, 2003

JAMES E. ROGAN
*Director of the United States Patent and Trademark Office*